US010894932B2

(12) United States Patent
Schubert et al.

(10) Patent No.: US 10,894,932 B2
(45) **Date of Patent: *Jan. 19, 2021**

(54) FABRIC CARE COMPOSITION COMPRISING GLYCERIDE COPOLYMERS

(71) Applicant: The Procter & Gamble Company, Cincinnati, OH (US)

(72) Inventors: Beth Ann Schubert, Maineville, OH (US); Rajan Keshav Panandiker, West Chester, OH (US); Luke Andrew Zannoni, West Chester, OH (US); Stephanie Ann Urbin, Liberty Township, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 525 days.

This patent is subject to a terminal disclaimer.

(21) Appl. No.: 15/240,259

(22) Filed: Aug. 18, 2016

(65) Prior Publication Data

US 2018/0051235 A1 Feb. 22, 2018

(51) Int. Cl.

| | |
|---|---|
| ***C11D 3/00*** | (2006.01) |
| ***C11D 3/37*** | (2006.01) |
| ***B08B 3/04*** | (2006.01) |
| ***C11D 3/42*** | (2006.01) |
| ***C11D 1/62*** | (2006.01) |
| ***C11D 17/00*** | (2006.01) |
| ***C11D 3/40*** | (2006.01) |
| ***C11D 3/50*** | (2006.01) |
| ***C11D 3/386*** | (2006.01) |
| ***C11D 11/00*** | (2006.01) |

(52) U.S. Cl.

CPC ..... *C11D 3/3715* (2013.01); *C11D 1/62* (2013.01); *C11D 3/001* (2013.01); *C11D 3/0021* (2013.01); *C11D 3/3796* (2013.01); *C11D 3/386* (2013.01); *C11D 3/40* (2013.01); *C11D 3/42* (2013.01); *C11D 3/50* (2013.01); *C11D 11/0017* (2013.01); *C11D 17/0026* (2013.01)

(58) Field of Classification Search

CPC ..... C11D 3/00; C11D 3/37; B08B 3/04

See application file for complete search history.

(56) References Cited

U.S. PATENT DOCUMENTS

| | | | |
|---|---|---|---|
| 4,214,038 | A | 7/1980 | McCarty et al. |
| 5,466,719 | A | 11/1995 | Jakobson et al. |
| 5,587,155 | A | 12/1996 | Ochiai et al. |
| 5,879,584 | A | 3/1999 | Bianchetti et al. |
| 6,420,013 | B1 | 7/2002 | Vinson et al. |
| 6,492,315 | B1 | 12/2002 | Cao et al. |
| 6,602,494 | B1 | 8/2003 | Jahedshoar et al. |
| 7,833,516 | B2 | 11/2010 | Fack et al. |
| 7,833,517 | B2 | 11/2010 | Fack et al. |
| 7,871,601 | B2 | 1/2011 | Watanabe |
| 8,501,973 | B2 | 8/2013 | Schrodi et al. |
| 8,642,824 | B2 | 2/2014 | Lemke et al. |
| 8,692,006 | B2 | 4/2014 | Uptain et al. |
| 8,748,646 | B2 | 6/2014 | Kluesener et al. |
| 8,815,257 | B2 | 8/2014 | Braksmayer et al. |
| 8,936,796 | B2 | 1/2015 | Kitko et al. |
| 8,936,798 | B2 | 1/2015 | Kitko et al. |
| 8,957,268 | B2 | 2/2015 | Cohen et al. |
| 9,382,189 | B2 | 7/2016 | Dubois et al. |
| 2003/0134771 | A1 | 7/2003 | Ellson et al. |
| 2004/0234491 | A1 | 11/2004 | Brautigam et al. |
| 2005/0180942 | A1 | 8/2005 | Shimizu et al. |
| 2006/0018863 | A1 | 1/2006 | Mougin et al. |
| 2007/0275866 | A1 | 11/2007 | Dykstra |
| 2007/0298004 | A1 | 12/2007 | Li |
| 2009/0220443 | A1 | 9/2009 | Braksmayer et al. |
| 2009/0324527 | A1 | 12/2009 | Okada et al. |
| 2009/0324528 | A1 | 12/2009 | Okada et al. |
| 2009/0324529 | A1 | 12/2009 | Okada et al. |
| 2009/0324531 | A1 | 12/2009 | Okada et al. |
| 2009/0324532 | A1 | 12/2009 | Okada et al. |
| 2010/0047499 | A1 | 2/2010 | Braksmayer et al. |
| 2010/0145086 | A1 | 6/2010 | Schrodi et al. |
| 2011/0113679 | A1 | 5/2011 | Cohen et al. |
| 2011/0135587 | A1 | 6/2011 | Kinoshita et al. |
| 2011/0160472 | A1 | 6/2011 | Lemke et al. |
| 2011/0201533 | A1* | 8/2011 | Ponder ..... C11D 1/667 510/221 |
| 2012/0020909 | A1 | 1/2012 | Courel et al. |
| 2013/0280174 | A1 | 10/2013 | Lipic et al. |

(Continued)

FOREIGN PATENT DOCUMENTS

| | | |
|---|---|---|
| EP | 0 472 184 B1 | 10/1994 |
| GB | 1 571 527 A | 7/1980 |

(Continued)

OTHER PUBLICATIONS

U.S. Appl. No. 15/203,823, filed Jul. 7, 2016, Schubert, et al.
U.S. Appl. No. 15/203,838, filed Jul. 7, 2016, Mohammadi, et al.
U.S. Appl. No. 62/359,790, filed Jul. 8, 2016, Zannoni, et al.
U.S. Appl. No. 62/359,785, filed Jul. 8, 2016, Zannoni, et al.
U.S. Appl. No. 62/376,603, filed Jul. 8, 2016, Zannoni, et al.
U.S. Appl. No. 62/376,603, filed Aug. 18, 2016, Qing Stella.
U.S. Appl. No. 62/376,617, filed Aug. 18, 2016. Qing Stella.
International Search Report; International Application No. PCT/US2016/018372; dated Jun. 7, 2016; 10 pages.
PCT International Search Report dated May 2, 2016—4 pages.
All Office Actions U.S. Appl. No. 15/044,312.

(Continued)

*Primary Examiner* — Brian P Mruk
(74) *Attorney, Agent, or Firm* — Gary J. Foose

(57) ABSTRACT

The present invention relates to fabric cleaning and/or treatment compositions as well as methods of making and using same. Such fabric cleaning and/or treatment compositions contain species of glyceride copolymers that have the required viscosity and lubricity. Thus, such species of glyceride copolymers provide improved softening performance and formulability.

21 Claims, No Drawings

(56) References Cited

U.S. PATENT DOCUMENTS

| | | | |
|---|---|---|---|
| 2013/0280192 | A1 | 10/2013 | Carter et al. |
| 2013/0280193 | A1 | 10/2013 | Carter et al. |
| 2013/0280356 | A1 | 10/2013 | Stella et al. |
| 2013/0281551 | A1 | 10/2013 | Stella et al. |
| 2013/0344012 | A1 | 12/2013 | Cohen et al. |
| 2014/0275595 | A1 | 9/2014 | Wampler et al. |
| 2014/0275681 | A1 | 9/2014 | Cohen et al. |
| 2014/0302103 | A1 | 10/2014 | Carter et al. |
| 2014/0309154 | A1 | 10/2014 | Carter et al. |
| 2014/0357714 | A1 | 12/2014 | Braksmayer et al. |
| 2014/0377205 | A1 | 12/2014 | Uehara et al. |
| 2015/0059995 | A1 | 5/2015 | Ramaratnam et al. |
| 2015/0360015 | A1 | 12/2015 | Rabe et al. |
| 2015/0360016 | A1 | 12/2015 | Rabe et al. |
| 2016/0067153 | A1 | 3/2016 | Chen et al. |
| 2016/0090555 | A1 | 3/2016 | Frankenbach et al. |
| 2016/0095807 | A1 | 4/2016 | Stella et al. |
| 2016/0095808 | A1 | 4/2016 | Okada et al. |
| 2016/0095809 | A1 | 4/2016 | Stella et al. |
| 2016/0244698 | A1 | 8/2016 | Schubert et al. |
| 2016/0244915 | A1 | 8/2016 | Mohammadi et al. |
| 2017/0009184 | A1 | 1/2017 | Schubert et al. |

FOREIGN PATENT DOCUMENTS

| | | | |
|---|---|---|---|
| JP | H107532 | A | 1/1998 |
| WO | WO 2007/103398 | A1 | 9/2007 |
| WO | WO 2008/091681 | A2 | 7/2008 |
| WO | WO 2009/020665 | A1 | 2/2009 |
| WO | WO 2009/020667 | A1 | 2/2009 |
| WO | WO 2010/019727 | A1 | 2/2010 |
| WO | WO 2012/009525 | A2 | 1/2012 |
| WO | WO 2014/058872 | A1 | 4/2014 |

OTHER PUBLICATIONS

Schrock, Richard R., et al.; Molybdenum and Tungsten Imido Alkylidene Complexes as Efficient Olefin-Metathesis Catalysts; Angewandte Chemie Int. Ed.; 2003; pp. 4592-4633; vol. 42.

Schrock, Richard R.; High Oxidation State Multiple Metal-Carbon Bonds; Chemical Reviews; 2002; pp. 145-179; vol. 102; No. 1.

Schrock, Richard R.; Recent Advances in High Oxidation State Mo and W Imido Alkylidene Chemistry; Chemical Reviews; 2009; pp. 3211-3226; vol. 109; No. 8.

International Search Report; International Application No. PCT/US2016/041221; dated Sep. 29, 2016; 13 pages.

International Search Report; International Application No. PCT/US2016/047555; dated Apr. 25, 2017; 13 pages.

PCT International Search Report and Written Opinion for PCT/US2015/053609 dated Dec. 7, 2015.

Encyclopedia of Polymer Science and Engineering, vol. 15, 2d ed., pp. 204-308, "Silicones" John Wiley & Sons, Inc. (1989).

"DPG-Industrial", Data Sheet, Shell Chemicals, Issued Oct. 23, 2009.

"Benzyl alcohol" from Wikipedia, last modified Feb. 2, 2016, printed Mar. 15, 2016.

"Tallow Amines", Chemicalland21.com, printed Mar. 16, 2016.

"Myristic acid", from Wikipedia, last modified Dec. 3, 2015, printed Mar. 15, 2016.

PCT International Search Report and Written Opinion for PCT/US2016/013571 dated Apr. 1, 2016.

Hydetaka Akatsuka, et al., "Effect of polyols on the shear-induced structure and rheological properties of behenyl trimethyl ammonium chloride/1-octadecanol/water ternary systems", Colloids and Surfaces A: Physiochem. Eng. Aspects 326 (2008) 169-174.

PCT International Search Report and Written Opinion for PCT/US2016/013573 dated Apr. 19, 2016.

* cited by examiner

FABRIC CARE COMPOSITION COMPRISING GLYCERIDE COPOLYMERS

FIELD OF THE INVENTION

The present invention relates to fabric cleaning and/or treatment compositions as well as methods of making and using same.

BACKGROUND OF THE INVENTION

Softening agents are typically used to soften fabrics. Unfortunately, the current softening agents have a number of drawbacks which include high cost, a narrow pH formulation window, less than desirable stability and/or softening performance. In an effort to alleviate such drawbacks, new softening agents continue to be developed. Unfortunately, even such newly developed softening agents continue to have one or more of such drawbacks. Applicants recognized that the aforementioned drawbacks are due to one or more of the following factors: hydrolytic instability of ester linkage which is beta to the quaternary ammonium group in the molecule causes pH intolerance, the high charge density of quaternary ammonium headgroup causes salt intolerance and/or is incompatible with anionic materials such as anionic surfactants, excessively high molecular weights of the polymeric softening agents makes them difficult to process and dispose of. Thus what is required are cleaning and/or treatment compositions that comprise a material that can serve as a softening active but does not have the same level of drawbacks as current softening actives. Applicants recognized that glyceride copolymers can serve as such a softening active and when combined with certain fabric and home care ingredients can result in synergistic performance gains.

While not being bound by theory, Applicants believe that the uncharged nature and/or the low degree of oligomerization of the glyceride copolymers result in the lack of the aforementioned drawbacks. Thus, glyceride copolymers are salt and pH tolerant as well as easier to process and dispose of, yet have a softening capability that is at least as good as that of the best current softening agents. As a result, formulations comprising such glyceride copolymers can have wide pH ranges, and/or salt levels and still be stable. In addition, the salt, anionic and/or pH tolerance of such formulations allows a number of ingredients to be employed by the formulator, including ingredients that hitherto were not available to formulators. Furthermore, synergistic performance gains are obtained, for example, when glyceride copolymers are combined with a cationic softener agent, cationic surfactant, and/or a cationic polymer there is an unexpected gain in softness performance; an unexpected increase in phase stability is obtained when glyceride copolymers are combined with anionic surfactant; an unexpected increase in deposition of glyceride copolymers is obtained when such glyceride copolymers are combined with water soluble solid carriers; an unexpected improvement in fabric whiteness is obtained from fabrics treated with compositions comprising glyceride copolymers and a brightener, a soil dispersing polymer, a hueing dye, a dye transfer inhibiting agent, and/or a detersive enzyme and mixtures thereof; finally, an unexpected gain in perfume deposition and product stability is obtained from compositions that comprise glyceride copolymers and perfumes and/or perfume delivery systems.

Applicants recognized that the problems with commercially available glyceride copolymers lay in the rheology of such materials as such rheology resulted in a range of spreading on fabrics that was insufficient with a first class of materials and excessive spreading with a second class of materials. Thus, both classes of commercially available materials exhibited insufficient lubrication. Versions of glyceride copolymers are disclosed that have the correct rheology. Such species of glyceride copolymers provide unexpectedly improved softenening performance and formulability.

Unfortunately further improvement was needed in the area of chemical stability to oxidation and enzymes and in the area of processability as the aforementioned glyceride copolymers' viscosity limited the efficiency of processes used to make fabric care products that were formulated with such glyceride copolymers. Applicants recognized that the source of the viscosity problem lay in the fatty acid chain length distribution of the glyceride copolymers. Furthermore, glyceride copolymers derived from conventional self metathesis of unsaturated polyol esters contain impurities which cause unfavorable odor in finished product. Applicants recognized that this odor was caused by short chain olefin metathesis coproducts which are difficult to remove from the glyceride copolymer derived from self metathesis of unsaturated polyol esters. Thus, Applicants solved such problem by olefinizing and metathesizing the unsaturated polyol esters to form new glyceride coplymers. Thus, reducing the fatty acid chain length but still maintaining the molecular weight that provides the desired lubricity, and also reducing the short chain olefin in the fabric care composition and eliminating the odor. Applicants disclose such improved glyceride coplymers and products containing same herein.

SUMMARY OF THE INVENTION

The present invention relates to fabric cleaning and/or treatment compositions as well as methods of making and using same. Such fabric cleaning and/or treatment compositions contain species of glyceride copolymers that have the required viscosity and lubricity. Thus, such species of glyceride copolymers provide unexpectedly improved softening performance and formulability.

DETAILED DESCRIPTION OF THE INVENTION

Definitions

As used herein, "natural oil", "natural feedstocks," or "natural oil feedstocks" refers to oils obtained from plants or animal sources. The term "natural oil" includes natural oil derivatives, unless otherwise indicated. The terms also include modified plant or animal sources (e.g., genetically modified plant or animal sources), and derivatives produced or modified by fermentation or enzymatic processes, unless indicated otherwise. Examples of natural oils include, but are not limited to, vegetable oils, algae oils, fish oils, animal fats, tall oils, derivatives of these oils, combinations of any of these oils, and the like. Representative non-limiting examples of vegetable oils include low erucic acid rapeseed oil (canola oil), high erucic acid rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard seed oil, pennycress oil, camelina oil, hempseed oil, and castor oil. Representative non-limiting examples of animal fats include lard, tallow, poultry fat, yellow grease, and fish oil. Tall oils are by-products of wood pulp manufacture. In some embodiments, the natural oil or natural oil feedstock comprises one or more unsaturated glycerides (e.g., unsaturated triglycerides). In some such embodiments, the natural oil comprises at least 50% by weight, or at least 60% by weight, or at least 70% by weight, or at least 80% by weight, or at least 90% by weight, or at least 95% by weight, or at least 97% by weight, or at least 99% by weight of one or more unsaturated triglycerides, based on the total weight of the natural oil.

The term "natural oil glyceride" refers to a glyceryl ester of a fatty acid obtained from a natural oil. Such glycerides include monoacylglycerides, diacylglycerides, and triacylglyceriedes (triglycerides). In some embodiments, the natural oil glycerides are triglycerides. Analogously, the term "unsaturated natural oil glyceride" refers to natural oil glycerides, wherein at least one of its fatty acid residues contains unsaturation. For example, a glyceride of oleic acid is an unsaturated natural oil glyceride. The term "unsaturated alkenylized natural oil glyceride" refers to an unsaturated natural oil glyceride (as defined above) that is derivatized via a metathesis reaction with a sort-chain olefin (as defined below). In some cases, olefinizing process shortens one or more of the fatty acid chains in the compound. For example, a glyceride of 9-decenoic acid is an unsaturated alkenylized natural oil glyceride. Similarly, butenylized (e.g., with 1-butene and/or 2-butene) canola oil is a natural oil glyceride that has been modified via metathesis to contain some short-chain unsaturated $C_{10-15}$ ester groups.

The term "natural oil derivatives" refers to derivatives thereof derived from natural oil. The methods used to form these natural oil derivatives may include one or more of addition, neutralization, overbasing, saponification, transesterification, interesterification, esterification, amidation, hydrogenation, isomerization, oxidation, alkylation, acylation, sulfurization, sulfonation, rearrangement, reduction, fermentation, pyrolysis, hydrolysis, liquefaction, anaerobic digestion, hydrothermal processing, gasification or a combination of two or more thereof. Examples of natural derivatives thereof may include carboxylic acids, gums, phospholipids, soapstock, acidulated soapstock, distillate or distillate sludge, fatty acids, fatty acid esters, as well as hydroxy substituted variations thereof, including unsaturated polyol esters. In some embodiments, the natural oil derivative may comprise an unsaturated carboxylic acid having from about 5 to about 30 carbon atoms, having one or more carbon-carbon double bonds in the hydrocarbon (alkene) chain. The natural oil derivative may also comprise an unsaturated fatty acid alkyl (e.g., methyl) ester derived from a glyceride of natural oil. For example, the natural oil derivative may be a fatty acid methyl ester ("FAME") derived from the glyceride of the natural oil. In some embodiments, a feedstock includes canola or soybean oil, as a non-limiting example, refined, bleached, and deodorized oil (i.e., RBD soybean oil).

As used herein, the term "unsaturated polyol ester" refers to a compound having two or more hydroxyl groups wherein at least one of the hydroxyl groups is in the form of an ester and wherein the ester has an organic group including at least one carbon-carbon double bond.

The term "oligomeric glyceride moiety" is a moiety comprising two or more, in one aspect, up to 20, in another aspect, up to 10 constitutional units formed via olefin metathesis from natural oil glycerides and/or alkenylized natural oil glycerides.

The term "free hydrocarbon" refers to any one or combination of unsaturated or saturated straight, branched, or cyclic hydrocarbons in the $C_{2-30}$ range.

The term "metathesis monomer" refers to a single entity that is the product of an olefin metathesis reaction which comprises a molecule of a compound with one or more carbon-carbon double bonds which has undergone an alkylidene unit interchange via one or more of the carbon-carbon double bonds either within the same molecule (intramolecular metathesis) and/or with a molecule of another compound containing one or more carbon-carbon double bonds such as an olefin (intermolecular metathesis). In some embodiments, the term refers to a triglyceride or other unsaturated polyol ester that has not yet undergone an alkylidene unit interchange but contains at least one $C_{4-17}$ ester having a carbon-carbon double bond in the "omega minus n" position, where n=0, 1, 2, 3, 4, 5, or 6 and where the ester moiety has at least n+3 carbon atoms.

The term "metathesis dimer" refers to the product of a metathesis reaction wherein two reactant compounds, which can be the same or different and each with one or more carbon-carbon double bonds, are bonded together via one or more of the carbon-carbon double bonds in each of the reactant compounds as a result of the metathesis reaction.

The term "metathesis trimer" refers to the product of one or more metathesis reactions wherein three molecules of two or more reactant compounds, which can be the same or different and each with one or more carbon-carbon double bonds, are bonded together via one or more of the carbon-carbon double bonds in each of the reactant compounds as a result of the one or more metathesis reactions, the trimer containing three bonded groups derived from the reactant compounds.

The term "metathesis tetramer" refers to the product of one or more metathesis reactions wherein four molecules of two or more reactant compounds, which can be the same or different and each with one or more carbon-carbon double bonds, are bonded together via one or more of the carbon-carbon double bonds in each of the reactant compounds as a result of the one or more metathesis reactions, the tetramer containing four bonded groups derived from the reactant compounds.

The term "metathesis pentamer" refers to the product of one or more metathesis reactions wherein five molecules of two or more reactant compounds, which can be the same or different and each with one or more carbon-carbon double bonds, are bonded together via one or more of the carbon-carbon double bonds in each of the reactant compounds as a result of the one or more metathesis reactions, the pentamer containing five bonded groups derived from the reactant compounds.

The term "metathesis hexamer" refers to the product of one or more metathesis reactions wherein six molecules of two or more reactant compounds, which can be the same or different and each with one or more carbon-carbon double bonds, are bonded together via one or more of the carbon-carbon double bonds in each of the reactant compounds as a result of the one or more metathesis reactions, the hexamer containing six bonded groups derived from the reactant compounds.

The term "metathesis heptamer" refers to the product of one or more metathesis reactions wherein seven molecules of two or more reactant compounds, which can be the same or different and each with one or more carbon-carbon double bonds, are bonded together via one or more of the carbon-carbon double bonds in each of the reactant compounds as a result of the one or more metathesis reactions, the heptamer containing seven bonded groups derived from the reactant compounds.

The term "metathesis octamer" refers to the product of one or more metathesis reactions wherein eight molecules of two or more reactant compounds, which can be the same or different and each with one or more carbon-carbon double bonds, are bonded together via one or more of the carbon-carbon double bonds in each of the reactant compounds as a result of the one or more metathesis reactions, the octamer containing eight bonded groups derived from the reactant compounds.

The term "metathesis nonamer" refers to the product of one or more metathesis reactions wherein nine molecules of two or more reactant compounds, which can be the same or different and each with one or more carbon-carbon double bonds, are bonded together via one or more of the carbon-carbon double bonds in each of the reactant compounds as a result of the one or more metathesis reactions, the nonamer containing nine bonded groups derived from the reactant compounds.

The term "metathesis decamer" refers to the product of one or more metathesis reactions wherein ten molecules of two or more reactant compounds, which can be the same or different and each with one or more carbon-carbon double bonds, are bonded together via one or more of the carbon-carbon double bonds in each of the reactant compounds as a result of the one or more metathesis reactions, the decamer containing ten bonded groups derived from the reactant compounds.

The term "metathesis oligomer" refers to the product of one or more metathesis reactions wherein two or more molecules (e.g., 2 to about 10, or 2 to about 4) of two or more reactant compounds, which can be the same or different and each with one or more carbon-carbon double bonds, are bonded together via one or more of the carbon-carbon double bonds in each of the reactant compounds as a result of the one or more metathesis reactions, the oligomer containing a few (e.g., 2 to about 10, or 2 to about 4) bonded groups derived from the reactant compounds. In some embodiments, the term "metathesis oligomer" may include metathesis reactions wherein greater than ten molecules of two or more reactant compounds, which can be the same or different and each with one or more carbon-carbon double bonds, are bonded together via one or more of the carbon-carbon double bonds in each of the reactant compounds as a result of the one or more metathesis reactions, the oligomer containing greater than ten bonded groups derived from the reactant compounds.

As used herein, "metathesis" refers to olefin metathesis. As used herein, "metathesis catalyst" includes any catalyst or catalyst system that catalyzes an olefin metathesis reaction.

As used herein, "metathesize" or "metathesizing" refer to the reacting of a feedstock in the presence of a metathesis catalyst to form a "metathesized product" comprising new olefinic compounds, i.e., "metathesized" compounds. Metathesizing is not limited to any particular type of olefin metathesis, and may refer to cross-metathesis (i.e., co-metathesis), self-metathesis, ring-opening metathesis, ring-opening metathesis polymerizations ("ROMP"), ring-closing metathesis ("RCM"), and acyclic diene metathesis ("ADMET"). In some embodiments, metathesizing refers to reacting two triglycerides present in a natural feedstock (self-metathesis) in the presence of a metathesis catalyst, wherein each triglyceride has an unsaturated carbon-carbon double bond, thereby forming a new mixture of olefins and esters which may include a triglyceride dimer. Such triglyceride dimers may have more than one olefinic bond, thus higher oligomers also may form. These higher order oligomers may comprise one or more of: metathesis monomers, metathesis dimers, metathesis trimers, metathesis tetramers, metathesis pentamers, and higher order metathesis oligomers (e.g., metathesis hexamers, metathesis, metathesis heptamers, metathesis octamers, metathesis nonamers, metathesis decamers, and higher than metathesis decamers and above). Additionally, in some other embodiments, metathesizing may refer to reacting an olefin, such as ethylene, and a triglyceride in a natural feedstock having at least one unsaturated carbon-carbon double bond, thereby forming new olefinic molecules as well as new ester molecules (cross-metathesis).

As used herein, the term "olefinized natural polyol ester and/or olefinized synthetic polyol ester" refers to the product produced by metathesizing a natural and/or synthetic polyol ester with a $C_{2-14}$ olefin, preferably $C_{2-6}$ olefin, more preferably $C_{3-4}$ olefin, and mixtures and isomers thereof.

As used herein, "olefin" or "olefins" refer to compounds having at least one unsaturated carbon-carbon double bond. In certain embodiments, the term "olefins" refers to a group of unsaturated carbon-carbon double bond compounds with different carbon lengths. Unless noted otherwise, the terms "olefin" or "olefins" encompasses "polyunsaturated olefins" or "polyolefins," which have more than one carbon-carbon double bond. As used herein, the term "monounsaturated olefins" or "mono-olefins" refers to compounds having only one carbon-carbon double bond. A compound having a terminal carbon-carbon double bond can be referred to as a "terminal olefin" or an "alpha-olefin," while an olefin having a non-terminal carbon-carbon double bond can be referred to as an "internal olefin." In some embodiments, the alpha-olefin is a terminal alkene, which is an alkene (as defined below) having a terminal carbon-carbon double bond. Additional carbon-carbon double bonds can be present.

The number of carbon atoms in any group or compound can be represented by the terms: "$C_z$", which refers to a group of compound having z carbon atoms; and "$C_{x-y}$", which refers to a group or compound containing from x to y, inclusive, carbon atoms. For example, "$C_{1-6}$ alkyl" represents an alkyl chain having from 1 to 6 carbon atoms and, for example, includes, but is not limited to, methyl, ethyl, n-propyl, isopropyl, isobutyl, n-butyl, sec-butyl, tert-butyl, isopentyl, n-pentyl, neopentyl, and n-hexyl. As a further example, a "$C_{4-10}$ alkene" refers to an alkene molecule having from 4 to 10 carbon atoms, and, for example, includes, but is not limited to, 1-butene, 2-butene, isobutene, 1-pentene, 1-hexene, 3-hexene, 1-heptene, 3-heptene, 1-octene, 4-octene, 1-nonene, 4-nonene, and 1-decene.

As used herein, the terms "short-chain alkene" or "short-chain olefin" refer to any one or combination of unsaturated straight, branched, or cyclic hydrocarbons in the $C_{2-14}$ range, or the $C_{2-12}$ range, or the $C_{2-10}$ range, or the $C_{2-8}$ range. Such olefins include alpha-olefins, wherein the unsaturated carbon-carbon bond is present at one end of the compound. Such olefins also include dienes or trienes. Such olefins also include internal olefins. Examples of short-chain alkenes in the $C_{2-6}$ range include, but are not limited to: ethylene, propylene, 1-butene, 2-butene, isobutene, 1-pentene, 2-pentene, 2-methyl-1-butene, 2-methyl-2-butene, 3-methyl-1-butene, cyclopentene, 1,4-pentadiene, 1-hexene, 2-hexene, 3-hexene, 2-methyl-1-pentene, 3-methyl-1-pentene, 4-methyl-1-pentene, 2-methyl-2-pentene, 3-methyl-2-pentene, 4-methyl-2-pentene, 2-methyl-3-pentene, and cyclohexene. Non-limiting examples of short-chain alkenes in the $C_{7-9}$ range include 1,4-heptadiene, 1-heptene, 3,6-nonadiene, 3-nonene, 1,4,7-octatriene. In certain embodiments, it is preferable to use a mixture of olefins, the mixture comprising linear and branched low-molecular-weight olefins in the $C_{4-10}$ range. In some embodiments, it may be preferable to use a mixture of linear and branched $C_4$ olefins (i.e., combinations of: 1-butene, 2-butene, and/or isobutene). In other embodiments, a higher range of $C_{11-14}$ may be used.

As used herein, "alkyl" refers to a straight or branched chain saturated hydrocarbon having 1 to 30 carbon atoms, which may be optionally substituted, as herein further described, with multiple degrees of substitution being allowed. Examples of "alkyl," as used herein, include, but are not limited to, methyl, ethyl, n-propyl, isopropyl, isobutyl, n-butyl, sec-butyl, tert-butyl, isopentyl, n-pentyl, neopentyl, n-hexyl, and 2-ethylhexyl. The number of carbon atoms in an alkyl group is represented by the phrase "$C_{x-y}$ alkyl," which refers to an alkyl group, as herein defined, containing from x to y, inclusive, carbon atoms. Thus, "$C_{1-6}$ alkyl" represents an alkyl chain having from 1 to 6 carbon atoms and, for example, includes, but is not limited to, methyl, ethyl, n-propyl, isopropyl, isobutyl, n-butyl, sec-butyl, tert-butyl, isopentyl, n-pentyl, neopentyl, and n-hexyl. In some instances, the "alkyl" group can be divalent, in which case the group can alternatively be referred to as an "alkylene" group.

As used herein, "alkenyl" refers to a straight or branched chain non-aromatic hydrocarbon having 2 to 30 carbon atoms and having one or more carbon-carbon double bonds, which may be optionally substituted, as herein further described, with multiple degrees of substitution being allowed. Examples of "alkenyl," as used herein, include, but are not limited to, ethenyl, 2-propenyl, 2-butenyl, and 3-butenyl. The number of carbon atoms in an alkenyl group is represented by the phrase "$C_{x-y}$ alkenyl," which refers to an alkenyl group, as herein defined, containing from x to y, inclusive, carbon atoms. Thus, "$C_{2-6}$ alkenyl" represents an alkenyl chain having from 2 to 6 carbon atoms and, for example, includes, but is not limited to, ethenyl, 2-propenyl, 2-butenyl, and 3-butenyl. In some instances, the "alkenyl" group can be divalent, in which case the group can alternatively be referred to as an "alkenylene" group.

As used herein, "direct bond" refers to an embodiment where the identified moiety is absent from the structure, and is replaced by a bond between other moieties to which it is connected. For example, if the specification or claims recite A-D-E and D is defined as a direct bond, the resulting structure is A-E.

As used herein, "substituted" refers to substitution of one or more hydrogen atoms of the designated moiety with the named substituent or substituents, multiple degrees of substitution being allowed unless otherwise stated, provided that the substitution results in a stable or chemically feasible compound. A stable compound or chemically feasible compound is one in which the chemical structure is not substantially altered when kept at a temperature from about −80° C. to about +40° C., in the absence of moisture or other chemically reactive conditions, for at least a week. As used herein, the phrases "substituted with one or more . . . " or "substituted one or more times . . . " refer to a number of substituents that equals from one to the maximum number of substituents possible based on the number of available bonding sites, provided that the above conditions of stability and chemical feasibility are met.

As used herein, the term "polyol" means an organic material comprising at least two hydroxy moieties.

As used herein, the term "$C_{10-14}$ unsaturated fatty acid ester" means a fatty acid ester that comprises 10, 11, 12, 13 or 14 carbon atoms, wherein the fatty acid ester chain has at least one carbon-carbon double bond.

In some instances herein, organic compounds are described using the "line structure" methodology, where chemical bonds are indicated by a line, where the carbon atoms are not expressly labeled, and where the hydrogen atoms covalently bound to carbon (or the C—H bonds) are not shown at all. For example, by that convention, the formula

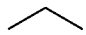

represents n-propane. In some instances herein, a squiggly bond is used to show the compound can have any one of two or more isomers. For example, the structure

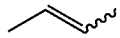

can refer to (E)-2-butene or (Z)-2-butene. The same is true when olefinic structures are drawn that are ambiguous as to which isomer is referred to. For example, $CH_3$—CH═CH—$CH_3$ can refer to (E)-2-butene or (Z)-2-butene.

As used herein, the various functional groups represented will be understood to have a point of attachment at the functional group having the hyphen or dash (-) or an asterisk (*). In other words, in the case of —$CH_2CH_2CH_3$, it will be understood that the point of attachment is the $CH_2$ group at the far left. If a group is recited without an asterisk or a dash, then the attachment point is indicated by the plain and ordinary meaning of the recited group.

As used herein, multi-atom bivalent species are to be read from left to right. For example, if the specification or claims recite A-D-E and D is defined as —OC(O)—, the resulting group with D replaced is: A-OC(O)-E and not A-C(O)O-E.

As used herein, the term "fabric care composition" includes compositions that can be used to clean and/or soften fabrics through the wash, through the rinse or during drying, unless otherwise indicated, such compositions include granular or powder-form all-purpose or "heavy-duty" washing agents, especially cleaning detergents; liquid, gel or paste-form all-purpose washing agents, especially the so-called heavy-duty liquid types; liquid fine-fabric detergents, especially those of the high-foaming type; including the various tablet, granular, unit dose forms for household and institutional use; cleaning bars, car or carpet cleaners, fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets. All of such products which were applicable may be in standard, concentrated or even highly concentrated form even to the extent that such products may in certain aspect be non-aqueous.

As used herein, the term "solid" includes granular, powder, bar, beads, pastilles and tablet product forms.

As used herein, the articles including "a" and "an" when used in a claim, are understood to mean one or more of what is claimed or described.

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated with the proviso that the sum of the percentage of all ingredients for a respective mixture/formula cannot exceed or be less than 100%.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Compositions, Articles, Methods of Use and Treated Articles

Paragraphs (a) Through (vv)

The following compositions, methods of use and treated articles are disclosed:

(a) A composition comprising,

A) a material selected from the group consisting of:

(i), a first glyceride copolymer, comprising, based on total weight of first glyceride copolymer, from about 3% to about 30%, from about 3% to about 25%, or from about 5% to about 20% $C_{10-14}$ unsaturated fatty acid esters; in one aspect, said first glyceride copolymer comprises, based on total weight of first glyceride copolymer, from about 3% to about 30%, from about 3% to about 25%, or from about 3% to about 20% $C_{10-13}$ unsaturated fatty acid esters; in one aspect said first glyceride copolymer comprises, based on total weight of first glyceride copolymer, from about 0.1% to about 30%, from about 0.1% to about 25%, from about 0.2% to about 20%, or from about 0.5% to about 15% $C_{10-11}$ unsaturated fatty acid esters;

(ii) a second glyceride copolymer having formula (I):

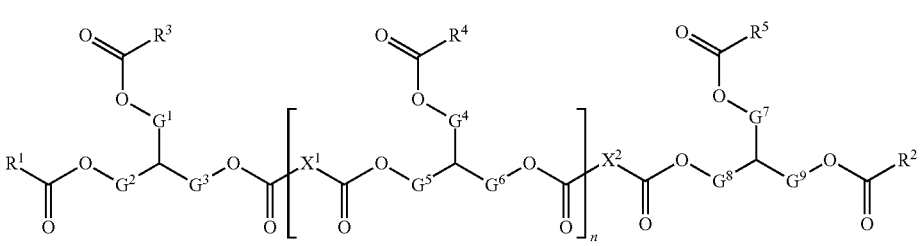

(I)

wherein:

each $R^1$, $R^2$, $R^3$, $R^4$, and $R^5$ in second glyceride copolymer is independently selected from the group consisting of an oligomeric glyceride moiety, a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties; and/or wherein each of the following combinations of moieties may each independently be covalently linked:

$R^1$ and $R^3$, $R^2$ and $R^5$, $R^1$ and an adjacent $R^4$, $R^2$ and an adjacent $R^4$, $R^3$ and an adjacent $R^4$, $R^5$ and an adjacent $R^4$, or any two adjacent $R^4$ such that the covalently linked moieties form an alkenylene moiety;

each $X^1$ and $X^2$ in said second glyceride copolymer is independently selected from the group consisting of a $C_{1-32}$ alkylene, a substituted $C_{1-32}$ alkylene wherein the substituent is one or more —OH moieties, a $C_{2-32}$ alkenylene or a substituted $C_{2-32}$ alkenylene wherein the substituent is one or more —OH moieties;

two of $G^1$, $G^2$, and $G^3$ are —$CH_2$—, and one of $G^1$, $G^2$, and $G^3$ is a direct bond;

for each individual repeat unit in the repeat unit having index n, two of $G^4$, $G^5$, and $G^6$ are —$CH_2$—, and one of $G^4$, $G^5$, and $G^6$ is a direct bond, and the values $G^4$, $G^5$, and $G^6$ for each individual repeat unit are independently selected from the values of $G^4$, $G^5$, and $G^6$ in other repeating units;

two of $G^7$, $G^8$, and $G^9$ are —$CH_2$—, and one of $G^7$, $G^8$, and $G^9$ is a direct bond;

n is an integer from 3 to 250;

with the proviso for each of said second glyceride copolymers at least one of $R^1$, $R^2$, $R^3$, and $R^5$, and/or at least one $R^4$ in one individual repeat unit of said repeat unit having index n, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl; in one aspect, said second glyceride copolymer comprises based on total weight of second glyceride copolymer, from about 3% to about 30%, from about 3% to about 25%, or from about 5% to about 20% $C_{9-13}$ alkenyl moieties; in one aspect, said second glyceride copolymer comprises, based on total weight of second glyceride copolymer, from about 3% to about 30%, from about 3% to about 25%, or from about 3% to about 20% $C_{9-12}$ alkenyl moieties; in one aspect, said second glyceride copolymer comprises, based on total weight of second glyceride copolymer, from about 0.1% to about 30%, from about 0.1% to about 25%, from about 0.2% to about 20%, or from about 0.5% to about 15% $C_{9-10}$ alkenyl moieties; and (iii) optionally, a third glyceride copolymer, which comprises constitutional units formed from reacting, in the presence of a metathesis catalyst, one or more compounds from each of the compounds having the following formulas:

Formula (IIa):

(IIa)

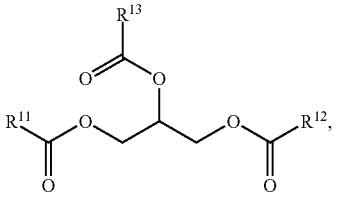

Formula (IIb):

(IIb)

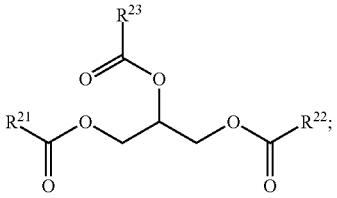

wherein, each $R^{11}$, $R^{12}$, and $R^{13}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties with the proviso that at least one of $R^{11}$, $R^{12}$, and $R^{13}$ is a $C_{2-24}$ alkenyl or a substituted $C_{2-24}$ alkenyl wherein the substituent is one or more —OH moieties; and each $R^{21}$, $R^{22}$, and $R^{23}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties, with the proviso that at least one of $R^{21}$, $R^{22}$, and $R^{23}$ is 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl;

wherein the number ratio of constitutional units formed from monomer compounds of formula (IIa) to constitutional units formed from monomer compounds of formula (IIb) is no more than 10:1; and (iv) mixtures thereof; and B) a material selected from the group consisting of a fabric softener active, a fabric care benefit agent, an anionic surfactant scavenger, a delivery enhancing agent, a perfume, a perfume delivery system, a structurant, a soil dispersing polymer, a brightener, a hueing dye, dye transfer inhibiting agent, builder, surfactant, an enzyme, in one aspect, a detersive enzyme and mixtures thereof, and optionally a carrier, in one aspect said composition has a pH of from about 2 to about 12 said composition being a fabric care composition.

(b) The composition of Paragraph (a) wherein said first, second, and third glyceride copolymers have a weight average molecular weight of from about 4,000 g/mol to about 150,000 g/mol, from about 5,000 g/mol to about 130,000 g/mol, from about 6,000 g/mol to about 100,000 g/mol, from about 7,000 g/mol to about 50,000 g/mol, from about 8,000 g/mol to about 30,000 g/mol, or from about 8,000 g/mol to about 20,000 g/mol.

(c) The composition according to Paragraphs (a) through (b) wherein said first, second, and third glyceride copolymers are produced by a process comprising metathesis; in one aspect, said process comprises reacting two or more monomers in the presence of the metathesis catalyst as part of a reaction mixture, wherein the weight-to-weight ratio of the monomer compounds of formula (IIa) to the monomer compounds of formula (IIb) in the reaction mixture is no more than 10:1, no more than 9:1, no more than 8:1, no more than 7:1, no more than 6:1, no more than 5:1, no more than 4:1, no more than 3:1, no more than 2:1, or no more than 1:1; in one aspect, the metathesis catalyst is an organo-ruthenium compound, an organo-osmium compound, an organo-tungsten compound, or an organo-molybdenum compound.

(d) The composition according to Paragraphs (a) through (c), wherein for said second glyceride copolymer at least one of $R^1$, $R^2$, $R^3$, $R^4$, or $R^5$ is a $C_{9-13}$ alkenyl, in one aspect, at least one of $R^1$, $R^2$, $R^3$, $R^4$, or $R^5$ is a $C_{9-12}$ alkenyl, in another aspect, at least one of $R^1$, $R^2$, $R^3$, $R^4$, or $R^5$ is a $C_{9-10}$ alkenyl.

(e) The composition according to Paragraphs (a) through (d), wherein for said third glyceride copolymer at least one of $R_{11}$, $R^{12}$, $R^{13}$, $R^{21}$, $R^{22}$, or $R^{23}$ is a $C_{9-13}$ alkenyl, in one aspect, at least one of $R^{11}$, $R^{12}$, $R^{13}$, $R^{21}$, $R^{22}$, or $R^{23}$ is a $C_{9-12}$ alkenyl, in another aspect, at least one of $R^{11}$, $R^{12}$, $R^{13}$, $R^{21}$, $R^{22}$, or $R^{23}$ is a $C_{9-10}$ alkenyl.

(f) The composition according to Paragraphs (a) through (e), wherein the second glyceride copolymer's $G^1$ and $G^2$ moieties are —$CH_2$— and $G^3$ is a direct bond.

(g) The composition according to any of Paragraphs (a) through (e), wherein the second glyceride copolymer's $G^1$ and $G^3$ moieties are —$CH_2$— and $G^2$ is a direct bond.

(h) The composition according to any of Paragraphs (a) through (e), wherein the second glyceride copolymer's $G^2$ and $G^3$ moieties are —$CH_2$— and $G^1$ is a direct bond.

(I) The composition according to Paragraphs (a) through (h), wherein for the second glyceride copolymer, at least one of, $G^4$ and $G^5$ are —$CH_2$— and $G^6$ is a direct bond.

(j) The composition according to any of Paragraphs (a) through (h), wherein for the second glyceride copolymer, at least one of, $G^4$ and $G^6$ are —$CH_2$— and $G^5$ is a direct bond.

(k) The composition according to any of Paragraphs (a) through (h), wherein for the second glyceride copolymer, at least one of, $G^5$ and $G^6$ are —$CH_2$— and $G^4$ is a direct bond.

(l) The composition according to any of Paragraphs (a) through (k), wherein for the second glyceride copolymer, at least one of, $G^7$ and $G^8$ are —$CH_2$— and $G^9$ is a direct bond.

(m) The composition according to Paragraphs (a) through (k), wherein for the second glyceride copolymer, at least one of $G^7$ and $G^9$ are —$CH_2$— and $G^8$ is a direct bond.

(n) The composition according to Paragraphs (a) through (k), wherein for the second glyceride copolymer, at least one of $G^8$ and $G^9$ are —$CH_2$— and $G^7$ is a direct bond.

(o) The composition according to any of Paragraphs (a) through (n), wherein for the second glyceride copolymer, each $X^1$ is independently selected from the group consisting of —$(CH_2)_{16}$—, —$(CH_2)_{18}$—, —$(CH_2)_{19}$—, —$(CH_2)_{29}$—, —$(CH_2)_{22}$—, —$(CH_2)_{24}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_{11}$—CH═CH—$(CH_2)_{11}$—, —$(CH_2)_7$—CH═CH—$CH_2$—CH═CH—$(CH_2)_{11}$—, —$(CH_2)_{11}$—CH═CH—$CH_2$—CH═CH—$(CH_2)_7$—, —$(CH_2)_7$—CH═CH—$CH_2$—CH═CH—$CH_2$—CH═CH—$(CH_2)_{11}$—, —$(CH_2)_{11}$—CH═CH—$CH_2$—CH═CH—$CH_2$—CH═CH—$(CH_2)_7$—, —$(CH_2)_9$—CH═CH—$(CH_2)_7$, —$(CH_2)_7$—CH═CH—$(CH_2)_9$, —$(CH_2)_{11}$—CH═CH—$(CH_2)_7$—, or —$(CH_2)_7$—CH═CH—$(CH_2)_{11}$—.

(p) The composition according to any of Paragraphs (a) through (m), wherein for the second glyceride copolymer, each $X^2$ is independently selected from the group consisting of —$(CH_2)_{16}$—, —$(CH_2)_{18}$—, —$(CH_2)_{19}$—, —$(CH_2)_{29}$—, —$(CH_2)_{22}$—, —$(CH_2)_{24}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$, —$(CH_2)_7$—CH═CH—$CH_2$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_{11}$—CH═CH—$(CH_2)_{11}$—, —$(CH_2)_7$—CH═CH—$CH_2$—CH═CH—$(CH_2)_{11}$—, —$(CH_2)_{11}$—CH═CH—$CH_2$—CH═CH—$(CH_2)_7$—, —$(CH_2)_7$—CH═CH—$CH_2$—CH═CH—$CH_2$—CH═CH—$(CH_2)_{11}$—, —$(CH_2)_{11}$—CH═CH—$CH_2$—CH═CH—$CH_2$—CH═CH—$(CH_2)_7$—, —$(CH_2)_9$—CH═CH—$(CH_2)_7$, —$(CH_2)_7$—CH═CH—$(CH_2)_9$, —$(CH_2)_{11}$—CH═CH—$(CH_2)_7$—, or —$(CH_2)_7$—CH═CH—$(CH_2)_{11}$—.

(q) The composition according to any of Paragraphs (a) through (p), wherein for the second glyceride copolymer, $R^1$ is a $C_{1-24}$ alkyl or a $C_{2-24}$ alkenyl; in one aspect, $R^1$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl, in another aspect, $R^1$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(r) The composition according to any of Paragraphs (a) through (q), wherein for the second glyceride copolymer, $R^2$ is a $C_{1-24}$ alkyl or a $C_{2-24}$ alkenyl; in one aspect, $R^2$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in another aspect, $R^2$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(s) The composition according to any of Paragraphs (a) through (r), wherein for the second glyceride copolymer, $R^3$ is a $C_{1-24}$ alkyl or a $C_{2-24}$ alkenyl; in one aspect, $R^3$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in another aspect, $R^3$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(t) The composition according to any of Paragraphs (a) through (s), wherein for the second glyceride copolymer, each $R^4$ is independently selected from a $C_{1-24}$ alkyl and a $C_{2-24}$ alkenyl; in one aspect, each $R^4$ is independently selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in another aspect, each $R^4$ is independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(u) The composition according to any of Paragraphs (a) through (t), wherein for the second glyceride copolymer, $R^5$ is a $C_{1-24}$ alkyl or a $C_{2-24}$ alkenyl; in one aspect, $R^5$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in another aspect, $R^5$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(v) The composition according to any of Paragraphs (a) through (u), wherein for the second glyceride copolymer, n is an integer from 3 to 250, from 5 to 180, from 6 to 140, from 8 to 70, from 9 to 40, or from 9 to 26.

(w) The composition according to Paragraphs (a) through (c), wherein for the third glyceride copolymer, $R^{11}$, $R^{12}$, and $R^{13}$ are each independently selected from the group consisting of pentadecyl, heptadecyl, 8-heptadecenyl, 8,11-heptadecadienyl, and 8,11,14-heptadecatrienyl.

(x) The composition according to Paragraphs (a) through (c) and (w), wherein for the third glyceride copolymer, two of $R^{21}$, $R^{22}$, and $R^{23}$ are independently selected from the group consisting of pentadecyl, heptadecyl, 8-heptadecenyl, 8,11-heptadecadienyl, and 8,11,14-heptadecatrienyl; and wherein one of $R^{21}$, $R^{22}$, and $R^{23}$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in one aspect, one of $R^{21}$, $R^{22}$, and $R^{23}$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(y) The composition according to Paragraphs (a) through (c) and (w), wherein for the third glyceride copolymer, one of $R^{21}$, $R^{22}$, and $R^{23}$ is selected from the group consisting of pentadecyl, heptadecyl, 8-heptadecenyl, 8,11-heptadecadienyl, and 8,11,14-heptadecatrienyl; and wherein two of $R^{21}$, $R^{22}$, and $R^{23}$ are independently selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in one aspect, two of $R^{21}$, $R^{22}$, and $R^{23}$ are independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(z) A composition comprising a glyceride copolymer, which comprises constitutional units formed from reacting:

a) at least an unsaturated natural oil glyceride, and a unsaturated alkenylized natural oil glyceride in the presence of a metathesis catalyst;

b) at least an unsaturated synthetic polyol ester, and a unsaturated alkenylized natural oil glyceride in the presence of a metathesis catalyst;

c) at least an unsaturated natural oil glyceride, and a unsaturated alkenylized synthetic polyol ester in the presence of a metathesis catalyst;

d) at least an unsaturated synthetic polyol ester, and a unsaturated alkenylized synthetic polyol ester in the presence of a metathesis catalyst;

e) at least an unsaturated alkenylized synthetic polyol ester, and a unsaturated alkenylized synthetic polyol ester in the presence of a metathesis catalyst;

f) at least an unsaturated alkenylized natural oil glyceride, and a unsaturated alkenylized natural oil glyceride in the presence of a metathesis catalyst;

said composition being a fabric care composition.

In one aspect, said glyceride copolymer comprises a $C_{10-14}$ unsaturated fatty acid ester, in one aspect said catalyst is selected from the group consisting of an organo-ruthenium compound, an organo-osmium compound, an organo-tungsten compound, an organo-molybdenum compound and mixtures thereof;

in one aspect the unsaturated alkenylized natural oil glyceride is formed from the reaction of a unsaturated natural oil glyceride with a short-chain alkene in the presence of a metathesis catalyst, in one aspect, said catalyst is selected from the group consisting of an organo-ruthenium compound, an organo-osmium compound, an organo-tungsten compound, an organo-molybdenum compound and mixtures thereof, in one aspect, the short-chain alkene is selected from the group consisting of ethylene, propylene, 1-butene, 2-butene, isobutene, 1-pentene, 2-pentene, 1-hexene, 2-hexene, 3-hexene and mixtures thereof, in one aspect, the short-chain alkene is selected from the group consisting of ethylene, propylene, 1-butene, and 2-butene, and mixtures thereof, in one aspect, the unsaturated alkenylized natural oil glyceride has a lower molecular weight than the second unsaturated natural oil glyceride;

in one aspect, the unsaturated natural oil glyceride is obtained from a natural oil; in one aspect, from vegetable oil, animal fat, and/or algae oil; in one aspect, from Abyssinian oil, Almond Oil, Apricot Oil, Apricot Kernel oil, Argan oil, Avocado Oil, Babassu Oil, Baobab Oil, Black Cumin Oil, Black Currant Oil, Borage Oil, Camelina oil, Carinata oil, Canola oil, Castor oil, Cherry Kernel Oil, Coconut oil, Corn oil, Cottonseed oil, Echium Oil, Evening Primrose Oil, Flax Seed Oil, Grape Seed Oil, Grapefruit Seed Oil, Hazelnut Oil, Hemp Seed Oil, Jatropha oil, Jojoba Oil, Kukui Nut Oil, Linseed Oil, Macadamia Nut Oil, Meadowfoam Seed Oil, Moringa Oil, Neem Oil, Olive Oil, Palm Oil, Palm Kernel Oil, Peach Kernel Oil, Peanut Oil, Pecan Oil, Pennycress oil, Perilla Seed Oil, Pistachio Oil, Pomegranate Seed Oil, Pongamia oil, Pumpkin Seed Oil, Raspberry Oil, Red Palm Olein, Rice Bran Oil, Rosehip Oil, Safflower Oil, Seabuckthorn Fruit Oil, Sesame Seed Oil, Shea Olein, Sunflower Oil, Soybean Oil, Tonka Bean Oil, Tung Oil, Walnut Oil, Wheat Germ Oil, High Oleoyl Soybean Oil, High Oleoyl Sunflower Oil, High Oleoyl Safflower Oil, High Erucic Acid Rapeseed Oil, and mixtures thereof;

in one aspect, said synthetic polyol ester is derived from a material selected from the group consisting of ethylene glycol, propylene glycol, glycerol, polyglycerol, polyethylene glycol, polypropylene glycol, poly(tetramethylene ether) glycol, pentaerythritol, dipentaerythritol, tripentaerythritol, trimethylolpropane, neopentyl glycol, a sugar, for example, sucrose, and mixtures thereof;

in one aspect, the glyceride copolymer has a weight average molecular weight ranging from 4,000 g/mol to 150,000 g/mol, from 5,000 g/mol to 130,000 g/mol, from 6,000 g/mol to 100,000 g/mol, from 7,000 g/mol to 50,000 g/mol, from 8,000 g/mol to 30,000 g/mol, or from 8,000 g/mol to 20,000 g/mol.

(aa) The composition of Paragraph (z), wherein the short-chain alkene is ethylene (bb) The composition of Paragraph (z), wherein the short-chain alkene is propylene.

(cc) The composition of Paragraph (z), wherein the short-chain alkene is 1-butene.

(dd) The composition of Paragraph (z), wherein the short-chain alkene is 2-butene.

(ee) A composition according to Paragraphs (a) through (c) wherein the first glyceride copolymer is derived from a natural polyol ester and/or a synthetic polyol ester, in one aspect, said natural polyol ester is selected from the group consisting of a vegetable oil, a animal fat, a algae oil and mixtures thereof; and said synthetic polyol ester is derived from a material selected from the group consisting of ethylene glycol, propylene glycol, glycerol, polyglycerol, polyethylene glycol, polypropylene glycol, poly(tetramethylene ether) glycol, pentaerythritol, dipentaerythritol, tripentaerythritol, trimethylolpropane, neopentyl glycol, a sugar, for example, sucrose, and mixtures thereof.

(ff) A composition according to any of Paragraphs (a) through (ee), said composition comprising, based on total composition weight, from about 0.1% to about 50%, from about 0.5% to about 30%, or from about 1% to about 20% of a glyceride copolymer, selected from the group consisting of said first glyceride copolymer, second glyceride copolymer, third glyceride copolymer, and mixtures thereof.

(gg) A composition according to any of Paragraphs (a) through (ff), comprising one or more of the following:

a) from about 0.01% to about 50%, from about 0.01% to about 30%, or from about 0.1% to about 20% of said fabric softener active;

b) from about 0.001% to about 15%, from about 0.05% to about 10%, or from about 0.05% to about 5% of said anionic surfactant scavenger;

c) from about 0.01% to about 10%, from about 0.05% to about 5%, or from about 0.05% to about 3% of said delivery enhancing agent;

d) from about 0.005% to about 30%, from about 0.01% to about 20%, or from about 0.02% to about 10% of said perfume;

e) from about 0.005% to about 30%, from about 0.01% to about 20%, or from about 0.02% to about 10% of said perfume delivery system;

f) from about 0.01% to about 20%, from about 0.1 to about 10% or from about 0.1% to about 5% of said soil dispersing polymer;

g) from about 0.001% to about 10%, from about 0.005 to about 5%, or from about 0.01% to about 2% of said brightener;

h) from about 0.0001% to about 10%, from about 0.01% to about 2%, or from about 0.05% to about 1% of said hueing dye;

i) from about 0.0001% to about 10%, from about 0.01% to about 2%, or from about 0.05% to about 1% of said dye transfer inhibiting agent;

j) from about 0.01% to about 10%, from about 0.01% to about 5%, or from about 0.05% to about 2% of said enzyme, in one aspect, said enzyme is a detersive enzyme;

k) from about 0.01% to about 20%, from about 0.1% to about 10%, or from about 0.1% to about 5% of said structurant;

l) from about 0.05% to about 20%, from about 0.1% to about 15%, or from about 0.2% to about 7% of said fabric care benefit agent;

m) from about 0.1% to about 80% of said builder, in one aspect, if said composition is a powder laundry detergent, and in another aspect, from about 0.1% to about 20% of said builder, if said composition is a liquid laundry detergent;

n) from about 0.1% to about 99% of a carrier; and o) mixtures thereof.

(hh) A composition according to any of Paragraphs (a) through (gg) wherein:

a) said fabric softener active comprises a cationic fabric softener, in one aspect, said cationic softener is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammoniumpropane chloride, dicanoladimethylammonium chloride, ditallowdimethylammonium chloride, dicanoladimethylammonium methylsulfate, 1-methyl-1-stearoylamidoethyl-2-stearoylimidazolinium methylsulfate, 1-tallowylamidoethyl-2-tallowylimidazoline, Dipalmethyl Hydroxyethylammoinum Methosulfate and mixtures thereof;

b) said anionic surfactant scavenger comprises a water soluble cationic and/or zwitterionic scavenger compound; in one aspect, said anionic surfactant scavenger is selected from the group consisting of monoalkyl quaternary ammonium compounds and amine precursors thereof, dialkyl quaternary ammonium compounds and amine precursors thereof, polyquaternary ammonium compounds and amine precursors thereof, polymeric amines, and mixtures thereof;

c) said delivery enhancing agent comprises a material selected from the group consisting of a cationic polymer having a charge density from about 0.05 milliequivalent/g to about 23 milliequivalent per gram of polymer, an amphoteric polymer having a charge density from about 0.05 milliequivalent/g to about 23 milliequivalent per gram of polymer, a protein having a charge density from about 0.05 milliequivalent/g to about 23 milliequivalent per gram of protein and mixtures thereof;

d) said perfume delivery system is selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system, and mixtures thereof;

e) said soil dispersing polymer is selected from the group consisting of a homopolymer copolymer or terpolymer of an ethylenically unsaturated monomer anionic monomer, in one aspect, said anionic monomer is selected from the group consisting of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, derivatives and combinations thereof, alkoxylated polyamines, in one aspect, alkoxylated polyethyleneimines, and mixtures thereof;

f) said brightener is selected from the group consisting of derivatives of stilbene or 4,4'-diaminostilbene, biphenyl, five-membered heterocycles, for example, triazoles, pyrazolines, oxazoles, imidiazoles, six-membered heterocycles, for example, coumarins, naphthalamide, s-triazine, and mixtures thereof;

g) said hueing dye comprising a moiety selected the group consisting of acridine, anthraquinone, for example, polycyclic quinones, azine, azo, for example, monoazo, disazo, trisazo, tetrakisazo, polyazo, premetallized azo, benzodifurane and benzodifuranone, carotenoid, coumarin, cyanine, diazahemicyanine, diphenylmethane, formazan, hemicyanine, indigoid, methane, naphthalimide, naphthoquinone, nitro and nitroso, oxazine, phthalocyanine, pyrazole, stilbene, styryl, triarylmethane, triphenylmethane, xanthene and mixtures thereof;

h) said dye transfer inhibiting agent is selected from the group consisting polyvinylpyrrolidone polymers, polyamine N-oxide polymers, copolymers of N-vinylpyrrolidone and N-vinylimidazole, polyvinyloxazolidones and polyvinylimidazoles or mixtures thereof;

i) said bleach is selected from the group consisting of catalytic metal complexes; activated peroxygen sources; bleach activators; bleach boosters; photobleaches; bleaching enzymes; free radical initiators; $H_2O_2$; hypohalite bleaches; peroxygen sources and mixtures thereof;

j) said detersive enzyme is selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, 13-glucanases, arabinosidases, hyaluronidase, chondroitinase, laccase, amylases and mixtures thereof;

k) said structurant is selected from the group consisting of hydrogenated castor oil, gellan gum, starches, derivatized starches, carrageenan, guar gum, pectin, xanthan gum, modified celluloses, microcrystalline celluloses modified proteins, hydrogenated polyalkylenes, non-hydrogenated polyalkenes, inorganic salts, in one aspect, said inorganic salts are selected from the group consisting of magnesium chloride, calcium chloride, calcium formate, magnesium formate, aluminum chloride, potassium permanganate and mixtures thereof, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, in one aspect, when said composition is a liquid laundry detergent composition, said structurant comprises hydrogenated castor oil; in one aspect, when said composition is a rinse added fabric enhancer, said structurant comprises a linear and/or crosslinked homo- and co-polymer of quaternized N,N-dialkylaminoalkyl acrylate;

l) said fabric care benefit agent is selected from the group consisting of polyglycerol esters, oily sugar derivatives, wax emulsions, silicones, polyisobutylene, polyolefins and mixtures thereof;

m) said builder is selected from the group consisting of phosphate salts, water-soluble, nonphosphorus organic builders, alkali metal, ammonium and substituted ammonium polyacetates, carboxylates, polycarboxylates, polyhydroxy sulfonates, in one aspect, said builder is selected from the group consisting of sodium, potassium, lithium, ammonium and substituted ammonium salts of ethylene diamine tetraacetic acid, nitrilotriacetic acid, oxydisuccinic acid, mellitic acid, benzene polycarboxylic acids, citric acid, oxydisuccinate, ether carboxylate, tartrate monosuccinate, tartrate disuccinate, silicate, aluminosilicate, borate, carbonate, bicarbonate, sesquicarbonate, tetraborate decahydrate, zeolites, and mixtures thereof;

n) said surfactant is selected from the group consisting of anionic surfactants, nonionic surfactants, ampholytic surfactants, cationic surfactants, zwitterionic surfactants, and mixtures thereof o) said carrier is selected from the group consisting of water, 1,2-propanediol, hexylene glycol, ethanol, isopropanol, glycerol, $C_1$-$C_4$ alkanolamines, salts, sugars, polyalkylene oxides, for example, polyethylene oxide; polyethylene glycols; polypropylene oxide, and mixtures thereof;

(II) A composition according to any of Paragraphs (a) through (hh) wherein:

a) said fabric softener active is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis- (palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammonium-propane chloride, dicanoladimethylammonium chloride, di(hard)tallowdimethylammonium chloride dicanoladimethylammonium methylsulfate, Dipalmethyl Hydroxyethylammoinum Methosulfate and mixtures thereof;

b) said anionic surfactant scavenger is selected from the group consisting of monoalkyl quaternary ammonium compounds, amine precursors of monoalkyl quaternary ammonium compounds, dialkyl quaternary ammonium compounds, and amine precursors of dialkyl quaternary ammonium compounds, polyquaternary ammonium compounds, amine precursors of polyquaternary ammonium compounds, and mixtures thereof, in one aspect, said anionic surfactant scavenger is selected from the group consisting of N—$C_6$ to $C_{18}$ alkyl-N,N,N-trimethyl ammonium salts, N—$C_6$ to $C_{18}$ alkyl-N-hydroxyethyl-N,N-dimethyl ammonium salts, N—$C_6$ to $C_{18}$ alkyl-N,N-dihydroxyethyl-N-methyl ammonium salts, N—$C_6$ to $C_{18}$ alkyl-N-benzyl-N,N-dimethyl ammonium salts, N,N-di-$C_6$ to di-$C_{12}$ alkyl-N,N-dimethyl ammonium salts, N,N-di-$C_6$ to di-$C_{12}$ alkyl N-hydroxyethyl N-methyl ammonium salts, N—$C_6$ to $C_{18}$ alkyl N-alkylhexyl, N,N-dimethyl ammonium salt;

c) said delivery enhancing agent is selected from the group consisting of cationic polysaccaharides, polyethyleneimine and its derivatives, polyamidoamines and homopolymers, copolymers and terpolymers made from one or more cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, and combinations thereof; in one aspect, when said composition is a rinse added fabric enhancer, said polymer comprises a linear and/or cross-linked quaternized N,N-dialkylaminoalkyl acrylate, when said composition is a liquid laundry detergent, said delivery enhancing agent comprises cationic polysaccharide, polyquaternium-10, polyquaternium-7, polyquaternium-6, a homo- or co-polymer selected diallyl dimethyl ammonium chloride, quaternized N,N-dialkylaminoalkyl acrylamide, quaternized N,N-dialkylaminoalkylmethacrylamide, vinylamine, and mixtures thereof;

d) said soil dispersing polymer is selected from the group consisting of alkoxylated polyethyleneimines, homopolymer or copolymer of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, acrylamidopropylmethane sulfonic acid (AMPS) and their salts, derivatives thereof and mixtures thereof;

e) said brightener is selected from the group consisting of derivatives of stilbene or 4,4'-diaminostilbene, biphenyl, five-membered heterocycles, for example, triazoles and mixtures thereof;

f) said hueing dye is selected from the group consisting of Direct Violet dyes, for example, Direct Violet dyes 9, 35, 48, 51, 66, and 99; Direct Blue dyes, for example, Direct Blue dyes 1, 71, 80 and 279; Acid Red dyes, for example, Acid Red dyes 17, 73, 52, 88 and 150; Acid Violet dyes, for example, Acid Violet dyes 15, 17, 24, 43, 49 and 50; Acid Blue dyes, for example, Acid Blue dyes 15, 17, 25, 29, 40, 45, 75, 80, 83, 90 and 113; Acid Black dyes, for example, Acid Black dye 1; Basic Violet dyes, for example, Basic Violet dyes 1, 3, 4, 10 and 35; Basic Blue dyes, for example, Basic Blue dyes 3, 16, 22, 47, 66, 75 and 159; Disperse or Solvent dyes and mixtures thereof, in one aspect, said hueing dye is selected from the group consisting of Acid Violet 17, Acid Blue 80, Acid Violet 50, Direct Blue 71, Direct Violet 51, Direct Blue 1, Acid Red 88, Acid Red 150, Acid Blue 29, Acid Blue 113 and mixtures thereof;

g) said bleach is selected from the group consisting of catalytic metal complexes; activated peroxygen sources; bleach activators; bleach boosters; photobleaches, peroxygen source, hydrogen peroxide, perborate and percarbonate or mixtures thereof;

h) said enzyme, is selected from the group consisting of hemicellulases, peroxidases, proteases, cellulases, xylanases, lipases, phospholipases, esterases, cutinases, pectinases, pentosanases, malanases, β-glucanases, laccase, amylases and mixtures thereof, in one aspect, said enzyme is s detersive enzyme;

i) said surfactant is selected from the group consisting of alkyl sulfate, alkyl ethoxysulfate, linear alkylbenzene sulfonate, alpha olefin sulfonate, ethoxylated alcohols, ethoxylated alkyl phenols, fatty acids, soaps, and mixtures thereof.

j) said fabric care benefit agent is selected from the group consisting of polydimethylsiloxane, silicone polyethers, cationic silicone, aminosilicone, and mixtures thereof.

(jj) A composition according to any of Paragraphs (a) through (II) comprising:

a) a fabric softener active selected from the group consisting of a cationic fabric softener, in one aspect, said cationic softener is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammoniumpropane chloride, dicanoladimethylammonium chloride, di(hard)tallowdimethylammonium chloride, dicanoladimethylammonium methylsulfate, 1-methyl-1-stearoylamidoethyl-2-stearoylimidazolinium methylsulfate, 1-tallowylamidoethyl-2-tallowylimidazoline, Dipalmethyl Hydroxyethylammoinum Methosulfate and mixtures thereof;

b) a carrier, c) optionally, an anionic surfactant scavenger selected from the group consisting of a water soluble cationic and/or zwitterionic scavenger compound; in one aspect, said anionic surfactant scavenger is selected from the group consisting of monoalkyl quaternary ammonium compounds and amine precursors thereof, dialkyl quaternary ammonium compounds and amine precursors thereof, polyquaternary ammonium compounds and amine precursors thereof, polymeric amines, and mixtures thereof;

d) optionally, a delivery enhancing agent selected from the group consisting of a cationic polymer having a charge density from about 0.05 milliequivalent/g to about 23 milliequivalent per gram of polymer, an amphoteric polymer having a charge density from about 0.05 milliequivalent/g to about 23 milliequivalent per gram of polymer, a protein having a charge density from about 0.05 milliequivalent/g to about 23 milliequivalent per gram of protein and mixtures thereof;

e) optionally, a dye transfer inhibiting agent selected from the group consisting of polyvinylpyrrolidone polymers, polyamine N-oxide polymers, copolymers of N-vinylpyrrolidone and N-vinylimidazole, polyvinyloxazolidones and polyvinylimidazoles or mixtures thereof;

f) optionally, a structurant selected from the group consisting of hydrogenated castor oil, gellan gum, starches, derivatized starches, carrageenan, guar gum, pectin, xanthan gum, modified celluloses, microcyrstalline celluloses, modified proteins, hydrogenated polyalkylenes, non-hydrogenated polyalkenes, inorganic salts, in one aspect, said inorganic salts are selected from the group consisting of magnesium chloride, calcium chloride, calcium formate, magnesium formate, aluminum chloride, potassium permanganate and mixtures thereof, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, in one aspect, when said composition is a liquid laundry detergent composition, said structurant comprises hydrogenated castor oil; in one aspect, when said composition is a rinse added fabric enhancer, said structurant comprises a linear and/or crosslinked homo- and co-polymer of quaternized N,N-dialkylaminoalkyl acrylate; and g) optionally, a fabric care benefit agent selected from the group consisting of polyglycerol esters, oily sugar derivatives, wax emulsions, silicones, polyisobutylene, polyolefins and mixtures thereof; and h) optionally a perfume; and i) optionally a perfume delivery system, in one aspect, said perfume delivery system is selected from the group consisting of selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; in one aspect, 2 or more types of PMC;

said composition having a pH of from about 2 to about 7, or a pH from about 2 to about 5.

(kk) A composition according to any of Paragraphs (a) through (II) comprising:

a) a surfactant selected from the group consisting of anionic surfactants, nonionic surfactants, ampholytic surfactants, cationic surfactants, zwitterionic surfactants, and mixtures thereof;

b) a carrier;

c) optionally, a builder selected from the group consisting of phosphate salts, water-soluble, nonphosphorus organic builders, alkali metal, ammonium and substituted ammonium polyacetates, carboxylates, polycarboxylates, polyhydroxy sulfonates, in one aspect, said builder is selected from the group consisting of sodium, potassium, lithium, ammonium and substituted ammonium salts of ethylene diamine tetraacetic acid, nitrilotriacetic acid, oxydisuccinic acid, mellitic acid, benzene polycarboxylic acids, citric acid, oxydisuccinate, ether carboxylate, tartrate monosuccinate, tartrate disuccinate, silicate, aluminosilicate, borate, carbonate, bicarbonate, sesquicarbonate, tetraborate decahydrate, zeolites, and mixtures thereof d) optionally, a soil dispersing polymer selected from the group consisting of a homopolymer copolymer or terpolymer of an ethylenically unsaturated monomer anionic monomer, in one aspect, said anionic monomer is selected from the group consisting of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, derivatives thereof and mixtures thereof, alkoxylated polyamines, in one aspect, alkoxylated polyethyleneimines, and mixtures thereof;

e) optionally, a delivery enhancing agent selected from the group consisting of a cationic polymer having a charge density from about 0.05 milliequivalent/g to about 23 milliequivalent per gram of polymer, an amphoteric polymer having a charge density from about 0.05 milliequivalent/g to about 23 milliequivalent per gram of polymer, a protein having a charge density from about 0.05 milliequivalent/g to about 23 milliequivalent per gram of protein and mixtures thereof;

f) optionally, a brightener selected from the group consisting of derivatives of stilbene or 4,4'-diaminostilbene, biphenyl, five-membered heterocycles, for example, triazoles, pyrazolines, oxazoles, imidiazoles, six-membered heterocycles, for example, coumarins, naphthalamide, s-triazine, and mixtures thereof;

g) optionally, a hueing dye comprising a moiety selected the group consisting of acridine, anthraquinone, for example, polycyclic quinones, azine, azo, for example, monoazo, disazo, trisazo, tetrakisazo, polyazo, premetallized azo, benzodifurane and benzodifuranone, carotenoid, coumarin, cyanine, diazahemicyanine, diphenylmethane, formazan, hemicyanine, indigoid, methane, naphthalimide, naphthoquinone, nitro and nitroso, oxazine, phthalocyanine, pyrazole, stilbene, styryl, triarylmethane, triphenylmethane, xanthene and mixtures thereof;

h) optionally, a dye transfer inhibiting agent selected from the group consisting polyvinylpyrrolidone polymers, polyamine N-oxide polymers, copolymers of N-vinylpyrrolidone and N-vinylimidazole, polyvinyloxazolidones and polyvinylimidazoles or mixtures thereof;

i) optionally, a bleach selected from the group consisting of catalytic metal complexes; activated peroxygen sources; bleach activators; bleach boosters; photobleaches; bleaching enzymes; free radical initiators; $H_2O_2$; hypohalite bleaches; peroxygen sources and mixtures thereof;

j) optionally, a detersive enzyme selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases and mixtures thereof;

k) optionally, a structurant selected from the group consisting of hydrogenated castor oil, gellan gum, starches, derivatized starches, carrageenan, guar gum, pectin, xanthan gum, modified celluloses, modified proteins, hydrogenated polyalkylenes, non-hydrogenated polyalkenes, inorganic salts, in one aspect, said inorganic salts are selected from the group consisting of magnesium chloride, calcium chloride, calcium formate, magnesium formate, aluminum chloride, potassium permanganate and mixtures thereof, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, in one aspect, when said composition is a liquid laundry detergent composition, said structurant comprises hydrogenated castor oil; in one aspect, when said composition is a rinse added fabric enhancer, said structurant comprises a linear and/or crosslinked homo- and co-polymer of quaternized N,N-dialkylaminoalkyl acrylate;

l) optionally, a fabric care benefit agent selected from the group consisting of polyglycerol esters, oily sugar derivatives, wax emulsions, silicones, polyisobutylene, polyolefins and mixtures thereof; and m) optionally a perfume;

n) optionally a perfume delivery system, in one aspect, said perfume delivery system is selected from the group consisting of selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; in one aspect, 2 or more types of PMC;

said composition having a pH of from about 4 to about 12, or a pH from about 5 to about 9.

(ll) A composition according to any of Paragraphs (a) through (II) comprising a) about 49 to about 99% of carrier selected from the group consisting of polyethylene glycol, salt, polysaccharide and sugar; in one aspect, a polyethylene glycol of molecular weight from about 2000 Da to about 20,000 Da, a polyethylene glycol of molecular weight from about 3,000 Da to about 12,000 Da, or a polyethylene glycol of molecular weight from about 6,000 Da to 10,000 Da;

b) optionally, a fabric care benefit agent, in one aspect, a silicone;

c) optionally a perfume;

d) optionally a perfume delivery system;

e) optionally a delivery enhancing agent.

(mm) A composition according to any of Paragraphs (a) through (II) comprising:

a) a fabric softening agent, a perfume, and a delivery enhancing agent; or b) a fabric softening agent, a perfume and a perfume delivery system; or c) a hueing dye and a surfactant; or d) less than 10% total water, said total water being the sum of the free and bound water; or e) a fabric softening agent, a fabric care benefit agent and a delivery enhancing agent; or g) a fabric care benefit agent, anionic surfactant scavenger and a delivery enhancing agent; or h) a perfume delivery system, in one aspect, said perfume delivery system is selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; in one aspect, 2 or more types of PMC.

(nn) A composition according to any of Paragraphs (a) through (jj), said composition comprising an emulsion, a gel network or lamellar phase, in one aspect, said composition comprises vesicles.

(oo) A composition according to any of a Paragraphs (a) through (II) and (11) said composition being in the form of a crystal, a bead or a pastille, in one aspect, said composition comprises, based on total composition weight, from about 0.1% to about 50%, from about 0.5% to about 30%, or from about 5% to about 30% of a glyceride copolymer, selected from the group consisting of said first glyceride copolymer, second glyceride copolymer, third glyceride copolymer, and mixtures thereof, in one aspect, said bead has a shape that is circular, lozenge shape, dome shape or semi-circular with a flat base.

(pp) An article comprising a composition according to any of Paragraphs (a) through (oo) and a water soluble film, in one aspect, said film comprises polyvinyl alcohol, in one aspect, said film surrounds said composition, in one aspect, said article comprises two or more chambers that are surrounded by said film and wherein at least one of said chambers comprises said composition.

(qq) An article comprising a composition according to any of Paragraphs (a) through (II), said article being in the form of a dryer sheet.

(rr) A fabric treated with a composition according to any of Paragraphs (a) through (oo) and/or an article according to any of Paragraphs (pp) through (qq).

(ss) A method of treating and/or cleaning a fabric, said method comprising a) optionally washing and/or rinsing said fabric;

b) contacting said fabric with a composition according to any of any of Paragraphs (a) through (oo), (uu) and (vv) and/or an article according to any of Paragraphs (pp) through (qq);

c) optionally washing and/or rinsing said fabric; and d) optionally passively or actively drying said fabric.

(tt) A composition according to any of Paragraphs (a) through (oo), wherein said first, and second, glyceride copolymers have a free hydrocarbon content, based on the weight of glyceride copolymer of from about 0% to about 5%, from about 0.1% to about 5%, from about 0.1% to about 4%, from about 0.1 to about 3%, or from about 0.1% to about 1%.

(uu) A composition according to any of Paragraphs (a) through (oo), wherein said third glyceride copolymer have a free hydrocarbon content, based on the weight of glyceride copolymer of from about 0% to about 5%, from about 0.1% to about 5%, from about 0.1% to about 4%, from about 0.1 to about 3%, or from about 0.1% to about 1%.

(vv) The composition according to any of Paragraphs (a) through (c) and (w), wherein for the third glyceride copolymer, $R^{21}$, $R^{22}$, and $R^{23}$ are each independently selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; in one aspect, $R^{21}$, $R^{22}$, and $R^{23}$ are each independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

Paragraphs (a2) through (vv2)

The following compositions, methods of use and treated articles are disclosed:

(a2) A composition comprising,

A) a material selected from the group consisting of:

(i), a first glyceride copolymer, comprising, based on total weight of first glyceride copolymer, from 3% to 30%, preferably from 3% to 25%, more preferably from 5% to 20% $C_{10-14}$ unsaturated fatty acid esters; preferably said first glyceride copolymer comprises, based on total weight of first glyceride copolymer, from 3% to 30%, preferably from 3% to 25%, more preferably from 3% to 20% $C_{10-13}$ unsaturated fatty acid esters; more preferably said first glyceride copolymer comprises, based on total weight of first glyceride copolymer, from 0.1% to 30%, preferably from 0.1% to 25%, more preferably from 0.2% to 20%, most preferably from 0.5% to 15% $C_{10-11}$ unsaturated fatty acid esters;

(ii) a second glyceride copolymer having formula (I):

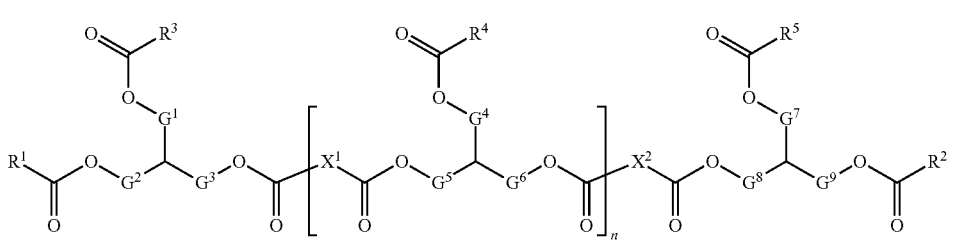

(I)

(I)

wherein:

each $R^1$, $R^2$, $R^3$, $R^4$, and $R^5$ in second glyceride copolymer is independently selected from the group consisting of an oligomeric glyceride moiety, a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties; and/or wherein each of the following combinations of moieties may each independently be covalently linked:

$R^1$ and $R^3$, $R^2$ and $R^5$, $R^1$ and an adjacent $R^4$, $R^2$ and an adjacent $R^4$, $R^3$ and an adjacent $R^4$, $R^5$ and an adjacent $R^4$, or any two adjacent $R^4$ such that the covalently linked moieties form an alkenylene moiety;

each $X^1$ and $X^2$ in said second glyceride copolymer is independently selected from the group consisting of a $C_{1-32}$ alkylene, a substituted $C_{1-32}$ alkylene wherein the substituent is one or more —OH moieties, a $C_{2-32}$ alkenylene or a substituted $C_{2-32}$ alkenylene wherein the substituent is one or more —OH moieties;

two of $G^1$, $G^2$, and $G^3$ are —$CH_2$—, and one of $G^1$, $G^2$, and $G^3$ is a direct bond;

for each individual repeat unit in the repeat unit having index n, two of $G^4$, $G^5$, and $G^6$ are —$CH_2$—, and one of $G^4$, $G^5$, and $G^6$ is a direct bond, and the values $G^4$, $G^5$, and $G^6$ for each individual repeat unit are independently selected from the values of $G^4$, $G^5$, and $G^6$ in other repeating units;

two of $G^7$, $G^8$, and $G^9$ are —$CH_2$—, and one of $G^7$, $G^8$, and $G^9$ is a direct bond;

n is an integer from 3 to 250;

with the proviso for each of said second glyceride copolymers at least one of $R^1$, $R^2$, $R^3$, and $R^5$, and/or at least one $R^4$ in one individual repeat unit of said repeat unit having index n, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl; preferably said second glyceride copolymer comprises based on total weight of second glyceride copolymer, from 3% to 30%, preferably from 3% to 25%, more preferably from 5% to 20% $C_{9-13}$ alkenyl moieties; preferably said second glyceride copolymer comprises, based on total weight of second glyceride copolymer, from 3% to 30%, preferably from 3% to 25%, more preferably from 3% to 20% $C_{9-12}$ alkenyl moieties; more preferably said second glyceride copolymer comprises, based on total weight of second glyceride copolymer, from 0.1% to 30%, preferably from 0.1% to 25%, more preferably from 0.2% to 20%, most preferably from 0.5% to 15% $C_{9-10}$ alkenyl moieties; and (iii) optionally, a third glyceride copolymer, which comprises constitutional units formed from reacting, in the presence of a metathesis catalyst, one or more compounds from each of the compounds having the following formulas:

Formula (IIa):

(IIa)

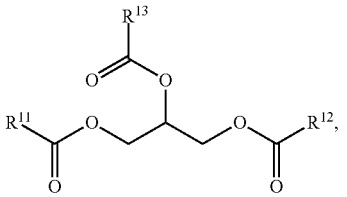

Formula (IIb):

(IIb)

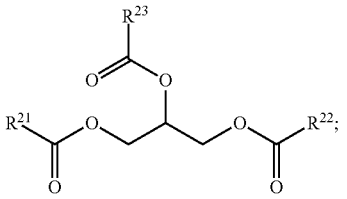

wherein, each $R^{11}$, $R^{12}$, and $R^{13}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties with the proviso that at least one of $R^{11}$, $R^{12}$, and $R^{13}$ is a $C_{2-24}$ alkenyl or a substituted $C_{2-24}$ alkenyl wherein the substituent is one or more —OH moieties; and each $R^{21}$, $R^{22}$, and $R^{23}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties, with the proviso that at least one of $R^{21}$, $R^{22}$, and $R^{23}$ is 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl;

wherein the number ratio of constitutional units formed from monomer compounds of formula (IIa) to constitutional units formed from monomer compounds of formula (IIb) is no more than 10:1; and (iv) mixtures thereof; and B) a material selected from the group consisting of a fabric softener active, a fabric care benefit agent, an anionic surfactant scavenger, a delivery enhancing agent, a perfume, a perfume delivery system, a structurant, a soil dispersing polymer, a brightener, a hueing dye, dye transfer inhibiting agent, builder, surfactant, an enzyme, preferably a detersive enzyme and mixtures thereof, and optionally a carrier, preferably said composition having a pH of from 2 to 12 said composition being a fabric care composition.

(b2) The composition of Paragraph (a2) wherein said first, second, and third glyceride copolymers have a weight average molecular weight of from 4,000 g/mol to 150,000 g/mol, preferably from 5,000 g/mol to 130,000 g/mol, more preferably from 6,000 g/mol to 100,000 g/mol, more preferably from 7,000 g/mol to 50,000 g/mol, more preferably from 8,000 g/mol to 30,000 g/mol, most preferably from 8,000 g/mol to 20,000 g/mol.

(c2) The composition according to Paragraphs (a2) through (b2) wherein said first, second, and third glyceride copolymers are produced by a process comprising metathesis; preferably said process comprises reacting two or more monomers in the presence of the metathesis catalyst as part of a reaction mixture, wherein the weight-to-weight ratio of the monomer compounds of formula (IIa) to the monomer compounds of formula (IIb) in the reaction mixture is no more than 10:1, preferably no more than 9:1, more preferably no more than 8:1, more preferably no more than 7:1, more preferably no more than 6:1, more preferably no more than 5:1, more preferably no more than 4:1, more preferably no more than 3:1, more preferably no more than 2:1, most preferably no more than 1:1; preferably the metathesis catalyst is an organo-ruthenium compound, an organo-osmium compound, an organo-tungsten compound, or an organo-molybdenum compound.

(d2) The composition according to Paragraphs (a2) through (c2), wherein for said second glyceride copolymer at least one of $R^1$, $R^2$, $R^3$, $R^4$, or $R^5$ is a $C_{9-13}$ alkenyl, preferably a $C_{9-12}$ alkenyl, more preferably a $C_{9-10}$ alkenyl.

(e2) The composition according to Paragraphs (a2) through (d2), wherein for said third glyceride copolymer at least one of $R^1$, $R^{12}$, $R^{13}$, $R^{21}$, $R^{22}$, or $R^{23}$ is a $C_{9-13}$ alkenyl, preferably a $C_{9-12}$ alkenyl, more preferably a $C_{9-10}$ alkenyl.

(f2) The composition according to Paragraphs (a2) through (e2), wherein the second glyceride copolymer's $G^1$ and $G^2$ moieties are —$CH_2$— and $G^3$ is a direct bond.

(g2) The composition according to any of Paragraphs (a2) through (e2), wherein the second glyceride copolymer's $G^1$ and $G^3$ moieties are —$CH_2$— and $G^2$ is a direct bond.

(h2) The composition according to any of Paragraphs (a2) through (e2), wherein the second glyceride copolymer's $G^2$ and $G^3$ moieties are —$CH_2$— and G is a direct bond.

(i2) The composition according to Paragraphs (a2) through (h2), wherein for the second glyceride copolymer, at least one of, $G^4$ and $G^5$ are —$CH_2$— and $G^6$ is a direct bond.

(j2) The composition according to any of Paragraphs (a2) through (h2), wherein for the second glyceride copolymer, at least one of, $G^4$ and $G^6$ are —$CH_2$— and $G^5$ is a direct bond.

(k2) The composition according to any of Paragraphs (a2) through (h2), wherein for the second glyceride copolymer, at least one of, $G^5$ and $G^6$ are —$CH_2$— and $G^4$ is a direct bond.

(l2) The composition according to any of Paragraphs (a2) through (k2), wherein for the second glyceride copolymer, at least one of, $G^7$ and $G^8$ are —$CH_2$— and $G^9$ is a direct bond.

(m2) The composition according to Paragraphs (a2) through (k2), wherein for the second glyceride copolymer, at least one of $G^7$ and $G^9$ are —$CH_2$— and $G^8$ is a direct bond.

(n2) The composition according to Paragraphs (a2) through (k2), wherein for the second glyceride copolymer, at least one of $G^8$ and $G^9$ are —$CH_2$— and $G^7$ is a direct bond.

(o2) The composition according to any of Paragraphs (a2) through (n2), wherein for the second glyceride copolymer, each $X^1$ is independently selected from the group consisting of —$(CH_2)_{16}$—, —$(CH_2)_{18}$—, —$(CH_2)_{19}$—, —$(CH_2)_{20}$—, —$(CH_2)_{22}$—, —$(CH_2)_{24}$—, —$(CH_2)_{25}$—, —$(CH_2)_{28}$—, —$(CH_2)_7$—, CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_{11}$—CH═CH—$(CH_2)_{11}$—, —$(CH_2)_7$—CH═CH—$CH_2$—CH═CH—$(CH_2)_{11}$—, —$(CH_2)_{11}$—CH═CH—$CH_2$—CH═CH—$(CH_2)_7$—, —$(CH_2)_7$—CH═CH—$CH_2$—CH═CH—$CH_2$—CH═CH—$(CH_2)_{11}$—, —$(CH_2)_{11}$—CH═CH—$CH_2$—CH═CH—$CH_2$—CH═CH—$(CH_2)_7$—, —$(CH_2)_9$—CH═CH—$(CH_2)_7$—, —$(CH_2)_7$—CH═CH—$(CH_2)_9$, —$(CH_2)_{11}$—CH═CH—$(CH_2)_7$—, or —$(CH_2)_7$—CH═CH—$(CH_2)_{11}$—.

(p2) The composition according to any of Paragraphs (a2) through (m2), wherein for the second glyceride copolymer, each $X^2$ is independently selected from the group consisting of —$(CH_2)_{16}$—, —$(CH_2)_{18}$—, —$(CH_2)_{19}$—, —$(CH_2)_{20}$—, —$(CH_2)_{22}$—, —$(CH_2)_{24}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_1$—CH═CH—$(CH_2)_{11}$—, —$(CH_2)_7$—CH═CH—$CH_2$—CH═CH—$(CH_2)_{11}$—, —$(CH_2)_{11}$—CH═CH—$CH_2$—CH═CH—$(CH_2)_7$—, —$(CH_2)_{11}$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$(CH_2)_{11}$—, —$(CH_2)_{11}$—CH═CH—$CH_2$—CH═CH—$CH_2$—CH═CH—$(CH_2)_7$—, —$(CH_2)_9$—CH═CH—$(CH_2)_7$, —$(CH_2)_7$—CH═CH—$(CH_2)_9$, —$(CH_2)_{11}$—CH═CH—$(CH_2)_7$—, or —$(CH_2)_7$—CH═CH—$(CH_2)_{11}$—.

(q2) The composition according to any of Paragraphs (a2) through (p2), wherein for the second glyceride copolymer, $R^1$ is a $C_{1-24}$ alkyl or a $C_{2-24}$ alkenyl; preferably $R^1$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl, more preferably $R^1$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(r2) The composition according to any of Paragraphs (a2) through (q2), wherein for the second glyceride copolymer, $R^2$ is a $C_{1-24}$ alkyl or a $C_{2-24}$ alkenyl; preferably $R^2$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably $R^2$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(s2) The composition according to any of Paragraphs (a2) through (r2), wherein for the second glyceride copolymer, $R^3$ is a $C_{1-24}$ alkyl or a $C_{2-24}$ alkenyl; preferably $R^3$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably $R^3$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(t2) The composition according to any of Paragraphs (a2) through (s2), wherein for the second glyceride copolymer, each $R^4$ is independently selected from a $C_{1-24}$ alkyl and a $C_{2-24}$ alkenyl; preferably each $R^4$ is independently selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably each $R^4$ is independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(u2) The composition according to any of Paragraphs (a2) through (t2), wherein for the second glyceride copolymer, $R^5$ is a $C_{1-24}$ alkyl or a $C_{2-24}$ alkenyl; preferably $R^5$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably $R^5$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(v2) The composition according to any of Paragraphs (a2) through (u2), wherein for the second glyceride copolymer, n is an integer from 3 to 250, preferably from 5 to 180, more preferably from 6 to 140, more preferably from 8 to 70, more preferably from 9 to 40, most preferably from 9 to 26.

(w2) The composition according to Paragraphs (a2) through (c2), wherein for the third glyceride copolymer, $R^{11}$, $R^{12}$, and $R^{13}$ are each independently selected from the group consisting of pentadecyl, heptadecyl, 8-heptadecenyl, 8,11-heptadecadienyl, and 8,11,14-heptadecatrienyl.

(x2) The composition according to Paragraphs (a2) through (c2) and (w2), wherein for the third glyceride copolymer, two of $R^{21}$, $R^{22}$, and $R^{23}$ are independently selected from the group consisting of pentadecyl, heptadecyl, 8-heptadecenyl, 8,11-heptadecadienyl, and 8,11,14-heptadecatrienyl; and wherein one of $R^{21}$, $R^{22}$, and $R^{23}$ is selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably one of $R^{21}$, $R^{22}$, and $R^{23}$ is selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(y2) The composition according to Paragraphs (a2) through (c2) and (w2), wherein for the third glyceride copolymer, one of $R^{21}$, $R^{22}$, and $R^{23}$ is selected from the group consisting of pentadecyl, heptadecyl, 8-heptadecenyl, 8,11-heptadecadienyl, and 8,11,14-heptadecatrienyl; and wherein two of $R^{21}$, $R^{22}$, and $R^{23}$ are independently selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; more preferably two of $R^{21}$, $R^{22}$, and $R^{23}$ are independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

(z2) A composition comprising a glyceride copolymer, preferably a glyceride copolymer comprising a $C_{10-14}$ unsaturated fatty acid ester, which comprises constitutional units formed from reacting:

a) at least an unsaturated natural oil glyceride, and an unsaturated alkenylized natural oil glyceride in the presence of a metathesis catalyst;
b) at least an unsaturated synthetic polyol ester, and an unsaturated alkenylized natural oil glyceride in the presence of a metathesis catalyst;
c) at least an unsaturated natural oil glyceride, and an unsaturated alkenylized synthetic polyol ester in the presence of a metathesis catalyst;
d) at least an unsaturated synthetic polyol ester, and an unsaturated alkenylized synthetic polyol ester in the presence of a metathesis catalyst;
e) at least an unsaturated alkenylized synthetic polyol ester, and an unsaturated alkenylized synthetic polyol ester in the presence of a metathesis catalyst;
f) at least an unsaturated alkenylized natural oil glyceride, and an unsaturated alkenylized natural oil glyceride in the presence of a metathesis catalyst;

said composition being a fabric care composition.

preferably said catalyst is selected from the group consisting of an organo-ruthenium compound, an organo-osmium compound, an organo-tungsten compound, an organo-molybdenum compound and mixtures thereof;

preferably the unsaturated alkenylized natural oil glyceride is formed from the reaction of a unsaturated natural oil glyceride with a short-chain alkene in the presence of a metathesis catalyst, preferably said catalyst is selected from the group consisting of an organo-ruthenium compound, an organo-osmium compound, an organo-tungsten compound, an organo-molybdenum compound and mixtures thereof, preferably the short-chain alkene is selected from the group consisting of ethylene, propylene, 1-butene, 2-butene, isobutene, 1-pentene, 2-pentene, 1-hexene, 2-hexene, 3-hexene and mixtures thereof, more preferably the short-chain alkene is selected from the group consisting of ethylene, propylene, 1-butene, and 2-butene, and mixtures thereof, more preferably the unsaturated alkenylized natural oil glyceride has a lower molecular weight than the second unsaturated natural oil glyceride;

preferably the unsaturated natural oil glyceride is obtained from a natural oil; preferably from vegetable oil, animal fat, and/or algae oil; more preferably from Abyssinian oil, Almond Oil, Apricot Oil, Apricot Kernel oil, Argan oil, Avocado Oil, Babassu Oil, Baobab Oil, Black Cumin Oil, Black Currant Oil, Borage Oil, Camelina oil, Carinata oil, Canola oil, Castor oil, Cherry Kernel Oil, Coconut oil, Corn oil, Cottonseed oil, Echium Oil, Evening Primrose Oil, Flax Seed Oil, Grape Seed Oil, Grapefruit Seed Oil, Hazelnut Oil, Hemp Seed Oil, Jatropha oil, Jojoba Oil, Kukui Nut Oil, Linseed Oil, Macadamia Nut Oil, Meadowfoam Seed Oil, Moringa Oil, Neem Oil, Olive Oil, Palm Oil, Palm Kernel Oil, Peach Kernel Oil, Peanut Oil, Pecan Oil, Pennycress oil, Perilla Seed Oil, Pistachio Oil, Pomegranate Seed Oil, Pongamia oil, Pumpkin Seed Oil, Raspberry Oil, Red Palm Olein, Rice Bran Oil, Rosehip Oil, Safflower Oil, Seabuckthorn Fruit Oil, Sesame Seed Oil, Shea Olein, Sunflower Oil, Soybean Oil, Tonka Bean Oil, Tung Oil, Walnut Oil, Wheat Germ Oil, High Oleoyl Soybean Oil, High Oleoyl Sunflower Oil, High Oleoyl Safflower Oil, High Erucic Acid Rapeseed Oil, and mixtures thereof;

preferably said synthetic polyol ester is derived from a material selected from the group consisting of ethylene glycol, propylene glycol, glycerol, polyglycerol, polyethylene glycol, polypropylene glycol, poly(tetramethylene ether) glycol, pentaerythritol, dipentaerythritol, tripentaerythritol, trimethylolpropane, neopentyl glycol, a sugar, preferably, sucrose, and mixtures thereof;

preferably the glyceride copolymer has a weight average molecular weight ranging from 4,000 g/mol to 150,000 g/mol, preferably from 5,000 g/mol to 130,000 g/mol, more preferably from 6,000 g/mol to 100,000 g/mol, more preferably from 7,000 g/mol to 50,000 g/mol, more preferably from 8,000 g/mol to 30,000 g/mol, most preferably from 8,000 g/mol to 20,000 g/mol.

(aa2) The composition of Paragraph (z2), wherein the short-chain alkene is ethylene (bb2) The composition of Paragraph (z2), wherein the short-chain alkene is propylene.

(cc2) The composition of Paragraph (z2), wherein the short-chain alkene is 1-butene.

(dd2) The composition of Paragraph (z2), wherein the short-chain alkene is 2-butene.

(ee2) A composition according to Paragraphs (a2) through (c2) wherein the first glyceride copolymer is derived from a natural polyol ester and/or a synthetic polyol ester, preferably said natural polyol ester is selected from the group consisting of a vegetable oil, a animal fat, a algae oil and mixtures thereof; and said synthetic polyol ester is derived from a material selected from the group consisting of ethylene glycol, propylene glycol, glycerol, polyglycerol, polyethylene glycol, polypropylene glycol, poly(tetramethylene ether) glycol, pentaerythritol, dipentaerythritol, tripentaerythritol, trimethylolpropane, neopentyl glycol, a sugar, preferably, sucrose, and mixtures thereof.

(ff2) A composition according to any of Paragraphs (a) through (ee), said composition comprising, based on total composition weight, from 0.1% to 50%, preferably from 0.5% to 30%, more preferably from 1% to 20% of a glyceride copolymer, selected from the group consisting of said first glyceride copolymer, second glyceride copolymer, third glyceride copolymer, and mixtures thereof.

(gg2) A composition according to any of Paragraphs (a2) through (ff2), comprising one or more of the following:

a) from 0.01% to 50%, preferably from 0.01% to 30%, more preferably from 0.1% to 20% of said fabric softener active;
b) from 0.001% to 15%, preferably from 0.05% to 10%, more preferably from 0.05% to 5% of said anionic surfactant scavenger;
c) from 0.01% to 10%, preferably from 0.05% to 5%, more preferably from 0.05% to 3% of said delivery enhancing agent;
d) from 0.005% to 30%, preferably from 0.01% to 20%, more preferably from 0.02% to 10% of said perfume;
e) from 0.005% to 30%, preferably from 0.01% to 20%, more preferably from 0.02% to 10% of said perfume delivery system;
f) from 0.01% to 20%, preferably from 0.1 to 10% more preferably from 0.1% to 5% of said soil dispersing polymer;
g) from 0.001% to 10%, preferably from 0.005 to 5%, more preferably from 0.01% to 2% of said brightener;
h) from 0.0001% to 10%, preferably from 0.01% to 2%, more preferably from 0.05% to 1% of said hueing dye;
i) from 0.0001% to 10%, preferably from 0.01% to 2%, more preferably from 0.05% to 1% of said dye transfer inhibiting agent;
j) from 0.01% to 10%, preferably from 0.01% to 5%, more preferably from 0.05% to 2% of said enzyme, preferably said enzyme is a detersive enzyme;
k) from 0.01% to 20%, from 0.1% to 10%, or from 0.1% to 5% of said structurant;
l) from 0.05% to 20%, preferably from 0.1% to 15%, more preferably from 0.2% to 7% of said fabric care benefit agent;
m) from 0.1% to 80% of said builder, if said composition is a powder laundry detergent, and from 0.1% to 20% of said builder, if said composition is a liquid laundry detergent;
n) from 0.1% to 99% of a carrier; and
o) mixtures thereof.

(hh2) A composition according to any of Paragraphs (a2) through (gg2) wherein:

a) said fabric softener active comprises a cationic fabric softener, preferably said cationic softener is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis- (stearoyl-2-hydroxypropyl)-N,N-dimethylammonium chloride, 1,2 di(stearoyl-oxy) 3 trimethyl ammonium-propane chloride, dicanoladimethylammonium chloride, ditallowdimethylammonium chloride, dicanoladimethylammonium methylsulfate, 1-methyl-1-stearoylamidoethyl-2-stearoylimidazolinium methylsulfate, 1-tallowylamidoethyl-2-tallowylimidazoline, Dipalmethyl Hydroxyethylammoinum Methosulfate and mixtures thereof;

b) said anionic surfactant scavenger comprises a water soluble cationic and/or zwitterionic scavenger compound; preferably, said anionic surfactant scavenger is selected from the group consisting of monoalkyl quaternary ammonium compounds and amine precursors thereof, dialkyl quaternary ammonium compounds and amine precursors thereof, polyquaternary ammonium compounds and amine precursors thereof, polymeric amines, and mixtures thereof;

c) said delivery enhancing agent comprises a material selected from the group consisting of a cationic polymer having a charge density from 0.05 milliequivalent/g to 23 milliequivalent per gram of polymer, an amphoteric polymer having a charge density from 0.05 milliequivalent/g to 23 milliequivalent per gram of polymer, a protein having a charge density from 0.05 milliequivalent/g to 23 milliequivalent per gram of protein and mixtures thereof;

d) said perfume delivery system is selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system, and mixtures thereof;

e) said soil dispersing polymer is selected from the group consisting of a homopolymer copolymer or terpolymer of an ethylenically unsaturated monomer anionic monomer, preferably said anionic monomer is selected from the group consisting of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, derivatives thereof, alkoxylated polyamines, preferably, alkoxylated polyethyleneimines, and mixtures thereof;

f) said brightener is selected from the group consisting of derivatives of stilbene or 4,4'-diaminostilbene, biphenyl, five-membered heterocycles, preferably triazoles, pyrazolines, oxazoles, imidiazoles, six-membered heterocycles, preferably, coumarins, naphthalamide, s-triazine, and mixtures thereof;

g) said hueing dye comprising a moiety selected the group consisting of acridine, anthraquinone preferably polycyclic quinones, azine, azo, preferably monoazo, disazo, trisazo, tetrakisazo, polyazo, premetallized azo, benzodifurane and benzodifuranone, carotenoid, coumarin, cyanine, diazahemicyanine, diphenylmethane, formazan, hemicyanine, indigoid, methane, naphthalimide, naphthoquinone, nitro and nitroso, oxazine, phthalocyanine, pyrazole, stilbene, styryl, triarylmethane, triphenylmethane, xanthene and mixtures thereof;

h) said dye transfer inhibiting agent is selected from the group consisting polyvinylpyrrolidone polymers, polyamine N-oxide polymers, copolymers of N-vinylpyrrolidone and N-vinylimidazole, polyvinyloxazolidones and polyvinylimidazoles or mixtures thereof;

i) said bleach is selected from the group consisting of catalytic metal complexes; activated peroxygen sources; bleach activators; bleach boosters; photobleaches; bleaching enzymes; free radical initiators; $H_2O_2$; hypohalite bleaches; peroxygen sources and mixtures thereof;

j) said detersive enzyme is selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, 13-glucanases, arabinosidases, hyaluronidase, chondroitinase, laccase, amylases and mixtures thereof;

k) said structurant is selected from the group consisting of hydrogenated castor oil, gellan gum, starches, derivatized starches, carrageenan, guar gum, pectin, xanthan gum, modified celluloses, microcrystalline celluloses modified proteins, hydrogenated polyalkylenes, non-hydrogenated polyalkenes, inorganic salts, preferably said inorganic salts are selected from the group consisting of magnesium chloride, calcium chloride, calcium formate, magnesium formate, aluminum chloride, potassium permanganate and mixtures thereof, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, preferably when said composition is a liquid laundry detergent composition, said structurant comprises hydrogenated castor oil; preferably when said composition is a rinse added fabric enhancer, said structurant comprises a linear and/or crosslinked homo- and co-polymer of quaternized N,N-dialkylaminoalkyl acrylate;

l) said fabric care benefit agent is selected from the group consisting of polyglycerol esters, oily sugar derivatives, wax emulsions, silicones, polyisobutylene, polyolefins and mixtures thereof;

m) said builder is selected from the group consisting of phosphate salts, water-soluble, nonphosphorus organic builders, alkali metal, ammonium and substituted ammonium polyacetates, carboxylates, polycarboxylates, polyhydroxy sulfonates, preferably said builder is selected from the group consisting of sodium, potassium, lithium, ammonium and substituted ammonium salts of ethylene diamine tetraacetic acid, nitrilotriacetic acid, oxydisuccinic acid, mellitic acid, benzene polycarboxylic acids, citric acid, oxydisuccinate, ether carboxylate, tartrate monosuccinate, tartrate disuccinate, silicate, aluminosilicate, borate, carbonate, bicarbonate, sesquicarbonate, tetraborate decahydrate, zeolites, and mixtures thereof;

n) said surfactant is selected from the group consisting of anionic surfactants, nonionic surfactants, ampholytic surfactants, cationic surfactants, zwitterionic surfactants, and mixtures thereof o) said carrier is selected from the group consisting of water, 1,2-propanediol, hexylene glycol, ethanol, isopropanol, glycerol, $C_1$-$C_4$ alkanolamines, salts, sugars, polyalkylene oxides such as polyethylene oxide; polyethylene glycols; polypropylene oxide, and mixtures thereof;

(ii2) A composition according to any of Paragraphs (a2) through (hh2) wherein:

a) said fabric softener active is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammoniumpropane chloride, dicanoladimethylammonium chloride, di(hard)tallowdimethylammonium chloride dicanoladimethylammonium methylsulfate, Dipalmethyl Hydroxyethylammoinum Methosulfate and mixtures thereof;

b) said anionic surfactant scavenger is selected from the group consisting of monoalkyl quaternary ammonium compounds, amine precursors of monoalkyl quaternary ammonium compounds, dialkyl quaternary ammonium compounds, and amine precursors of dialkyl quaternary ammonium compounds, polyquaternary ammonium compounds, amine precursors of polyquaternary ammonium compounds, and mixtures thereof, preferably, said anionic surfactant scavenger is selected from the group consisting of N—$C_6$ to $C_{18}$ alkyl-N,N,N-trimethyl ammonium salts, N—$C_6$ to $C_{18}$ alkyl-N-hydroxyethyl-N,N-dimethyl ammonium salts, N—$C_6$ to $C_{18}$ alkyl-N,N-dihydroxyethyl-N-methyl ammonium salts, N—$C_6$ to $C_{18}$ alkyl-N-benzyl-N,N-dimethyl ammonium salts, N,N-di-$C_6$ to di-$C_{12}$ alkyl-N,N-dimethyl ammonium salts, N,N-di-$C_6$ to di-$C_{12}$ alkyl N-hydroxyethyl N-methyl ammonium salts, N—$C_6$ to $C_{18}$ alkyl N-alkylhexyl, N,N-dimethyl ammonium salt;

c) said delivery enhancing agent is selected from the group consisting of cationic polysaccaharides, polyethyleneimine and its derivatives, polyamidoamines and homopolymers, copolymers and terpolymers made from one or more cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, and combinations thereof; more preferably, when said composition is a rinse added fabric enhancer, said polymer comprises a linear and/or cross-linked quaternized N,N-dialkylaminoalkyl acrylate, when said composition is a liquid laundry detergent, said delivery enhancing agent comprises cationic polysaccharide, polyquaternium-10, polyquaternium-7, polyquaternium-6, a homo- or co-polymer selected diallyl dimethyl ammonium chloride, quaternized N,N-dialkylaminoalkyl acrylamide, quaternized N,N-dialkylaminoalkylmethacrylamide, vinylamine, and mixtures thereof;

d) said soil dispersing polymer is selected from the group consisting of alkoxylated polyethyleneimines, homopolymer or copolymer of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, acrylamidopropylmethane sulfonic acid (AMPS) and their salts, derivatives and combinations thereof;

e) said brightener is selected from the group consisting of derivatives of stilbene or 4,4'-diaminostilbene, biphenyl, five-membered heterocycles such as triazoles and mixtures thereof;

f) said hueing dye is selected from the group consisting of Direct Violet dyes, preferably Direct Violet dyes 9, 35, 48, 51, 66, and 99; Direct Blue dyes, preferably Direct Blue dyes 1, 71, 80 and 279; Acid Red dyes, preferably Acid Red dyes 17, 73, 52, 88 and 150; Acid Violet dyes, preferably Acid Violet dyes 15, 17, 24, 43, 49 and 50; Acid Blue dyes, preferably Acid Blue dyes 15, 17, 25, 29, 40, 45, 75, 80, 83, 90 and 113; Acid Black dyes, preferably Acid Black dye 1; Basic Violet dyes, preferably Basic Violet dyes 1, 3, 4, 10 and 35; Basic Blue dyes, preferably Basic Blue dyes 3, 16, 22, 47, 66, 75 and 159; Disperse or Solvent dyes and mixtures thereof, more preferably said hueing dye is selected from the group consisting of Acid Violet 17, Acid Blue 80, Acid Violet 50, Direct Blue 71, Direct Violet 51, Direct Blue 1, Acid Red 88, Acid Red 150, Acid Blue 29, Acid Blue 113 and mixtures thereof;

g) said bleach is selected from the group consisting of catalytic metal complexes; activated peroxygen sources; bleach activators; bleach boosters; photobleaches, peroxygen source, hydrogen peroxide, perborate and percarbonate or mixtures thereof;

h) said enzyme, is selected from the group consisting of hemicellulases, peroxidases, proteases, cellulases, xylanases, lipases, phospholipases, esterases, cutinases, pectinases, pentosanases, malanases, β-glucanases, laccase, amylases and mixtures thereof, preferably said enzyme is s detersive enzyme;

i) said surfactant is selected from the group consisting of alkyl sulfate, alkyl ethoxysulfate, linear alkylbenzene sulfonate, alpha olefin sulfonate, ethoxylated alcohols, ethoxylated alkyl phenols, fatty acids, soaps, and mixtures thereof.

j) said fabric care benefit agent is selected from the group consisting of polydimethylsiloxane, silicone polyethers, cationic silicone, aminosilicone, and mixtures thereof.

(jj2) A composition according to any of Paragraphs (a2) through (II2) comprising:

a) a fabric softener active selected from the group consisting of a cationic fabric softener, preferably said cationic softener is selected from the group consisting of esters of bis-(2-hydroxypropyl)-dimethylammonium methylsulfate and fatty acid; isomers of esters of bis-(2-hydroxypropyl)-dimethylammonium methylsulfate and fatty acid, preferably bis-(2-hydroxypropyl)-dimethylammonium methylsulphate fatty acid ester, more preferably the fatty acid is a $C_{12}$-$C_{22}$ fatty acid that can have a tallow or vegetable origin, can be saturated or unsaturated, and/or can be substituted or unsubstituted, 1,2-di(acyloxy)-3-trimethylammoniopropane chloride, N,N-bis(stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammoniumpropane chloride, dicanoladimethylammonium chloride, di(hard)tallowdimethylammonium chloride, dicanoladimethylammonium methylsulfate, 1-methyl-1-stearoylamidoethyl-2-stearoylimidazolinium methylsulfate, 1-tallowylamidoethyl-2-tallowylimidazoline, Dipalmethyl Hydroxyethylammoinum Methosulfate and mixtures thereof;

b) a carrier, c) optionally, an anionic surfactant scavenger selected from the group consisting of a water soluble cationic and/or zwitterionic scavenger compound; preferably, said anionic surfactant scavenger is selected from the group consisting of monoalkyl quaternary ammonium compounds and amine precursors thereof, dialkyl quaternary ammonium compounds and amine precursors thereof, polyquaternary ammonium compounds and amine precursors thereof, polymeric amines, and mixtures thereof;

d) optionally, a delivery enhancing agent selected from the group consisting of a cationic polymer having a charge density from 0.05 milliequivalent/g to 23 milliequivalent per gram of polymer, an amphoteric polymer having a charge density from 0.05 milliequivalent/g to 23 milliequivalent per gram of polymer, a protein having a charge density from 0.05 milliequivalent/g to 23 milliequivalent per gram of protein and mixtures thereof;

e) optionally, a dye transfer inhibiting agent selected from the group consisting of polyvinylpyrrolidone polymers, polyamine N-oxide polymers, copolymers of N-vinylpyrrolidone and N-vinylimidazole, polyvinyloxazolidones and polyvinylimidazoles or mixtures thereof;

f) optionally, a structurant selected from the group consisting of hydrogenated castor oil, gellan gum, starches, derivatized starches, carrageenan, guar gum, pectin, xanthan gum, modified celluloses, microcyrstalline celluloses, modified proteins, hydrogenated polyalkylenes, non-hydrogenated polyalkenes, inorganic salts, preferably said inorganic salts are selected from the group consisting of magnesium chloride, calcium chloride, calcium formate, magnesium formate, aluminum chloride, potassium permanganate and mixtures thereof, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, preferably when said composition is a liquid laundry detergent composition, said structurant comprises hydrogenated castor oil; preferably when said composition is a rinse added fabric enhancer, said structurant comprises a linear and/or crosslinked homo- and co-polymer of quaternized N,N-dialkylaminoalkyl acrylate; and g) optionally, a fabric care benefit agent selected from the group consisting of polyglycerol esters, oily sugar derivatives, wax emulsions, silicones, polyisobutylene, polyolefins and mixtures thereof; and h) optionally a perfume; and i) optionally a perfume delivery system, preferably said perfume delivery system is selected from the group consisting of selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; preferably 2 or more types of PMC;

said composition having a pH of from 2 to 7, preferably a pH from 2 to 5.

(kk2) A composition according to any of Paragraphs (a2) through (II2) comprising:

a) a surfactant selected from the group consisting of anionic surfactants, nonionic surfactants, ampholytic surfactants, cationic surfactants, zwitterionic surfactants, and mixtures thereof;

b) a carrier;

c) optionally, a builder selected from the group consisting of phosphate salts, water-soluble, nonphosphorus organic builders, alkali metal, ammonium and substituted ammonium polyacetates, carboxylates, polycarboxylates, polyhydroxy sulfonates, preferably said builder is selected from the group consisting of sodium, potassium, lithium, ammonium and substituted ammonium salts of ethylene diamine tetraacetic acid, nitrilotriacetic acid, oxydisuccinic acid, mellitic acid, benzene polycarboxylic acids, citric acid, oxydisuccinate, ether carboxylate, tartrate monosuccinate, tartrate disuccinate, silicate, aluminosilicate, borate, carbonate, bicarbonate, sesquicarbonate, tetraborate decahydrate, zeolites, and mixtures thereof;

d) optionally, a soil dispersing polymer selected from the group consisting of a homopolymer copolymer or terpolymer of an ethylenically unsaturated monomer anionic monomer, preferably said anionic monomer is selected from the group consisting of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, derivatives thereof, alkoxylated polyamines, preferably, alkoxylated polyethyleneimines, and mixtures thereof;

e) optionally, a delivery enhancing agent selected from the group consisting of a cationic polymer having a charge density from 0.05 milliequivalent/g to 23 milliequivalent per gram of polymer, an amphoteric polymer having a charge density from 0.05 milliequivalent/g to 23 milliequivalent per gram of polymer, a protein having a charge density from 0.05 milliequivalent/g to 23 milliequivalent per gram of protein and mixtures thereof;

f) optionally, a brightener selected from the group consisting of derivatives of stilbene or 4,4'-diaminostilbene, biphenyl, five-membered heterocycles, preferably triazoles, pyrazolines, oxazoles, imidiazoles, six-membered heterocycles, preferably coumarins, naphthalamide, s-triazine, and mixtures thereof;

g) optionally, a hueing dye comprising a moiety selected the group consisting of acridine, anthraquinone preferably polycyclic quinones, azine, azo preferably monoazo, disazo, trisazo, tetrakisazo, polyazo, premetallized azo, benzodifurane and benzodifuranone, carotenoid, coumarin, cyanine, diazahemicyanine, diphenylmethane, formazan, hemicyanine, indigoid, methane, naphthalimide, naphthoquinone, nitro and nitroso, oxazine, phthalocyanine, pyrazole, stilbene, styryl, triarylmethane, triphenylmethane, xanthene and mixtures thereof;

h) optionally, a dye transfer inhibiting agent selected from the group consisting polyvinylpyrrolidone polymers, polyamine N-oxide polymers, copolymers of N-vinylpyrrolidone and N-vinylimidazole, polyvinyloxazolidones and polyvinylimidazoles or mixtures thereof;

i) optionally, a bleach selected from the group consisting of catalytic metal complexes; activated peroxygen sources; bleach activators; bleach boosters; photobleaches; bleaching enzymes; free radical initiators; $H_2O_2$; hypohalite bleaches; peroxygen sources and mixtures thereof;

j) optionally, a detersive enzyme selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases and mixtures thereof;

k) optionally, a structurant selected from the group consisting of hydrogenated castor oil, gellan gum, starches, derivatized starches, carrageenan, guar gum, pectin, xanthan gum, modified celluloses, modified proteins, hydrogenated polyalkylenes, non-hydrogenated polyalkenes, inorganic salts, preferably said inorganic salts are selected from the group consisting of magnesium chloride, calcium chloride, calcium formate, magnesium formate, aluminum chloride, potassium permanganate and mixtures thereof, clay, homo- and copolymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof, preferably when said composition is a liquid laundry detergent composition, said structurant comprises hydrogenated castor oil; preferably when said composition is a rinse added fabric enhancer, said structurant comprises a linear and/or crosslinked homo- and co-polymer of quaternized N,N-dialkylaminoalkyl acrylate;

l) optionally, a fabric care benefit agent selected from the group consisting of polyglycerol esters, oily sugar derivatives, wax emulsions, silicones, polyisobutylene, polyolefins and mixtures thereof; and m) optionally a perfume;

n) optionally a perfume delivery system, preferably said perfume delivery system is selected from the group consisting of selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; preferably 2 or more types of PMC;

said composition having a pH of from 4 to 12, more preferably a pH from 5 to 9.

(ll2) A composition according to any of Paragraphs (a2) through (II2) comprising a) 49 to 99% of carrier selected from the group consisting of polyethylene glycol, salt, polysaccharide and sugar; preferably a polyethylene glycol of molecular weight from 2000 Da to 20,000 Da, more preferably a polyethylene glycol of molecular weight from 3,000 Da to 12,000 Da, and most preferably a polyethylene glycol of molecular weight from 6,000 Da to 10,000 Da;

b) optionally, a fabric care benefit agent, preferably a silicone;

c) optionally a perfume;

d) optionally a perfume delivery system;

e) optionally a delivery enhancing agent.

(mm2) A composition according to any of Paragraphs (a2) through (II2) comprising:

a) a fabric softening agent, a perfume, and a delivery enhancing agent; or b) a fabric softening agent, a perfume and a perfume delivery system; or c) a hueing dye and a surfactant; or d) less than 10% total water, said total water being the sum of the free and bound water; or e) a fabric softening agent, a fabric care benefit agent and a delivery enhancing agent; or g) a fabric care benefit agent, anionic surfactant scavenger and a delivery enhancing agent; or h) a perfume delivery system, preferably said perfume delivery system is selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system; preferably 2 or more types of PMC.

(nn2) A composition according to any of Paragraphs (a2) through (jj2), said composition comprising an emulsion, a gel network or lamellar phase, preferably said composition comprises vesicles.

(oo2) A composition according to any of a Paragraphs (a2) through (II2) and (112) said composition being in the form of a crystal, a bead or a pastille, preferably said composition comprises, based on total composition weight, from 0.1% to 50%, preferably from 0.5% to 30%, more preferably from 5% to 30% of a glyceride copolymer, selected from the group consisting of said first glyceride copolymer, second glyceride copolymer, third glyceride copolymer, and mixtures thereof, preferably the said bead has a shape that is circular, lozenge shape, dome shape or semi-circular with a flat base.

(pp2) An article comprising a composition according to any of Paragraphs (a2) through (002) and a water soluble film, preferably said film comprises polyvinyl alcohol, preferably said film surrounds said composition, more preferably said article comprises two or more chambers that are surrounded by said film and wherein at least one of said chambers comprises said composition.

(qq2) An article comprising a composition according to any of Paragraphs (a2) through (II2), said article being in the form of a dryer sheet.

(rr2) A fabric treated with a composition according to any of Paragraphs (a2) through (002) and/or an article according to any of Paragraphs (pp2) through (qq2).

(ss2) A method of treating and/or cleaning a fabric, said method comprising a) optionally washing and/or rinsing said fabric;

b) contacting said fabric with a composition according to any of any of Paragraphs (a2) through (oo2), (uu2) and (vv2) and/or an article according to any of Paragraphs (pp2) through (qq2);

c) optionally washing and/or rinsing said fabric; and d) optionally passively or actively drying said fabric.

(tt2) A composition according to any of Paragraphs (a2) through (002), wherein said first, and second, glyceride copolymers have a free hydrocarbon content, based on the weight of glyceride copolymer of from 0% to 5%, preferably from 0.1% to 5%, more preferably from 0.1% to 4%, more preferably from 0.1 to 3%, most preferably from 0.1% to 1%.

selected from the group consisting of: 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl; preferably $R^{21}$, $R^{22}$, and $R^{23}$ are each independently selected from the group consisting of 8-nonenyl, 8-decenyl, 8-undecenyl, 8,11-dodecadienyl, 8,11-tridecadienyl, 8,11-tetradecadienyl, 8,11,14-pentadecatrienyl, 8,11,14-hexadecatrienyl, 12-tridecenyl, 12-tetradecenyl, and 12-pentadecenyl.

Methods of Making Compositions

The compositions of the present invention can be formulated into any suitable form and prepared by any process chosen by the formulator, non-limiting examples of which are described in U.S. Pat. No. 5,879,584 which is incorporated herein by reference. For example, the glyceride copolymers can be combined directly with the composition's other ingredients without pre-emulsification and/or pre-mixing to form the finished products. Alternatively, the glyceride copolymers can be combined with surfactants or emulsifiers, solvents, suitable adjuncts, and/or any other suitable ingredients to prepare emulsions prior to compounding the finished products.

Suitable equipment for use in the processes disclosed herein may include continuous stirred tank reactors, homogenizers, turbine agitators, recirculating pumps, paddle mixers, plough shear mixers, ribbon blenders, vertical axis granulators and drum mixers, both in batch and, where available, in continuous process configurations, spray dryers, and extruders. Such equipment can be obtained from Lodige GmbH (Paderborn, Germany), Littleford Day, Inc. (Florence, Ky., U.S.A.), Forberg AS (Larvik, Norway), Glatt Ingenieurtechnik GmbH (Weimar, Germany), Niro (Soeborg, Denmark), Hosokawa Bepex Corp. (Minneapolis, Minn., U.S.A.), Arde Barinco (New Jersey, U.S.A.).

Glyceride Oligomers

In one aspect, the disclosure provides glyceride copolymers of formula (I):

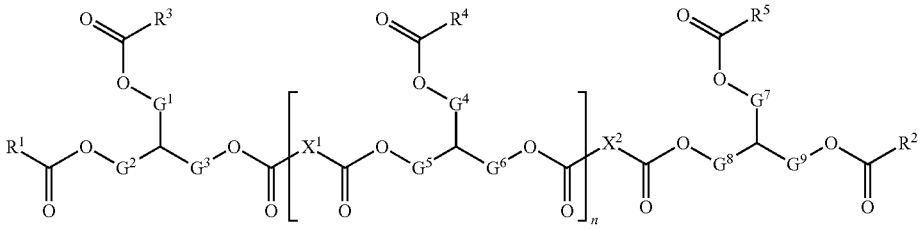

(I)

(uu2) A composition according to any of Paragraphs (a2) through (002), wherein said third glyceride copolymer have a free hydrocarbon content, based on the weight of glyceride copolymer of from 0% to 5%, preferably from 0.1% to 5%, more preferably from 0.1% to 4%, more preferably from 0.1 to 3%, most preferably from 0.1% to 1%.

(vv2) The composition according to any of Paragraphs (a2) through (c2) and (w2), wherein for the third glyceride copolymer, $R^{21}$, $R^{22}$, and $R^{23}$ are each independently wherein: each $R^1$, $R^2$, $R^3$, $R^4$, and $R^5$ is independently selected from the group consisting of an oligomeric glyceride moiety, a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties; and/or each of the following combinations of moieties may each independently be covalently linked: $R^1$ and $R^3$, $R^2$ and $R^5$, $R^1$ and an adjacent $R^4$, $R^2$ and an adjacent $R^4$, $R^3$ and an adjacent $R^4$, $R^5$ and an adjacent $R^4$, or any two adjacent $R^4$ such that the covalently linked moieties forms an alkenylene moiety; each X and $X^2$ is independently selected from the group consisting of a $C_{1-32}$ alkylene, a substituted $C_{1-32}$ alkylene wherein the substituent is one or more —OH moieties, a $C_{2-32}$ alkenylene or a substituted $C_{2-32}$ alkenylene wherein the substituent is one or more —OH moieties; two of $G^1$, $G^2$, and $G^3$ are —$CH_2$—, and one of $G^1$, $G^2$, and $G^3$ is a direct bond; for each individual repeat unit in the repeat unit having index n, two of $G^4$, $G^5$, and $G^6$ are —$CH_2$—, and one of $G^4$, $G^5$, and $G^6$ is a direct bond, and the values $G^4$, $G^5$, and $G^6$ for each individual repeat unit are independently selected from the values of $G^4$, $G^5$, and $G^6$ in other repeating units; two of $G^7$, $G^8$, and $G^9$ are —$CH_2$—, and one of $G^7$, $G^8$, and $G^9$ is a direct bond; and n is an integer from 3 to 250; with the proviso for each of said second glyceride copolymers at least one of $R^1$, $R^2$, $R^3$, and $R^5$, and/or at least one $R^4$ in one individual repeat unit of said repeat unit having index n, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl.

$G^1$, $G^2$, and $G^3$ can have any suitable value. In some embodiments, $G^1$ and $G^2$ are —$CH_2$— and $G^3$ is a direct bond. In some other embodiments, $G^1$ and $G^3$ are —$CH_2$— and $G^2$ is a direct bond. In some other embodiments, $G^2$ and $G^3$ are —$CH_2$— and $G^1$ is a direct bond.

$G^4$, $G^5$, and $G^6$ can, in each instance, independently have any suitable value. In some embodiments of any of the aforementioned embodiments, in at least one instance, $G^4$ and $G^5$ are —$CH_2$— and $G^6$ is a direct bond. In some other embodiments of any of the aforementioned embodiments, in at least one instance, $G^4$ and $G^6$ are —$CH_2$— and $G^5$ is a direct bond. In some other embodiments of any of the aforementioned embodiments, in at least one instance, $G^5$ and $G^6$ are —$CH_2$— and $G^4$ is a direct bond.

$G^7$, $G^8$, and $G^9$ can have any suitable value. In some embodiments of any of the aforementioned embodiments, $G^7$ and $G^8$ are —$CH_2$— and $G^9$ is a direct bond. In some other embodiments of any of the aforementioned embodiments, $G^7$ and $G^9$ are —$CH_2$— and $G^8$ is a direct bond. In some other embodiments of any of the aforementioned embodiments, $G^8$ and $G^9$ are —$CH_2$— and $G^7$ is a direct bond.

$X^1$ can have any suitable value. In some embodiments of any of the aforementioned embodiments, $X^1$ is —$(CH_2)_{16}$—, —$(CH_2)_{18}$—, —$(CH_2)_{19}$—, —$(CH_2)_{20}$—, —$(CH_2)_{22}$—, —$(CH_2)_{24}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_{11}$—CH═CH—$(CH_2)_{11}$—, —$(CH_2)_7$—CH═CH—$CH_2$—CH═CH—$(CH_2)_{11}$—, —$(CH_2)_{11}$—CH═CH—$CH_2$—CH═CH—$(CH_2)_7$—, —$(CH_2)_7$—CH═CH—$CH_2$—CH═CH—$CH_2$—CH═CH—$(CH_2)_{11}$—, —$(CH_2)_{11}$—CH═CH—$CH_2$—CH═CH—$CH_2$—CH═CH—$(CH_2)_7$—, —$(CH_2)_9$—CH═CH—$(CH_2)_7$, —$(CH_2)_7$—CH═CH—$(CH_2)_9$, —$(CH_2)_{11}$—CH═CH—$(CH_2)_7$—, or —$(CH_2)_7$—CH═CH—$(CH_2)_{11}$—. In some such embodiments, $X^1$ is —$(CH_2)_{16}$—, —$(CH_2)_{18}$—, —$(CH_2)_{19}$—, —$(CH_2)_{22}$—, —$(CH_2)_{25}$—, —$(CH_2)_{28}$—, —$(CH_2)_7$—CH═CH—$(CH_2)_7$—, —$(CH_2)_9$—CH═CH—$(CH_2)_7$—, —$(CH_2)_7$—CH═CH—$(CH_2)_9$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—. In some such embodiments, $X^1$ is —$(CH_2)_{16}$—, —$(CH_2)_{19}$—, —$(CH_2)_{22}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—. In some further such embodiments, $X^1$ is —$(CH_2)_7$—CH═CH—$(CH_2)_7$—, —$(CH_2)_9$—CH═CH—$(CH_2)_7$—, —$(CH_2)_7$—CH═CH—$(CH_2)_9$—, —$(CH_2)_7$—CH═CH—$CH_2$—CH═CH—$(CH_2)_7$ —, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, or —$(CH_2)$—CH═CH—$CH_2$—CH═CH—$CH_2$—CH═CH—$CH_2$—CH═CH—CH—CH═CH—$(CH_2)_7$—. In some further such embodiments, $X^1$ is —$(CH_2)_7$ —CH═CH—$(CH_2)_7$—, —$(CH_2)_7$—CH═CH—$CH_2$—CH═CH—$(CH_2)_7$, —$(CH_2)_7$—CH═CH—$CH_2$—CH═CH—$CH_2$—CH═CH—$(CH_2)_7$—, or —$(CH_2)_7$—CH═CH—$CH_2$—CH═CH—$CH_2$—CH═CH—$CH_2$—CH═CH—$(CH_2)_7$—.

$X^2$ can have any suitable value. In some embodiments of any of the aforementioned embodiments, $X^2$ is —$(CH_2)_{16}$—, —$(CH_2)_{18}$—, —$(CH_2)_{19}$—, —$(CH_2)_{20}$—, —$(CH_2)_{22}$—, —$(CH_2)_{24}$—, —$(CH_2)_{25}$—, —$(CH_2)_{28}$—, —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—CH—CH═CH—$(CH_2)_7$—, —$(CH_2)_{11}$—CH═CH—$(CH_2)_{11}$—, —$(CH_2)$—CH═CH—$CH_2$—CH═CH—$(CH_2)_{11}$—, —$(CH_2)_{11}$—CH═CH—$CH_2$—CH═CH—$(CH_2)_7$—, —$(CH_2)_7$—CH═CH—$CH_2$—CH═CH—CH—CH═CH—$(CH_2)_{11}$—, —$(CH_2)_{11}$—CH═CH—$CH_2$—CH═CH—$CH_2$—CH═CH—CH—CH═CH—$(CH_2)_7$—, —$(CH_2)_9$—CH═CH—$(CH_2)$, —$(CH_2)_7$—CH═CH—$(CH_2)_9$, —$(CH_2)_{11}$—CH═CH—$(CH_2)_7$—, or —$(CH_2)$—CH═CH—$(CH_2)_{11}$—. In some such embodiments, $X^2$ is —$(CH_2)_7$—CH═CH—$(CH_2)_7$—, —$(CH_2)_9$—CH═CH—$(CH_2)_7$—, —$(CH_2)_7$—CH═CH—$(CH_2)_9$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—CH—CH═CH—$(CH_2)_7$—, or —$(CH_2)$—CH═CH—$CH_2$—CH═CH—$CH_2$—CH═CH—$CH_2$—CH═CH—CH—CH═CH—$(CH_2)_7$—. In some such embodiments, $X^2$ is —$(CH_2)_{16}$—, —$(CH_2)_{19}$—, —$(CH_2)_{22}$—, —$(CH)_{25}$—, —$(CH)_{28}$—, —$(CH_2)_7$—CH═CH—$(CH_2)$—, —$(CH_2)_7$—CH═CH—$CH_2$—CH═CH—$(CH_2)_7$—, —$(CH_2)_7$—CH═CH—$CH_2$—CH═CH—$CH_2$—

CH═CH—$(CH_2)_7$—, —$(CH_2)_7$—CH═CH—$CH_2$—CH═CH—$CH_2$—CH═CH—CH—CH═CH—$(CH_2)_7$—, or —$(CH_2)$—CH═CH—$CH_2$—CH═CH—$CH_2$—CH═CH—$CH_2$—CH═CH—CH—CH═CH—$(CH_2)_7$—. In some further such embodiments, $X^2$ is —$(CH_2)_7$—CH═CH—$(CH_2)_7$—, —$(CH_2)_9$—CH═CH—$(CH_2)_7$—, —$(CH_2)_7$—CH═CH—$(CH_2)_9$—, —$(CH_2)_7$—CH═CH—$CH_2$—CH═CH—$(CH_2)$—, —$(CH_2)_7$—CH═CH—$CH_2$—CH═CH—$CH_2$—CH═CH—$(CH_2)$—, —$(CH_2)_7$—CH═CH—$CH_2$—CH═CH—$CH_2$—CH═CH—$CH_2$—CH═CH—$(CH_2)_7$—, or —$(CH_2)_7$—CH═CH—$CH_2$—CH═CH—$CH_2$—CH═CH—$CH_2$—CH═CH—$CH_2$—CH═CH—$(CH_2)_7$—. In some further such embodiments, $X^2$ is —$(CH_2)_7$—CH═CH—$(CH_2)_7$—, —$(CH_2)_7$—CH═CH—$CH_2$—CH═CH—$(CH_2)_7$—, —$(CH_2)_7$—CH═CH—$CH_2$—CH═CH—$CH_2$—CH═CH—$(CH_2)_7$—, —$(CH_2)_7$—CH═CH—$CH_2$—CH═CH—$CH_2$—CH═CH—$(CH_2)_7$—, or —$(CH_2)_7$—CH═CH—$CH_2$—CH═CH—$CH_2$—CH═CH—$CH_2$—CH═CH—$(CH_2)_7$—.

$R^1$ can have any suitable value. In some embodiments of any of the aforementioned embodiments, $R^1$ is $C_{1-24}$ alkyl, or $C_{11-24}$ alkyl, or $C_{13-24}$ alkyl, or $C_{15-24}$ alkyl. In some such embodiments, $R^1$ is undecyl, tridecyl, pentadecyl, or heptadecyl. In some further such embodiments, $R^1$ is pentadecyl or heptadecyl. In some embodiments of any of the aforementioned embodiments, $R^1$ is $C_{2-24}$ alkenyl or $C_{9-24}$ alkenyl. In some such embodiments, $R^1$ is 8-heptadecenyl, 10-heptadecenyl, 12-heneicosenyl, 8,11-heptadecadienyl, 8,11,14-heptadecatrienyl, 8-nonenyl, 8-decenyl, 8-undecenyl, 10-undecenyl, 8-dodecenyl, 12-tridecenyl, 12-tetradecenyl, 12-pentadecenyl, 12-hexadecenyl, 9-methyl-8-decenyl, 9-methyl-8-undecenyl, 10-methyl-8-undecenyl, 13-methyl-12-tetradecenyl, 13-methyl-12-pentadecenyl, 14-methyl-12-pentadecenyl, 8,11-dodecadienyl, 8,11-tridecadienyl, 8,11-tetradecadienyl, 8,11-pentadecadienyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 8,11,14-pentadecatrienyl, 8,11,14-hexadecatrienyl, 8,11,14-heptadecatrienyl, or 8,11,14-octadecatrienyl. In some further such embodiments, $R^1$ is 8-heptadecenyl, 10-heptadecenyl, 8,11-heptadecadienyl, or 8,11,14-heptadecatrienyl. In some further such embodiments, $R^1$ is 8-heptadecenyl, 8,11-heptadecadienyl, or 8,11,14-heptadecatrienyl. In some such embodiments, $R^1$ is 8-nonenyl, 8-decenyl, 8-undecenyl, 10-undecenyl, 8-dodecenyl, 8,11-dodecadienyl, 8,11-tridecadienyl, 12-tridecenyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^1$ is 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^1$ is 8-nonenyl, 8-undecenyl, 8,11-dodecadienyl, 8,11-tetradecadienyl, or 8,11,14-pentadecatrienyl. In some embodiments, $R^1$ is an oligomeric glyceride moiety.

$R^2$ can have any suitable value. In some embodiments of any of the aforementioned embodiments, $R^2$ is $C_{1-24}$ alkyl, or $C_{11-24}$ alkyl, or $C_{13-24}$ alkyl, or $C_{15-24}$ alkyl. In some such embodiments, $R^2$ is undecyl, tridecyl, pentadecyl, or heptadecyl. In some further such embodiments, $R^2$ is pentadecyl or heptadecyl. In some embodiments of any of the aforementioned embodiments, $R^2$ is $C_{2-24}$ alkenyl or $C_{9-24}$ alkenyl In some such embodiments, $R^2$ is 8-heptadecenyl, 10-heptadecenyl, 12-heneicosenyl, 8,11-heptadecadienyl, 8,11,14-heptadecatrienyl, 8-nonenyl, 8-decenyl, 8-undecenyl, 10-undecenyl, 8-dodecenyl, 12-tridecenyl, 12-tetradecenyl, 12-pentadecenyl, 12-hexadecenyl, 9-methyl-8-decenyl, 9-methyl-8-undecenyl, 10-methyl-8-undecenyl, 13-methyl-12-tetradecenyl, 13-methyl-12-pentadecenyl, 14-methyl-12-pentadecenyl, 8,11-dodecadienyl, 8,11-tridecadienyl, 8,11-tetradecadienyl, 8,11-pentadecadienyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 8,11,14-pentadecatrienyl, 8,11,14-hexadecatrienyl, 8,11,14-heptadecatrienyl, or 8,11,14-octadecatrienyl. In some further such embodiments, $R^2$ is 8-heptadecenyl, 10-heptadecenyl, 8,11-heptadecadienyl, or 8,11,14-heptadecatrienyl. In some further such embodiments, $R^2$ is 8-heptadecenyl, 8,11-heptadecadienyl, or 8,11,14-heptadecatrienyl. In some such embodiments, $R^2$ is 8-nonenyl, 8-decenyl, 8-undecenyl, 10-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^2$ is 8-nonenyl, 8-decenyl, 8-undecenyl, 8-dodecenyl, 8,11-dodecadienyl, 8,11-tridecadienyl, 12-tridecenyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^2$ is 8-nonenyl, 8-undecenyl, 8,11-dodecadienyl, 8,11-tetradecadienyl, or 8,11,14-pentadecatrienyl. In some embodiments, $R^2$ is an oligomeric glyceride moiety.

$R^3$ can have any suitable value. In some embodiments of any of the aforementioned embodiments, $R^3$ is $C_{1-24}$ alkyl, or $C_{11-24}$ alkyl, or $C_{13-24}$ alkyl, or $C_{15-24}$ alkyl. In some such embodiments, $R^3$ is undecyl, tridecyl, pentadecyl, or heptadecyl. In some further such embodiments, $R^3$ is pentadecyl or heptadecyl. In some embodiments of any of the aforementioned embodiments, $R^3$ is $C_{2-24}$ alkenyl or $C_{9-24}$ alkenyl. In some such embodiments, $R^3$ is 8-heptadecenyl, 10-heptadecenyl, 12-heneicosenyl, 8,11-heptadecadienyl, 8,11,14-heptadecatrienyl, 8-nonenyl, 8-decenyl, 8-undecenyl, 10-undecenyl, 8-dodecenyl, 12-tridecenyl, 12-tetradecenyl, 12-pentadecenyl, 12-hexadecenyl, 9-methyl-8-decenyl, 9-methyl-8-undecenyl, 10-methyl-8-undecenyl, 13-methyl-12-tetradecenyl, 13-methyl-12-pentadecenyl, 14-methyl-12-pentadecenyl, 8,11-dodecadienyl, 8,11-tridecadienyl, 8,11-tetradecadienyl, 8,11-pentadecadienyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 8,11,14-pentadecatrienyl, 8,11,14-hexadecatrienyl, 8,11,14-heptadecatrienyl, or 8,11,14-octadecatrienyl. In some further such embodiments, $R^3$ is 8-heptadecenyl, 10-heptadecenyl, 8,11-heptadecadienyl, or 8,11,14-heptadecatrienyl. In some further such embodiments, $R^3$ is 8-heptadecenyl, 8,11-heptadecadienyl, or 8,11,14-heptadecatrienyl. In some such embodiments, $R^3$ is 8-nonenyl, 8-decenyl, 8-undecenyl, 10-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^3$ is 8-nonenyl, 8-decenyl, 8-undecenyl, 8-dodecenyl, 8,11-dodecadienyl, 8,11-tridecadienyl, 12-tridecenyl, 8,11-tetradecadienyl, 8,11-pentadecadienyl, 8,11,14-pentadecatrienyl, 8,11,14-hexadecatrienyl, 8,11,14-heptadecatrienyl, or 8,11, 14-octadecatrienyl. In some further such embodiments, $R^3$ is 8-nonenyl, 8-undecenyl, 8,11-dodecadienyl, 8,11-tetradecadienyl, or 8,11,14-pentadecatrienyl. In some embodiments, $R^3$ is an oligomeric glyceride moiety.

$R^4$ can, in each of its instances, have any suitable value. In some embodiments of any of the aforementioned embodiments, $R^4$, in at least one instance, is $C_{1-24}$ alkyl, or $C_{11-24}$ alkyl, or $C_{13-24}$ alkyl, or $C_{15-24}$ alkyl. In some such embodiments, $R^4$ is, in at least one instance, undecyl, tridecyl, pentadecyl, or heptadecyl. In some further such embodiments, $R^4$ is, in at least one instance, pentadecyl or heptadecyl. In some embodiments of any of the aforementioned embodiments, $R^4$ is, in at least one instance, $C_{2-24}$ alkenyl or $C_{9-24}$ alkenyl. In some such embodiments, $R^4$ is, in at least one instance, 8-heptadecenyl, 10-heptadecenyl, 12-heneicosenyl, 8,11-heptadecadienyl, 8,11,14-heptadecatrienyl, 8-nonenyl, 8-decenyl, 8-undecenyl, 10-undecenyl, 8-dodecenyl, 12-tridecenyl, 12-tetradecenyl, 12-pentadecenyl, 12-hexadecenyl, 9-methyl-8-decenyl, 9-methyl-8-undecenyl, 10-methyl-8-undecenyl, 13-methyl-12-tetradecenyl, 13-methyl-12-pentadecenyl, 14-methyl-12-pentadecenyl, 8,11-dodecadienyl, 8,11-tridecadienyl, 8,11-tetradecadienyl, 8,11-pentadecadienyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 8,11,14-pentadecatrienyl, 8,11,14-hexadecatrienyl, 8,11,14-heptadecatrienyl, or 8,11,14-octadecatrienyl. In some further such embodiments, $R^4$ is, in at least one instance, 8-heptadecenyl, 10-heptadecenyl, 8,11-heptadecadienyl, or 8,11,14-heptadecatrienyl. In some further such embodiments, $R^4$ is, in at least one instance, 8-heptadecenyl, 8,11-heptadecadienyl, or 8,11,14-heptadecatrienyl. In some such embodiments, $R^4$ is, in at least one instance, 8-nonenyl, 8-decenyl, 8-undecenyl, 10-undecenyl, 8-dodecenyl, 8,11-dodecadienyl, 8,11-tridecadienyl, 12-tridecenyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^4$ is, in at least one instance, 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^4$ is, in at least one instance, 8-nonenyl, 8-undecenyl, 8,11-dodecadienyl, 8,11-tetradecadienyl, or 8,11,14-pentadecatrienyl. In some embodiments, $R^4$, in at least one instance, is an oligomeric glyceride moiety.

$R^5$ can have any suitable value. In some embodiments of any of the aforementioned embodiments, $R^5$ is $C_{1-24}$ alkyl, or $C_{11-24}$ alkyl, or $C_{13-24}$ alkyl, or $C_{15-24}$ alkyl. In some such embodiments, $R^5$ is undecyl, tridecyl, pentadecyl, or heptadecyl. In some further such embodiments, $R^5$ is pentadecyl or heptadecyl. In some embodiments of any of the aforementioned embodiments, $R^5$ is $C_{2-24}$ alkenyl or $C_{9-24}$ alkenyl. In some such embodiments, $R^5$ is 8-heptadecenyl, 10-heptadecenyl, 12-heneicosenyl, 8,11-heptadecadienyl, 8,11,14-heptadecatrienyl, 8-nonenyl, 8-decenyl, 8-undecenyl, 10-undecenyl, 8-dodecenyl, 12-tridecenyl, 12-tetradecenyl, 12-pentadecenyl, 12-hexadecenyl, 9-methyl-8-decenyl, 9-methyl-8-undecenyl, 10-methyl-8-undecenyl, 13-methyl-12-tetradecenyl, 13-methyl-12-pentadecenyl, 14-methyl-12-pentadecenyl, 8,11-dodecadienyl, 8,11-tridecadienyl, 8,11-tetradecadienyl, 8,11-pentadecadienyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 8,11,14-pentadecatrienyl, 8,11,14-hexadecatrienyl, 8,11,14-heptadecatrienyl, or 8,11,14-octadecatrienyl. In some further such embodiments, $R^5$ is 8-heptadecenyl, 10-heptadecenyl, 8,11-heptadecadienyl, or 8,11,14-heptadecatrienyl. In some further such embodiments, $R^5$ is 8-heptadecenyl, 8,11-heptadecadienyl, or 8,11,14-heptadecatrienyl. In some such embodiments, $R^5$ is 8-nonenyl, 8-decenyl, 8-undecenyl, 10-undecenyl, 8-dodecenyl, 8,11-dodecadienyl, 12-tridecenyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^5$ is 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, $R^5$ is 8-nonenyl, 8-undecenyl, 8,11-dodecadienyl, 8,11-tetradecadienyl, or 8,11,14-pentadecatrienyl. In some embodiments, $R^5$ is an oligomeric glyceride moiety.

The variable n can have any suitable value. In some embodiments of any of the aforementioned embodiments, n is an integer from 3 to 250, or from 5 to 180, or from 6 to 140, or from 8 to 70, or from 9 to 40, or from 9 to 26. In some other embodiments, n is an integer from 3 to 35, or from 5 to 30, or from 7 to 25, or from 10 to 20.

In some embodiments of any of the aforementioned embodiments, the glyceride polymers include only compounds wherein at least one of $R^1$, $R^2$, $R^3$, and $R^5$, or at least one instance of $R^4$, is selected from the group consisting of: 8-nonenyl; 8-decenyl; 8-undecenyl; 10-undecenyl, 12-tridecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-heptadecatrienyl; and 8,11,14-octadecatrienyl. In some other embodiments of any of the aforementioned embodiments, the glyceride polymers include only compounds wherein at least one of $R^1$, $R^2$, $R^3$, and $R^5$, or at least one instance of $R^4$, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-heptadecatrienyl; and 8,11,14-octadecatrienyl. In some other embodiments of any of the aforementioned embodiments, the glyceride polymers include only compounds wherein at least one of $R^1$, $R^2$, $R^3$, and $R^5$, or at least one instance of $R^4$, is selected from the group consisting of: 8-nonenyl; 8-undecenyl; 8,11-dodecadienyl; 8,11-tetradecadienyl; or 8,11,14-pentadecatrienyl. In some embodiments of any of the aforementioned embodiments, the glyceride polymers include only compounds wherein at least one of $R^1$, $R^2$, $R^3$, and $R^5$, or at least one instance of $R^4$, is selected from the group consisting of: 8-nonenyl; 8-decenyl; 8-undecenyl; 10-undecenyl; 12-tridecenyl; 8-dodecenyl; 8,11-dodecadienyl; 8,11-tridecadienyl; 8,11-tetradecadienyl; 8,11-pentadecadienyl; 8,11,14-pentadecatrienyl; and 8,11,14-hexadecatrienyl. In some other embodiments of any of the aforementioned embodiments, the glyceride polymers include only compounds wherein at least one of $R^1$, $R^2$, $R^3$, and $R^5$, or at least one instance of $R^4$, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl. In some other embodiments of any of the aforementioned embodiments, the glyceride polymers include only compounds wherein at least one of $R^1$, $R^2$, $R^3$, and $R^5$, or at least one instance of $R^4$, is $C_{2-15}$ alkenyl, or $C_{2-14}$ alkenyl, or $C_{5-14}$ alkenyl, or $C_{2-13}$ alkenyl, or $C_{2-12}$ alkenyl, or $C_{5-12}$ alkenyl.

In a another aspect, glyceride copolymers, which comprises constitutional units formed from reacting two or more monomers in the presence of a metathesis catalyst, the two or more monomers comprise monomer compounds of formula (IIa):

(IIa)

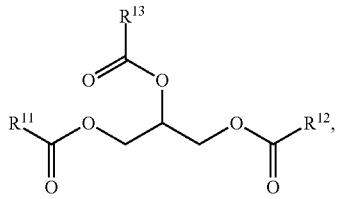

and monomer compounds of formula (IIb):

(IIb)

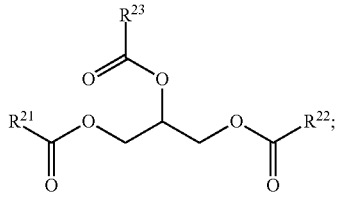

wherein, each $R^{11}$, $R^{12}$, and $R^{13}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties with the proviso that at least one of $R^{11}$, $R^{12}$, and $R^{13}$ is a $C_{2-24}$ alkenyl or a substituted $C_{2-24}$ alkenyl wherein the substituent is one or more —OH moieties; each $R^{21}$, $R^{22}$, and $R^{23}$ is independently a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more —OH moieties, with the proviso that at least one of $R^{21}$, $R^{22}$, and $R^{23}$ is 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl.

The variables $R^{11}$, $R^{12}$, and $R^{13}$ can have any suitable value. In some embodiments, $R^{11}$, $R^{12}$, and $R^{13}$ are independently $C_{1-24}$ alkyl, or $C_{11-24}$ alkyl, or $C_{13-24}$ alkyl, or $C_{15-24}$ alkyl. In some such embodiments, $R^{11}$, $R^{12}$, and $R^{13}$ are independently undecyl, tridecyl, pentadecyl, or heptadecyl. In some further such embodiments, $R^{11}$, $R^{12}$, and $R^{13}$ are independently pentadecyl or heptadecyl. In some embodiments of any of the aforementioned embodiments, $R^{11}$, $R^{12}$, and $R^{13}$ are independently $C_{2-24}$ alkenyl, or $C_{9-24}$ alkenyl, or $C_{11-24}$ alkenyl, or $C_{13-24}$ alkenyl, or $C_{15-24}$ alkenyl. In some such embodiments, $R^{11}$, $R^{12}$, and $R^{13}$ are independently 8-heptadecenyl, 10-heptadecenyl, 8,11-heptadecadienyl or 8,11,14-heptadecatrienyl. In some further such embodiments, $R^{11}$, $R^{12}$, and $R^{13}$ are independently 8-heptadecenyl, 8,11-heptadecadienyl, or 8,11,14-heptadecatrienyl.

The variables $R^{21}$, $R^{22}$, and $R^{23}$ can have any suitable value. In some embodiments of any of the foregoing embodiments, zero, one, or two of $R^{21}$, $R^{22}$, and $R^{23}$ are independently $C_{1-24}$ alkyl, or $C_{11-24}$ alkyl, or $C_{13-24}$ alkyl, or $C_{15-24}$ alkyl. In some such embodiments, zero, one, or two of $R^{21}$, $R^{22}$, and $R^{23}$ are independently undecyl, tridecyl, pentadecyl, or heptadecyl. In some further such embodiments, zero, one, or two of $R^{21}$, $R^{22}$, and $R^{23}$ are independently pentadecyl or heptadecyl. In some embodiments of any of the aforementioned embodiments, zero, one, or two of $R^{21}$, $R^{22}$, and $R^{23}$ are independently $C_{2-24}$ alkenyl, or $C_{9-24}$ alkenyl, or $C_{11-24}$ alkenyl, or $C_{13-24}$ alkenyl, or $C_{15-24}$ alkenyl. In some such embodiments, zero, one, or two of $R^{21}$, $R^{22}$, and $R^{23}$ are independently 8-heptadecenyl, 10-heptadecenyl, 8,11-heptadecadienyl or 8,11,14-heptadecatrienyl. In some further such embodiments, zero, one, or two of $R^{21}$, $R^{22}$, and $R^{23}$ are independently 8-heptadecenyl, 8,11-heptadecadienyl, or 8,11,14-heptadecatrienyl.

In some other embodiments of any of the foregoing embodiments, one, two, or three of $R^{21}$, $R^{22}$, and $R^{23}$ are independently $C_{2-15}$ alkenyl, or $C_{2-14}$ alkenyl, $C_{5-14}$ alkenyl, or $C_{2-13}$ alkenyl, or $C_{2-12}$ alkenyl, or $C_{5-12}$ alkenyl. In some such embodiments, one, two, or three of $R^{21}$, $R^{22}$, and $R^{23}$ are independently 8-nonenyl, 8-decenyl, 8-undecenyl, 8-dodecenyl, 8,11-dodecadienyl, 8,11-tridecadienyl 8,11-tetradecadienyl, 8,11-pentadecadienyl 8,11,14-pentadecatrienyl, 8,11,14-hexadecatrienyl, 8,11,14-octadecatrienyl, 9-methyl-8-decenyl, 9-methyl-8-undecenyl, 10-methyl-8-undecenyl, 12-methyl-8,11-tridecadienyl, 12-methyl-8,11-tetradecadienyl, 13-methyl-8,11-tetradecadienyl, 15-methyl-8,11,14-hexadecatrienyl, 15-methyl-8,11,14-heptadecatrienyl, 16-methyl-8,11,14-heptadecatrienyl, 12-tridecenyl, 12-tetradecenyl, 12-pentadecenyl, 12-hexadecenyl, 13-methyl-12-tetradecenyl, 13-methyl-12-pentadecenyl, and 14-methyl-12-pentadecenyl, 10-undecenyl, 8,11,14-heptadecatrienyl, or 8,11,14-octadecatrienyl. In some further such embodiments, one, two, or three of $R^{21}$, $R^{22}$, and $R^{23}$ are independently 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, one, two, or three of $R^{21}$, $R^{22}$, and $R^{23}$ are independently 8-nonenyl, 8-undecenyl, 8,11-dodecadienyl, 8,11-tetradecadienyl, or 8,11,14-pentadecatrienyl.

The glyceride copolymers disclosed herein can have any suitable molecular weight. In some embodiments of any of the aforementioned embodiments, the glyceride copolymer has a weight average molecular weight ranging from 4,000 g/mol to 150,000 g/mol, or from 5,000 g/mol to 130,000 g/mol, or from 6,000 g/mol to 100,000 g/mol, or from 7,000 g/mol to 50,000 g/mol, or from 8,000 g/mol to 30,000 g/mol, or from 8,000 g/mol to 20,000 g/mol.

In some embodiments, the glyceride copolymer has a number-average molecular weight ($M_n$) from 2,000 g/mol to 150,000 g/mol, or from 3,000 g/mol to 30,000 g/mol, or from 4,000 g/mol to 20,000 g/mol.

The glyceride copolymers disclosed herein can have any suitable ratio of constitutional units formed from monomer compounds of formula (IIa) to constitutional units formed from monomer compounds of formula (IIb). In some embodiments of any of the aforementioned embodiments, the number ratio of constitutional units formed from monomer compounds of formula (IIa) to constitutional units formed from monomer compounds of formula (IIb) is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. The glyceride copolymers disclosed herein can include additional constitutional units not formed from monomer compounds of either formula (IIa) or formula (IIb), including, but not limited to, constitutional units formed from other unsaturated polyol esters, such as unsaturated diols, triols, and the like.

Or, in some other embodiments of any of the foregoing embodiments, the two or more monomers are reacted in the presence of the metathesis catalyst as part of a reaction mixture, wherein the weight-to-weight ratio of the monomer compounds of formula (IIa) to the monomer compounds of formula (IIb) in the reaction mixture is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. In some embodiments, the reaction mixture includes additional monomer compounds besides monomer compounds of formula (IIa) and formula (IIb).

Any suitable metathesis catalyst can be used, as described in more detail below. In some embodiments of any of the aforementioned embodiments, the metathesis catalyst is an organoruthenium compound, an organoosmium compound, an organotungsten compound, or an organomolybdenum compound.

In another aspect, the disclosure provides glyceride copolymers, which comprises constitutional units formed from reacting two or more monomers in the presence of a first metathesis catalyst; wherein the first monomer is an unsaturated natural oil glyceride, and the second monomer is an unsaturated alkenylized natural oil glyceride. In another aspect, the disclosure provides glyceride copolymers, which comprises constitutional units formed from reacting two or more monomers in the presence of a first metathesis catalyst; wherein the first monomer is an unsaturated synthetic polyol ester, and the second monomer is an unsaturated alkenylized natural oil glyceride. In another aspect, the disclosure provides glyceride copolymers, which comprises constitutional units formed from reacting two or more monomers in the presence of a first metathesis catalyst; wherein the first monomer is an unsaturated natural oil glyceride, and the second monomer is an unsaturated alkenylized synthetic polyol ester. In another aspect, the disclosure provides glyceride copolymers, which comprises constitutional units formed from reacting two or more monomers in the presence of a first metathesis catalyst; wherein the first monomer is an unsaturated synthetic polyol ester, and the second monomer is an unsaturated alkenylized synthetic polyol ester. In another aspect, the disclosure provides glyceride copolymers, which comprises constitutional units formed from reacting two or more monomers in the presence of a first metathesis catalyst; wherein the first monomer is a first unsaturated alkenylized synthetic polyol ester, and the second monomer is a second unsaturated alkenylized synthetic polyol ester. In another aspect, the disclosure provides glyceride copolymers, which comprises constitutional units formed from reacting two or more monomers in the presence of a first metathesis; wherein the first monomer is a first unsaturated alkenylized natural oil glyceride, and the second monomer is a second unsaturated alkenylized natural oil glyceride. In another aspect, the disclosure provides glyceride copolymers, which comprises constitutional units formed from reacting two or more monomers in the presence of a first metathesis; wherein the first monomer is an unsaturated alkenylized natural oil glyceride, and the second monomer is an unsaturated alkenylized synthetic polyol ester.

In some embodiments, the unsaturated alkenylized natural oil glyceride is formed from the reaction of a second unsaturated natural oil glyceride with a short-chain alkene in the presence of a second metathesis catalyst. In some such embodiments, the unsaturated alkenylized natural oil glyceride has a lower molecular weight than the second unsaturated natural oil glyceride. Any suitable short-chain alkene can be used, according to the embodiments described above. In some embodiments, the short-chain alkene is a $C_{2-8}$ olefin, or a $C_{2-6}$ olefin. In some such embodiments, the short-chain alkene is ethylene, propylene, 1-butene, 2-butene, isobutene, 1-pentene, 2-pentene, 1-hexene, 2-hexene, or 3-hexene. In some further such embodiments, the short-chain alkene is ethylene, propylene, 1-butene, 2-butene, or isobutene. In some embodiments, the short-chain alkene is ethylene. In some embodiments, the short-chain alkene is propylene. In some embodiments, the short-chain alkene is 1-butene. In some embodiments, the short-chain alkene is 2-butene. In some other embodiments, the short-chain alkene is a branched short-chain alkene. Non-limiting examples of such branched short-chain alkenes include, but are not limited to, isobutylene, 3-methyl-1-butene, 3-methyl-1-pentene, and 4-methyl-1-pentene.

The unsaturated natural oil glyceride can be obtained from any suitable natural oil source. In some embodiments of any of the aforementioned embodiments, the unsaturated natural oil glycerides are obtained from synthesized oils, natural oils (e.g., vegetable oils, algae oils, bacterial and/or fungal derived oils, and animal fats), combinations of these, and the like. In some embodiments, the natural oil is obtained from a vegetable oil, such as a seed oil. Recycled used vegetable oils may also be used. In some further embodiments, the vegetable oil is Abyssinian oil, Almond Oil, Apricot Oil, Apricot Kernel oil, Argan oil, Avocado Oil, Babassu Oil, Baobab Oil, Black Cumin Oil, Black Currant Oil, Borage Oil, Camelina oil, Carinata oil, Canola (low erucic acid rapeseed) oil, Castor oil, Cherry Kernel Oil, Coconut oil, Corn oil, Cottonseed oil, Echium Oil, Evening Primrose Oil, Flax Seed Oil, Grape Seed Oil, Grapefruit Seed Oil, Hazelnut Oil, Hemp Seed Oil, Jatropha oil, Jojoba Oil, Kukui Nut Oil, Linseed Oil, Macadamia Nut Oil, Meadowfoam Seed Oil, Moringa Oil, Mustard Seed Oil, Neem Oil, Olive Oil, Palm Oil, Palm Kernel Oil, Peach Kernel Oil, Peanut Oil, Pecan Oil, Pennycress oil, Perilla Seed Oil, Pistachio Oil, Pomegranate Seed Oil, Pongamia oil, Pumpkin Seed Oil, Raspberry Oil, Red Palm Olein, Rice Bran Oil, Rosehip Oil, Safflower Oil, Seabuckthorn Fruit Oil, Sesame Seed Oil, Shea Olein, Sunflower Oil, Soybean Oil, Tonka Bean Oil, Tung Oil, Walnut Oil, Wheat Germ Oil, High Oleoyl Soybean Oil, High Oleoyl Sunflower Oil, High Oleoyl Safflower Oil, High Erucic Acid Rapeseed Oil, and mixtures thereof. In some embodiments, the vegetable oil is palm oil. In some embodiments, the vegetable oil is soybean oil. In some embodiments, the vegetable oil is canola oil. In some embodiments, a representative, non-limiting example of animal fat is lard, tallow, chicken fat, yellow grease, fish oil, emu oil, combinations of these, and the like. In some embodiments, a representative non-limiting example of a synthesized oil includes tall oil, which is a byproduct of wood pulp manufacture. In some embodiments, the natural oil is refined, bleached, and/or deodorized.

Natural oils of the type described herein typically are composed of triglycerides of fatty acids. These fatty acids may be either saturated, monounsaturated or polyunsaturated and contain varying chain lengths ranging from $C_8$ to $C_{30}$. The most common fatty acids include saturated fatty acids such as lauric acid (dodecanoic acid), myristic acid (tetradecanoic acid), palmitic acid (hexadecanoic acid), stearic acid (octadecanoic acid), arachidic acid (eicosanoic acid), and lignoceric acid (tetracosanoic acid); unsaturated acids include such fatty acids as palmitoleic (a $C_{16}$ acid), and oleic acid (a $C_{18}$ acid); polyunsaturated acids include such fatty acids as linoleic acid (a di-unsaturated $C_{18}$ acid), linolenic acid (a tri-unsaturated $C_{18}$ acid), and arachidonic acid (a tetra-unsubstituted $C_{20}$ acid). The natural oils are further comprised of esters of these fatty acids in random placement onto the three sites of the trifunctional glycerine molecule. Different natural oils will have different ratios of these fatty acids, and within a given natural oil there is a range of these acids as well depending on such factors as where a vegetable or crop is grown, maturity of the vegetable or crop, the weather during the growing season, etc. Thus, it is difficult to have a specific or unique structure for any given natural oil, but rather a structure is typically based on some statistical average. For example soybean oil contains a mixture of predominantly C16 and C18 acid groups where stearic acid, oleic acid, linoleic acid, and linolenic acid are in the ratio of about 15:24:50:11, and an average number of double bonds of 4.4-4.7 per triglyceride. One method of quantifying the number of double bonds is the iodine value (IV) which is defined as the number of grams of iodine that will react with 100 grams of oil. Therefore for soybean oil, the average iodine value range is from 120-140. Soybean oil may comprise about 95% by weight or greater (e.g., 99% weight or greater) triglycerides of fatty acids. Major fatty acids in the polyol esters of soybean oil include saturated fatty acids, as a non-limiting example, palmitic acid (hexadecanoic acid) and stearic acid (octadecanoic acid), and unsaturated fatty acids, as a non-limiting example, oleic acid (9-octadecenoic acid), linoleic acid (9,12octadecadienoic acid), and linolenic acid (9,12,15-octadecatrienoic acid).

In an exemplary embodiment, the vegetable oil is canola oil, for example, refined, bleached, and deodorized canola oil (i.e., RBD canola oil). Canola oil is an unsaturated polyol ester of glycerol that typically comprises about 95% weight or greater (e.g., 99% weight or greater) triglycerides of fatty acids. Major fatty acids in the polyol esters of canola oil include saturated fatty acids, for example, palmitic acid (hexadecanoic acid) and stearic acid (octadecanoic acid), and unsaturated fatty acids, for example, oleic acid (9-octadecenoic acid), linoleic acid (9,12-octadecadienoic acid), and linolenic acid (9,12,15-octadecatrienoic acid). Canola oil is a highly unsaturated vegetable oil with many of the triglyceride molecules having at least two unsaturated fatty acids (i.e., a polyunsaturated triglyceride).

In some embodiments, the unsaturated alkenylized synthetic polyol ester is formed from the reaction of an unsaturated synthetic polyol ester with a short-chain alkene in the presence of a second metathesis catalyst. In some such embodiments, the unsaturated alkenylized synthetic polyol ester has a lower molecular weight than the second unsaturated synthetic polyol ester. Any suitable short-chain alkene can be used, according to the embodiments described above. In some embodiments, the short-chain alkene is a $C_{2-8}$ olefin, or a $C_{2-6}$ olefin. In some such embodiments, the short-chain alkene is ethylene, propylene, 1-butene, 2-butene, isobutene, 1-pentene, 2-pentene, 1-hexene, 2-hexene, or 3-hexene. In some further such embodiments, the short-chain alkene is ethylene, propylene, 1-butene, 2-butene, or isobutene. In some embodiments, the short-chain alkene is ethylene. In some embodiments, the short-chain alkene is propylene. In some embodiments, the short-chain alkene is 1-butene. In some embodiments, the short-chain alkene is 2-butene. In some other embodiments, the short-chain alkene is a branched short-chain alkene. Non-limiting examples of such branched short-chain alkenes include, but are not limited to, isobutylene, 3-methyl-1-butene, 3-methyl-1-pentene, and 4-methyl-1-pentene.

The unsaturated synthetic polyol ester includes esters such as those derived from ethylene glycol or propylene glycol, polyethylene glycol, polypropylene glycol, or poly (tetramethylene ether) glycol, esters such as those derived from pentaerythritol, dipentaerythritol, tripentaerythritol, trimethylolpropane, or neopentyl glycol, or sugar esters such as SEFOSE®. Sugar esters such as SEFOSE® include one or more types of sucrose polyesters, with up to eight ester groups that could undergo a metathesis exchange reaction. Sucrose polyesters are derived from a natural resource and therefore, the use of sucrose polyesters can result in a positive environmental impact. Sucrose polyesters are polyester materials, having multiple substitution positions around the sucrose backbone coupled with the chain length, saturation, and derivation variables of the fatty chains. Such sucrose polyesters can have an esterification ("IBAR") of greater than about 5. In one embodiment the sucrose polyester may have an IBAR of from about 5 to about 8. In another embodiment the sucrose polyester has an IBAR of about 5-7, and in another embodiment the sucrose polyester has an IBAR of about 6. In yet another embodiment the sucrose polyester has an IBAR of about 8. As sucrose polyesters are derived from a natural resource, a distribution in the IBAR and chain length may exist. For example a sucrose polyester having an IBAR of 6, may contain a mixture of mostly IBAR of about 6, with some IBAR of about 5 and some IBAR of about 7. Additionally, such sucrose polyesters may have an unsaturation or iodine value ("IV") of about 3 to about 140. In another embodiment the sucrose polyester may have an IV of about 10 to about 120. In yet another embodiment the sucrose polyester may have an IV of about 20 to 100. Further, such sucrose polyesters have a chain length of about $C_{12-20}$ but are not limited to these chain lengths.

Non-limiting examples of sucrose polyesters suitable for use include SEFOSE® 16185, SEFOSE® 1618U, SEFOSE® 1618H, Sefa Soyate IMF 40, Sefa Soyate LP426, SEFOSE® 2275, SEFOSE® C1695, SEFOSE® C18:0 95, SEFOSE® C1495, SEFOSE® 1618H B6, SEFOSE® 1618S B6, SEFOSE® 1618U B6, Sefa Cottonate, SEFOSE® C1295, Sefa C895, Sefa C1095, SEFOSE® 1618S B4.5, all available from The Procter and Gamble Co. of Cincinnati, Ohio.

Other examples of suitable unsaturated polyol esters may include but not be limited to sorbitol esters, maltitol esters, sorbitan esters, maltodextrin derived esters, xylitol esters, polyglycerol esters, and other sugar derived esters.

The glyceride copolymers disclosed herein can have any suitable molecular weight. In some embodiments of any of the aforementioned embodiments, the glyceride copolymer has a weight average molecular weight ranging from 4,000 g/mol to 150,000 g/mol, or from 5,000 g/mol to 130,000 g/mol, or from 6,000 g/mol to 100,000 g/mol, or from 7,000 g/mol to 50,000 g/mol, or from 8,000 g/mol to 30,000 g/mol, or from 8,000 g/mol to 20,000 g/mol.

In some embodiments, the glyceride copolymer has a number-average molecular weight ($M_n$) from 2,000 g/mol to 150,000 g/mol, or from 3,000 g/mol to 30,000 g/mol, or from 4,000 g/mol to 20,000 g/mol.

The glyceride copolymers disclosed herein can have any suitable ratio of constitutional units formed from the first monomer to constitutional units formed from the second monomer. In some embodiments of any of the aforementioned embodiments, the number ratio of constitutional units formed from the first monomer to constitutional units formed from the second monomer is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. The glyceride copolymers disclosed herein can include additional constitutional units not formed from the first monomer or the second monomer, including, but not limited to, constitutional units formed from other unsaturated polyol esters, such as unsaturated diols, triols, and the like.

Or, in some other embodiments of any of the foregoing embodiments, the two or more monomers are reacted in the presence of the metathesis catalyst as part of a reaction mixture, wherein the weight-to-weight ratio of the first monomer to the second monomer in the reaction mixture is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. In some embodiments, the reaction mixture includes additional monomer compounds besides the first monomer and the second monomer.

Any suitable metathesis catalyst can be used as either the first metathesis catalyst or the second metathesis catalyst, as described in more detail below. In some embodiments of any of the aforementioned embodiments, the first and second metathesis catalysts are an organoruthenium compound, an organoosmium compound, an organo-tungsten compound, or an organomolybdenum compound.

Additional glyceride copolymers are contemplated as products of the synthetic methods and examples disclosed herein.

Synthetic Methods

In a fifth aspect, the disclosure provides methods of forming a glyceride copolymer composition, the methods comprising: (a) providing a reaction mixture comprising a metathesis catalyst and monomer compounds of formula (IIIa):

(IIIa)

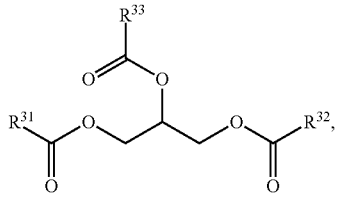

and monomer compounds of formula (IIIb):

(IIIb)

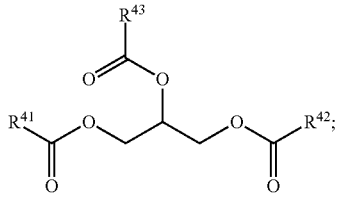

wherein, $R^{31}$, $R^{32}$, and $R^{33}$ are independently $C_{1-24}$ alkyl or $C_{2-24}$ alkenyl, each of which is optionally substituted one or more times by —OH, provided that at least one of $R^{31}$, $R^{32}$, and $R^{33}$ is $C_{2-24}$ alkenyl, which is optionally substituted one or more times by —OH; and $R^{41}$, $R^{42}$, and $R^{43}$ are independently $C_{1-24}$ alkyl or $C_{2-24}$ alkenyl, each of which is optionally substituted one or more times by —OH, provided that at least one of $R^{41}$, $R^{42}$, and $R^{43}$ is 8-nonenyl, 8-decenyl, 8-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl; and (b) reacting the monomer compounds of formula (IIIa) with the monomer compounds of formula (IIIb) in the presence of the metathesis catalyst to form the glyceride polymer composition.

The variables $R^{31}$, $R^{32}$, and $R^{33}$ can have any suitable value. In some embodiments, $R^{31}$, $R^{32}$, and $R^{33}$ are independently $C_{1-24}$ alkyl, or $C_{11-24}$ alkyl, or $C_{13-24}$ alkyl, or $C_{15-24}$ alkyl. In some such embodiments, $R^{31}$, $R^{32}$, and $R^{33}$ are independently undecyl, tridecyl, pentadecyl, or heptadecyl. In some further such embodiments, $R^{31}$, $R^{32}$, and $R^{33}$ are independently pentadecyl or heptadecyl. In some embodiments of any of the aforementioned embodiments, $R^{31}$, $R^{32}$, and $R^{33}$ are independently $C_{2-24}$ alkenyl, or $C_{9-24}$ alkenyl, or $C_{11-24}$ alkenyl, or $C_{13-24}$ alkenyl, or $C_{15-24}$ alkenyl. In some such embodiments, $R^{31}$, $R^{32}$, and $R^{33}$ are independently 8-heptadecenyl, 10-heptadecenyl, 8,11-heptadecadienyl or 8,11,14-heptadecatrienyl. In some further such embodiments, $R^{31}$, $R^{32}$, and $R^{33}$ are independently 8-heptadecenyl, 8,11-heptadecadienyl, or 8,11,14-heptadecatrienyl.

The variables $R^{41}$, $R^{42}$, and $R^{43}$ can have any suitable value. In some embodiments of any of the foregoing embodiments, zero, one, or two of $R^{41}$, $R^{42}$, and $R^{43}$ are independently $C_{1-24}$, alkyl, or $C_{11-24}$ alkyl, or $C_{13-24}$ alkyl, or $C_{15-24}$ alkyl. In some such embodiments, zero, one, or two of $R^{41}$, $R^{42}$, and $R^{43}$ are independently undecyl, tridecyl, pentadecyl, or heptadecyl. In some further such embodiments, zero, one, or two of $R^{41}$, $R^{42}$, and $R^{43}$ are independently pentadecyl or heptadecyl. In some embodiments of any of the aforementioned embodiments, zero, one, or two of $R^{41}$, $R^{42}$, and $R^{43}$ are independently $C_{2-24}$ alkenyl, or $C_{9-24}$ alkenyl, or $C_{11-24}$ alkenyl, or $C_{13-24}$ alkenyl, or $C_{15-24}$ alkenyl. In some such embodiments, zero, one, or two of $R^{41}$, $R^{42}$, and $R^{43}$ are independently 8-heptadecenyl, 10-heptadecenyl, 8,11-heptadecadienyl or 8,11,14-heptadecatrienyl. In some further such embodiments, zero, one, or two of $R^{41}$, $R^{42}$, and $R^{43}$ are independently 8-heptadecenyl, 8,11-heptadecadienyl, or 8,11,14-heptadecatrienyl.

In some other embodiments of any of the foregoing embodiments, one, two, or three of $R^{41}$, $R^{42}$, and $R^{43}$ are independently $C_{2-15}$ alkenyl, or $C_{2-14}$ alkenyl, or $C_{2-13}$ alkenyl, or $C_{2-12}$ alkenyl, or $C_{5-12}$ alkenyl. In some such embodiments, one, two, or three of $R^{41}$, $R^{42}$, and $R^{43}$ are independently 8-nonenyl, 8-decenyl, 8-undecenyl, 10-undecenyl, 8-dodecenyl, 8,11-dodecadienyl, 8,11-tridecadienyl, 8,11-tetradecadienyl, 8,11-pentadecadienyl, 8,11,14-pentadecatrienyl, 8,11,14-hexadecatrienyl, 8,11,14-heptadecatrienyl, or 8,11,14-octadecatrienyl. In some further such embodiments, one, two, or three of $R^{41}$, $R^{42}$, and $R^{43}$ are independently 8-nonenyl, 8-decenyl, 8-undecenyl, 8-dodecenyl, 8,11-dodecadienyl, 8,11-tridecadienyl, 8,11-tetradecadienyl, 8,11-pentadecadienyl 8,11,14-pentadecatrienyl, 8,11,14-hexadecatrienyl, 8,11,14-heptadecatrienyl, or 8,11,14-octadecatrienyl. In some further such embodiments, one, two, or three of $R^{41}$, $R^{42}$, and $R^{43}$ are independently 8-nonenyl, 8-undecenyl, 8,11-dodecadienyl, 8,11-tetradecadienyl, or 8,11,14-pentadecatrienyl.

The glyceride copolymers formed by the methods disclosed herein can have any suitable molecular weight. In some embodiments of any of the aforementioned embodiments, the glyceride copolymer has a weight average molecular weight ranging from 4,000 g/mol to 150,000 g/mol, or from 5,000 g/mol to 130,000 g/mol, or from 6,000 g/mol to 100,000 g/mol, or from 7,000 g/mol to 50,000 g/mol, or from 8,000 g/mol to 30,000 g/mol, or from 8,000 g/mol to 20,000 g/mol.

The glyceride copolymers formed by the methods disclosed herein can have any suitable ratio of constitutional units formed from monomer compounds of formula (IIa) to constitutional units formed from monomer compounds of formula (IIIb). In some embodiments of any of the aforementioned embodiments, the number ratio of constitutional units formed from monomer compounds of formula (IIa) to constitutional units formed from monomer compounds of formula (IIb) is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. The glyceride copolymers disclosed herein can include additional constitutional units not formed from monomer compounds of either formula (IIa) or formula (IIIb).

Or, in some other embodiments of any of the foregoing embodiments, the two or more monomers are reacted in the presence of the metathesis catalyst as part of a reaction mixture, wherein the weight-to-weight ratio of the monomer compounds of formula (IIIa) to the monomer compounds of formula (IIIb) in the reaction mixture is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. In some embodiments, the reaction mixture includes additional monomer compounds besides monomer compounds of formula (IIIa) and formula (IIIb).

Any suitable metathesis catalyst can be used, as described in more detail below. In some embodiments of any of the aforementioned embodiments, the metathesis catalyst is an organoruthenium compound, an organoosmium compound, an organotungsten compound, or an organomolybdenum compound.

The methods disclosed herein can include additional chemical and physical treatment of the resulting glyceride copolymers. For example, in some embodiments, the resulting glyceride copolymers are subjected to full or partial hydrogenation, such as diene-selective hydrogenation. Also, in some embodiments, the unspent metathesis catalyst and/or the spent metathesis catalyst residues are recovered. In some embodiments of any of the foregoing embodiments, the resulting glyceride polymers are subjected to methods that induce isomerization, such as olefin isomerization.

In another aspect, the disclosure provides methods of forming a glyceride copolymer, the methods comprising: (a) providing a reaction mixture comprising a first metathesis catalyst, unsaturated natural oil glycerides, and unsaturated alkenylized natural oil glycerides; and (b) reacting the unsaturated natural oil glycerides and unsaturated alkenylized natural oil glycerides in the presence of the first metathesis catalyst to form the glyceride copolymer.

In some embodiments, the unsaturated alkenylized natural oil glyceride is formed from the reaction of a second unsaturated natural oil glyceride with a short-chain alkene in the presence of a second metathesis catalyst. In some such embodiments, the unsaturated alkenylized natural oil glyceride has a lower molecular weight than the second unsaturated natural oil glyceride. Any suitable short-chain alkene can be used, according to the embodiments described above. In some embodiments, the short-chain alkene is a $C_{2-14}$ olefin, $C_{2-12}$ olefin, $C_{2-10}$ olefin, $C_{2-8}$ olefin, $C_{2-6}$ olefin, or a $C_{2-4}$ olefin. In some such embodiments, the short-chain alkene may comprise at least one of the following: ethylene, propylene, 1-butene, 2-butene, isobutene, 1-pentene, 2-pentene, 1-hexene, 2-hexene, 3-hexene, cyclohexene, 2-methyl-1-butene, 2-methyl-2-butene, 3-methyl-1-butene, cyclopentene, 2-methyl-1-pentene, 3-methyl-1-pentene, 4-methyl-1-pentene, 2-methyl-2-pentene, 3-methyl-2-pentene, 4-methyl-2-pentene, or 4,4-dimethyl-2-pentene. In some further such embodiments, the short-chain alkene is ethylene, propylene, 1-butene, 2-butene, or isobutene. In some embodiments, the short-chain alkene is ethylene. In some embodiments, the short-chain alkene is propylene. In some embodiments, the short-chain alkene is 1-butene. In some embodiments, the short-chain alkene is 2-butene.

As noted, it is possible to use a mixture of various linear or branched low-molecular-weight olefins in the reaction to achieve the desired metathesis product distribution. In one embodiment, a mixture of butenes (1-butene, 2-butenes, and, optionally, isobutene) may be employed as the low molecular-weight olefin, offering a low cost, commercially available feedstock instead a purified source of one particular butene. Such low cost mixed butene feedstocks are typically diluted with n-butane and/or isobutane.

The first unsaturated natural oil glyceride and the second unsaturated natural oil glyceride can be obtained from any suitable natural oil source. In some embodiments of any of the aforementioned embodiments, the first or second unsaturated natural oil glycerides are obtained from a vegetable oil, such as a seed oil. In some further embodiments, the vegetable oil is rapeseed oil, canola oil (low erucic acid rapeseed oil), coconut oil, corn oil, cottonseed oil, olive oil, palm oil, peanut oil, safflower oil, sesame oil, soybean oil, sunflower oil, linseed oil, palm kernel oil, tung oil, jatropha oil, mustard seed oil, pennycress oil, camelina oil, hempseed oil, or castor oil. In some embodiments, the vegetable oil is palm oil. In some embodiments, the vegetable oil is soybean oil. In some embodiments, the vegetable oil is canola oil.

The glyceride copolymers formed by the methods disclosed herein can have any suitable molecular weight. In some embodiments of any of the aforementioned embodiments, the glyceride copolymer has a weight average molecular weight ranging from 4,000 g/mol to 150,000 g/mol, or from 5,000 g/mol to 130,000 g/mol, or from 6,000 g/mol to 100,000 g/mol, or from 7,000 g/mol to 50,000 g/mol, or from 8,000 g/mol to 30,000 g/mol, or from 8,000 g/mol to 20,000 g/mol.

In some embodiments, the glyceride copolymer has a number-average molecular weight ($M_n$) from 2,000 g/mol to 150,000 g/mol, or from 3,000 g/mol to 30,000 g/mol, or from 4,000 g/mol to 20,000 g/mol.

The glyceride copolymers formed by the methods disclosed herein can have any suitable ratio of constitutional units formed from the first monomer to constitutional units formed from the second monomer. In some embodiments of any of the aforementioned embodiments, the number ratio of constitutional units formed from the first monomer to constitutional units formed from the second monomer is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. The glyceride copolymers disclosed herein can include additional constitutional units not formed from the first monomer or the second monomer.

Or, in some other embodiments of any of the foregoing embodiments, the two or more monomers are reacted in the presence of the metathesis catalyst as part of a reaction mixture, wherein the weight-to-weight ratio of the first monomer to the second monomer in the reaction mixture is no more than 10:1, or no more than 9:1, or no more than 8:1, or no more than 7:1, or no more than 6:1, or no more than 5:1, or no more than 4:1, or no more than 3:1, or no more than 2:1, or no more than 1:1. In some embodiments, the reaction mixture includes additional monomer compounds besides the first monomer and the second monomer.

Any suitable metathesis catalyst can be used as either the first metathesis catalyst or the second metathesis catalyst, as described in more detail below. In some embodiments of any of the aforementioned embodiments, the first and second metathesis catalysts are an organoruthenium compound, an organoosmium compound, an organo-tungsten compound, or an organomolybdenum compound.

The methods disclosed herein can include additional chemical and physical treatment of the resulting glyceride copolymers. For example, in some embodiments, the resulting glyceride copolymers are subjected to full or partial hydrogenation, such as diene-selective hydrogenation.

Derivation from Renewable Sources

The compounds employed in any of the aspects or embodiments disclosed herein can, in certain embodiments, be derived from renewable sources, such as from various natural oils or their derivatives. Any suitable methods can be used to make these compounds from such renewable sources.

Olefin metathesis provides one possible means to convert certain natural oil feedstocks into olefins and esters that can be used in a variety of applications, or that can be further modified chemically and used in a variety of applications. In some embodiments, a composition (or components of a composition) may be formed from a renewable feedstock, such as a renewable feedstock formed through metathesis reactions of natural oils and/or their fatty acid or fatty ester derivatives. When compounds containing a carbon-carbon double bond undergo metathesis reactions in the presence of a metathesis catalyst, some or all of the original carbon-carbon double bonds are broken, and new carbon-carbon double bonds are formed. The products of such metathesis reactions include carbon-carbon double bonds in different locations, which can provide unsaturated organic compounds having useful chemical properties.

A wide range of natural oils, or derivatives thereof, can be used in such metathesis reactions. Examples of suitable natural oils include, but are not limited to, vegetable oils, algae oils, fish oils, animal fats, tall oils, derivatives of these oils, combinations of any of these oils, and the like. Representative non-limiting examples of vegetable oils include low erucic acid rapeseed oil (canola oil), high erucic acid rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard seed oil, pennycress oil, camelina oil, hempseed oil, and castor oil. Representative non-limiting examples of animal fats include lard, tallow, poultry fat, yellow grease, and fish oil. Tall oils are by-products of wood pulp manufacture. In some embodiments, the natural oil or natural oil feedstock comprises one or more unsaturated glycerides (e.g., unsaturated triglycerides). In some such embodiments, the natural oil feedstock comprises at least 50% by weight, or at least 60% by weight, or at least 70% by weight, or at least 80% by weight, or at least 90% by weight, or at least 95% by weight, or at least 97% by weight, or at least 99% by weight of one or more unsaturated triglycerides, based on the total weight of the natural oil feedstock.

The natural oil may include canola or soybean oil, such as refined, bleached and deodorized soybean oil (i.e., RBD soybean oil). Soybean oil typically includes about 95 percent by weight (wt %) or greater (e.g., 99 wt % or greater) triglycerides of fatty acids. Major fatty acids in the polyol esters of soybean oil include but are not limited to saturated fatty acids such as palmitic acid (hexadecanoic acid) and stearic acid (octadecanoic acid), and unsaturated fatty acids such as oleic acid (9-octadecenoic acid), linoleic acid (9,12-octadecadienoic acid), and linolenic acid (9,12,15-octadecatrienoic acid).

Such natural oils, or derivatives thereof, contain esters, such as triglycerides, of various unsaturated fatty acids. The identity and concentration of such fatty acids varies depending on the oil source, and, in some cases, on the variety. In some embodiments, the natural oil comprises one or more esters of oleic acid, linoleic acid, linolenic acid, or any combination thereof. When such fatty acid esters are metathesized, new compounds are formed. For example, in embodiments where the metathesis uses certain short-chain alkenes, e.g., ethylene, propylene, or 1-butene, and where the natural oil includes esters of oleic acid, an amount of 1-decene and 1-decenoid acid (or an ester thereof), among other products, are formed.

In some embodiments, the natural oil can be subjected to various pre-treatment processes, which can facilitate their utility for use in certain metathesis reactions. Useful pre-treatment methods are described in United States Patent Application Publication Nos. 2011/0113679, 2014/0275595, and 2014/0275681, all three of which are hereby incorporated by reference as though fully set forth herein.

In certain embodiments, prior to the metathesis reaction, the natural oil and/or unsaturated polyol ester feedstock may be treated to render the natural oil more suitable for the subsequent metathesis reaction. In one embodiment, the treatment of the natural oil and/or unsaturated polyol ester involves the removal of catalyst poisons, such as peroxides, which may potentially diminish the activity of the metathesis catalyst. Non-limiting examples of the natural oil and/or unsaturated polyol ester feedstock treatment methods to diminish catalyst poisons include those described in PCT/US2008/09604, PCT/US2008/09635, and U.S. patent application Ser. Nos. 12/672,651 and 12/672,652, herein incorporated by reference in their entireties. In certain embodiments, the natural oil and/or unsaturated polyol ester feedstock is thermally treated by heating the feedstock to a temperature greater than 100° C. in the absence of oxygen and held at the temperature for a time sufficient to diminish catalyst poisons in the feedstock. In other embodiments, the temperature is between approximately 100° C. and 300° C., between approximately 120° C. and 250° C., between approximately 150° C. and 210° C., or approximately between 190 and 200° C. In one embodiment, the absence of oxygen is achieved by sparging the natural oil and/or unsaturated polyol ester feedstock with nitrogen, wherein the nitrogen gas is pumped into the feedstock treatment vessel at a pressure of approximately 10 atm (150 psig).

In certain embodiments, the natural oil and/or unsaturated polyol ester feedstock is chemically treated under conditions sufficient to diminish the catalyst poisons in the feedstock through a chemical reaction of the catalyst poisons. In certain embodiments, the feedstock is treated with a reducing agent or a cation-inorganic base composition. Non-limiting examples of reducing agents include bisulfate, borohydride, phosphine, thiosulfate, and combinations thereof.

In certain embodiments, the natural oil and/or unsaturated polyol ester feedstock is treated with an adsorbent to remove catalyst poisons. In one embodiment, the feedstock is treated with a combination of thermal and adsorbent methods. In another embodiment, the feedstock is treated with a combination of chemical and adsorbent methods. In another embodiment, the treatment involves a partial hydrogenation treatment to modify the natural oil and/or unsaturated polyol ester feedstocks reactivity with the metathesis catalyst. Additional non-limiting examples of feedstock treatment are also described below when discussing the various metathesis catalysts.

In some embodiments, after any optional pre-treatment of the natural oil feedstock, the natural oil feedstock is reacted in the presence of a metathesis catalyst in a metathesis reactor. In some other embodiments, an unsaturated ester (e.g., an unsaturated glyceride, such as an unsaturated triglyceride) is reacted in the presence of a metathesis catalyst in a metathesis reactor. These unsaturated esters may be a component of a natural oil feedstock, or may be derived from other sources, e.g., from esters generated in earlier-performed metathesis reactions.

In some embodiments, the natural oil is winterized. Winterization refers to the process of: (1) removing waxes and other non-triglyceride constituents, (2) removing naturally occurring high-melting triglycerides, and (3) removing high-melting triglycerides formed during partial hydrogenation. Winterization may be accomplished by known methods including, for example, cooling the oil at a controlled rate in order to cause crystallization of the higher melting components that are to be removed from the oil. The crystallized high melting components are then removed from the oil by filtration resulting in winterized oil. Winterized soybean oil is commercially available from Cargill, Incorporated (Minneapolis, Minn.)

The conditions for such metathesis reactions, and the reactor design, and suitable catalysts are as described below with reference to the metathesis of the olefin esters. That discussion is incorporated by reference as though fully set forth herein.

Olefin Metathesis

In some embodiments, one or more of the unsaturated monomers can be made by metathesizing a natural oil or natural oil derivative. The terms "metathesis" or "metathesizing" can refer to a variety of different reactions, including, but not limited to, cross-metathesis, self-metathesis, ring-opening metathesis, ring-opening metathesis polymerizations ("ROMP"), ring-closing metathesis ("RCM"), and acyclic diene metathesis ("ADMET"). Any suitable metathesis reaction can be used, depending on the desired product or product mixture.

In some embodiments, after any optional pre-treatment of the natural oil feedstock, the natural oil feedstock is reacted in the presence of a metathesis catalyst in a metathesis reactor. In some other embodiments, an unsaturated ester (e.g., an unsaturated glyceride, such as an unsaturated triglyceride) is reacted in the presence of a metathesis catalyst in a metathesis reactor. These unsaturated esters may be a component of a natural oil feedstock, or may be derived from other sources, e.g., from esters generated in earlier-performed metathesis reactions. In certain embodiments, in the presence of a metathesis catalyst, the natural oil or unsaturated ester can undergo a self-metathesis reaction with itself.

In some embodiments, the metathesis comprises reacting a natural oil feedstock (or another unsaturated ester) in the presence of a metathesis catalyst. In some such embodiments, the metathesis comprises reacting one or more unsaturated glycerides (e.g., unsaturated triglycerides) in the natural oil feedstock in the presence of a metathesis catalyst. In some embodiments, the unsaturated glyceride comprises one or more esters of oleic acid, linoleic acid, linoleic acid, or combinations thereof. In some other embodiments, the unsaturated glyceride is the product of the partial hydrogenation and/or the metathesis of another unsaturated glyceride (as described above).

In some embodiments, the unsaturated polyol ester is partially hydrogenated before being metathesized. For example, in some embodiments, the unsaturated polyol ester is partially hydrogenated to achieve an iodine value (IV) of about 120 or less before subjecting the partially hydrogenated polyol ester to metathesis.

The metathesis process can be conducted under any conditions adequate to produce the desired metathesis products. For example, stoichiometry, atmosphere, solvent, temperature, and pressure can be selected by one skilled in the art to produce a desired product and to minimize undesirable byproducts. In some embodiments, the metathesis process may be conducted under an inert atmosphere. Similarly, in embodiments where a reagent is supplied as a gas, an inert gaseous diluent can be used in the gas stream. In such embodiments, the inert atmosphere or inert gaseous diluent typically is an inert gas, meaning that the gas does not interact with the metathesis catalyst to impede catalysis to a substantial degree. For example, non-limiting examples of inert gases include helium, neon, argon, methane, and nitrogen, used individually or with each other and other inert gases.

The rector design for the metathesis reaction can vary depending on a variety of factors, including, but not limited to, the scale of the reaction, the reaction conditions (heat, pressure, etc.), the identity of the catalyst, the identity of the materials being reacted in the reactor, and the nature of the feedstock being employed. Suitable reactors can be designed by those of skill in the art, depending on the relevant factors, and incorporated into a refining process such, such as those disclosed herein.

The metathesis reactions disclosed herein generally occur in the presence of one or more metathesis catalysts. Such methods can employ any suitable metathesis catalyst. The metathesis catalyst in this reaction may include any catalyst or catalyst system that catalyzes a metathesis reaction. Any known or future developed metathesis catalyst may be used, alone or in combination with one or more additional catalysts. Examples of metathesis catalysts and process conditions are described in US 2011/0160472, incorporated by reference herein in its entirety, except that in the event of any inconsistent disclosure or definition from the present specification, the disclosure or definition herein shall be deemed to prevail. A number of the metathesis catalysts described in US 2011/0160472 are presently available from Materia, Inc. (Pasadena, Calif.).

In some embodiments, the metathesis catalyst includes a Grubbs-type olefin metathesis catalyst and/or an entity derived therefrom. In some embodiments, the metathesis catalyst includes a first-generation Grubbs-type olefin metathesis catalyst and/or an entity derived therefrom. In some embodiments, the metathesis catalyst includes a second-generation Grubbs-type olefin metathesis catalyst and/or an entity derived therefrom. In some embodiments, the metathesis catalyst includes a first-generation Hoveyda-Grubbs-type olefin metathesis catalyst and/or an entity derived therefrom. In some embodiments, the metathesis catalyst includes a second-generation Hoveyda-Grubbs-type olefin metathesis catalyst and/or an entity derived therefrom. In some embodiments, the metathesis catalyst includes one or a plurality of the ruthenium carbene metathesis catalysts sold by Materia, Inc. of Pasadena, Calif. and/or one or more entities derived from such catalysts. Representative metathesis catalysts from Materia, Inc. for use in accordance with the present teachings include but are not limited to those sold under the following product numbers as well as combinations thereof: product no. C823 (CAS no. 172222-30-9), product no. C848 (CAS no. 246047-72-3), product no. C601 (CAS no. 203714-71-0), product no. C627 (CAS no. 301224-40-8), product no. C571 (CAS no. 927429-61-6), product no. C598 (CAS no. 802912-44-3), product no. C793 (CAS no. 927429-60-5), product no. C801 (CAS no. 194659-03-9), product no. C827 (CAS no. 253688-91-4), product no. C884 (CAS no. 900169-53-1), product no. C833 (CAS no. 1020085-61-3), product no. C859 (CAS no. 832146-68-6), product no. C711 (CAS no. 635679-24-2), product no. C933 (CAS no. 373640-75-6).

In some embodiments, the metathesis catalyst includes a molybdenum and/or tungsten carbene complex and/or an entity derived from such a complex. In some embodiments, the metathesis catalyst includes a Schrock-type olefin metathesis catalyst and/or an entity derived therefrom. In some embodiments, the metathesis catalyst includes a high-oxidation-state alkylidene complex of molybdenum and/or an entity derived therefrom. In some embodiments, the metathesis catalyst includes a high-oxidation-state alkylidene complex of tungsten and/or an entity derived therefrom. In some embodiments, the metathesis catalyst includes molybdenum (VI). In some embodiments, the metathesis catalyst includes tungsten (VI). In some embodiments, the metathesis catalyst includes a molybdenum- and/or a tungsten-containing alkylidene complex of a type described in one or more of (a) Angew. Chem. Int. Ed. Engl., 2003, 42, 4592-4633; (b) Chem. Rev., 2002, 102, 145-179; and/or (c) Chem. Rev., 2009, 109, 3211-3226, each of which is incorporated by reference herein in its entirety, except that in the event of any inconsistent disclosure or definition from the present specification, the disclosure or definition herein shall be deemed to prevail.

Suitable homogeneous metathesis catalysts include combinations of a transition metal halide or oxo-halide (e.g., $WOCl_4$ or $WCl_6$) with an alkylating cocatalyst (e.g., $Me_4Sn$), or alkylidene (or carbene) complexes of transition metals, particularly Ru or W. These include first and second-generation Grubbs catalysts, Grubbs-Hoveyda catalysts, and the like. Suitable alkylidene catalysts have the general structure:

$$M[X^1X^2L^1L^2(L^3))_n]{=}C_m{=}C(R^1)R^2$$

where M is a Group 8 transition metal, $L^1$, $L^2$, and $L^3$ are neutral electron donor ligands, n is 0 (such that $L^3$ may not be present) or 1, m is 0, 1, or 2, $X^1$ and $X^2$ are anionic ligands, and $R^1$ and $R^2$ are independently selected from H, hydrocarbyl, substituted hydrocarbyl, heteroatom-containing hydrocarbyl, substituted heteroatom-containing hydrocarbyl, and functional groups. Any two or more of $X^1$, $X^2$, $L^1$, $L^2$, $L^3$, $R^1$ and $R^2$ can form a cyclic group and any one of those groups can be attached to a support.

First-generation Grubbs catalysts fall into this category where m=n=0 and particular selections are made for n, $X^1$, $X^2$, $L^1$, $L^2$, $L^3$, $R^1$ and $R^2$ as described in U.S. Pat. Appl. Publ. No. 2010/0145086, the teachings of which related to all metathesis catalysts are incorporated herein by reference.

Second-generation Grubbs catalysts also have the general formula described above, but $L^1$ is a carbene ligand where the carbene carbon is flanked by N, O, S, or P atoms, preferably by two N atoms. Usually, the carbene ligand is part of a cyclic group. Examples of suitable second-generation Grubbs catalysts also appear in the '086 publication.

In another class of suitable alkylidene catalysts, $L^1$ is a strongly coordinating neutral electron donor as in first- and second-generation Grubbs catalysts, and $L^2$ and $L^3$ are weakly coordinating neutral electron donor ligands in the form of optionally substituted heterocyclic groups. Thus, $L^2$ and $L^3$ are pyridine, pyrimidine, pyrrole, quinoline, thiophene, or the like.

In yet another class of suitable alkylidene catalysts, a pair of substituents is used to form a bi- or tridentate ligand, such as a biphosphine, dialkoxide, or alkyldiketonate. Grubbs-Hoveyda catalysts are a subset of this type of catalyst in which $L^2$ and $R^2$ are linked. Typically, a neutral oxygen or nitrogen coordinates to the metal while also being bonded to a carbon that is α-, β-, or γ- with respect to the carbene carbon to provide the bidentate ligand. Examples of suitable Grubbs-Hoveyda catalysts appear in the '086 publication.

The structures below provide just a few illustrations of suitable catalysts that may be used:

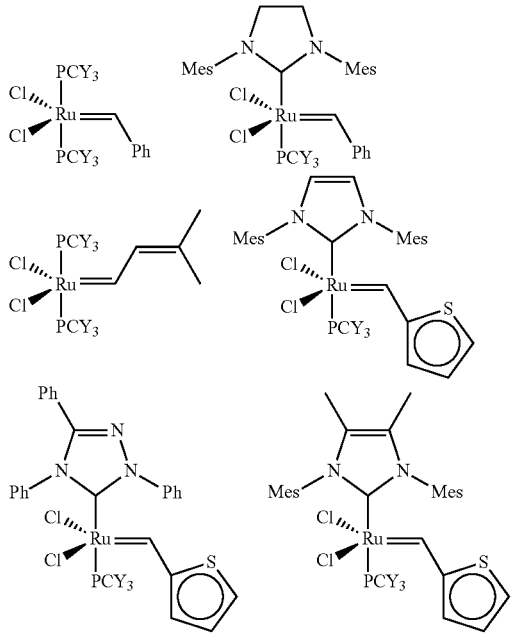

An immobilized catalyst can be used for the metathesis process. An immobilized catalyst is a system comprising a catalyst and a support, the catalyst associated with the support. Exemplary associations between the catalyst and the support may occur by way of chemical bonds or weak interactions (e.g. hydrogen bonds, donor acceptor interactions) between the catalyst, or any portions thereof, and the support or any portions thereof. Support is intended to include any material suitable to support the catalyst. Typically, immobilized catalysts are solid phase catalysts that act on liquid or gas phase reactants and products. Exemplary supports are polymers, silica or alumina. Such an immobilized catalyst may be used in a flow process. An immobilized catalyst can simplify purification of products and recovery of the catalyst so that recycling the catalyst may be more convenient.

Any useful amount of the selected metathesis catalyst can be used in the process. For example, the molar ratio of the unsaturated polyol ester to catalyst may range from about 5:1 to about 10,000,000:1 or from about 50:1 to 500,000:1. In some embodiments, an amount of about 1 to about 20 ppm, or about 2 ppm to about 15 ppm, of the metathesis catalyst per double bond of the starting composition (i.e., on a mole/mole basis) is used.

In some embodiments, the metathesis reaction is catalyzed by a system containing both a transition and a non-transition metal component. The most active and largest number of catalyst systems are derived from Group 6 and Group 8 transition metals, for example, tungsten, molybdenum, and ruthenium.

In certain embodiments, the metathesis catalyst is dissolved in a solvent prior to conducting the metathesis reaction. In certain such embodiments, the solvent chosen may be selected to be substantially inert with respect to the metathesis catalyst. For example, substantially inert solvents include, without limitation: aromatic hydrocarbons, such as benzene, toluene, xylenes, etc.; halogenated aromatic hydrocarbons, such as chlorobenzene and dichlorobenzene; aliphatic solvents, including pentane, hexane, heptane, cyclohexane, etc.; and chlorinated alkanes, such as dichloromethane, chloroform, dichloroethane, etc. In some embodiments, the solvent comprises toluene.

In other embodiments, the metathesis catalyst is not dissolved in a solvent prior to conducting the metathesis reaction. The catalyst, instead, for example, can be slurried with the natural oil or unsaturated ester, where the natural oil or unsaturated ester is in a liquid state. Under these conditions, it is possible to eliminate the solvent (e.g., toluene) from the process and eliminate downstream olefin losses when separating the solvent. In other embodiments, the metathesis catalyst may be added in solid state form (and not slurried) to the natural oil or unsaturated ester (e.g., as an auger feed).

In certain embodiments, a ligand may be added to the metathesis reaction mixture. In many embodiments using a ligand, the ligand is selected to be a molecule that stabilizes the catalyst, and may thus provide an increased turnover number for the catalyst. In some cases the ligand can alter reaction selectivity and product distribution. Examples of ligands that can be used include Lewis base ligands, such as, without limitation, trialkylphosphines, for example tricyclohexylphosphine and tributyl phosphine; triarylphosphines, such as triphenylphosphine; diarylalkylphosphines, such as, diphenylcyclohexylphosphine; pyridines, such as 2,6-dimethylpyridine, 2,4,6-trimethylpyridine; as well as other Lewis basic ligands, such as phosphine oxides and phosphinites. Additives may also be present during metathesis that increase catalyst lifetime.

The metathesis reaction temperature may, in some instances, be a rate-controlling variable where the temperature is selected to provide a desired product at an acceptable rate. In certain embodiments, the metathesis reaction temperature is greater than about −40° C., or greater than about −20° C., or greater than about 0° C., or greater than about 10° C. In certain embodiments, the metathesis reaction temperature is less than about 200° C., or less than about 150° C., or less than about 120° C. In some embodiments, the metathesis reaction temperature is between about 0° C. and about 150° C., or is between about 10° C. and about 120° C.

The metathesis reaction can be run under any desired pressure. Typically, it will be desirable to maintain a total pressure that is high enough to keep the cross-metathesis reagent in solution. Therefore, as the molecular weight of the cross-metathesis reagent increases, the lower pressure range typically decreases since the boiling point of the cross-metathesis reagent increases. The total pressure may be selected to be greater than about 0.1 atm (10 kPa), in some embodiments greater than about 0.3 atm (30 kPa), or greater than about 1 atm (100 kPa). Typically, the reaction pressure is no more than about 70 atm (7000 kPa), in some embodiments no more than about 30 atm (3000 kPa). A non-limiting exemplary pressure range for the metathesis reaction is from about 1 atm (100 kPa) to about 30 atm (3000 kPa). In certain embodiments it may be desirable to run the metathesis reactions under an atmosphere of reduced pressure. Conditions of reduced pressure or vacuum may be used to remove olefins as they are generated in a metathesis reaction, thereby driving the metathesis equilibrium towards the formation of less volatile products. In the case of a self-metathesis of a natural oil, reduced pressure can be used to remove $C_{12}$ or lighter olefins including, but not limited to, hexene, nonene, and dodecene, as well as byproducts including, but not limited to cyclohexadiene and benzene as the metathesis reaction proceeds. The removal of these species can be used as a means to drive the reaction towards the formation of diester groups and cross linked triglycerides.

In some embodiments, after metathesis has occurred, the metathesis catalyst is removed from the resulting product. One method of removing the catalyst is treatment of the metathesized product with an adsorbent bed. Representative adsorbents for use in accordance with the present teachings include but are not limited to carbon, silica, silica-alumina, alumina, clay, magnesium silicates (e.g., Magnesols), the synthetic silica adsorbent sold under the tradename TRISYL by W. R. Grace & Co., diatomaceous earth, polystyrene, macroporous (MP) resins, and the like, and combinations thereof. In one embodiment, the adsorbent is a clay bed. The clay bed will adsorb the metathesis catalyst, and after a filtration step, the metathesized product can be sent to a separation unit for further processing. The separation unit may comprise a distillation unit. In some embodiments, the distillation may be conducted, for example, by steam stripping the metathesized product. Distilling may be accomplished by sparging the mixture in a vessel, typically agitated, by contacting the mixture with a gaseous stream in a column that may contain typical distillation packing (e.g., random or structured), by vacuum distillation, or evaporating the lights in an evaporator such as a wiped film evaporator. Typically, steam stripping will be conducted at reduced pressure and at temperatures ranging from about 100° C. to 250° C. The temperature may depend, for example, on the level of vacuum used, with higher vacuum allowing for a lower temperature and allowing for a more efficient and complete separation of volatiles.

In another embodiment, the adsorbent is a water soluble phosphine reagent such as tris hydroxymethyl phosphine (THMP). THMP may be added at a rate equivalent to at least 1:1, 5:1, 10:1, 25:1, or 50:1 molar ratio relative to the catalyst. Catalyst may be separated with a water soluble phosphine through known liquid-liquid extraction mechanisms by decanting the aqueous phase from the organic phase. In other embodiments, the catalyst separation comprises washing or extracting the mixture with a polar solvent (e.g., particularly, though not exclusively, for embodiments in which the reagent is at least partially soluble in the polar solvent). Representative polar solvents for use in accordance with the present teachings include but are not limited to water, alcohols (e.g., methanol, ethanol, etc.), ethylene glycol, glycerol, DMF, multifunctional polar compounds including but not limited to polyethylene glycols and/or glymes, ionic liquids, and the like, and combinations thereof. In some embodiments, the mixture is extracted with water. In some embodiments, when a phosphite ester that is at least partially hydrolyzable (e.g., in some embodiments, a phosphite ester having a low molecular weight, including but not limited to trimethyl phosphite, triethyl phosphite, and a combination thereof) is used as a reagent, washing the mixture with water may convert the phosphite ester into a corresponding acid. In other embodiments, the metathesized product may be contacted with a reactant to deactivate or to extract the catalyst.

The metathesis reaction also results in the formation of internal olefin compounds that may be linear or cyclic. If the metathesized polyol ester is fully or partially hydrogenated, the linear and cyclic olefins would typically be fully or partially converted to the corresponding saturated linear and cyclic hydrocarbons. The linear/cyclic olefins and saturated linear/cyclic hydrocarbons may remain in the metathesized polyol ester or they may be removed or partially removed from the metathesized polyol ester using one or more known stripping techniques, including but not limited to wipe film evaporation, falling film evaporation, rotary evaporation, steam stripping, vacuum distillation, etc.

Multiple, sequential metathesis reaction steps may be employed. For example, the glyceride copolymer product may be made by reacting an unsaturated polyol ester in the presence of a metathesis catalyst to form a first glyceride copolymer product. The first glyceride copolymer product may then be reacted in a self-metathesis reaction to form another glyceride copolymer product. Alternatively, the first glyceride copolymer product may be reacted in a cross-metathesis reaction with a unsaturated polyol ester to form another glyceride copolymer product. Also in the alternative, the transesterified products, the olefins and/or esters may be further metathesized in the presence of a metathesis catalyst. Such multiple and/or sequential metathesis reactions can be performed as many times as needed, and at least one or more times, depending on the processing/compositional requirements as understood by a person skilled in the art. As used herein, a "glyceride copolymer product" may include products that have been once metathesized and/or multiply metathesized. These procedures may be used to form metathesis dimers, metathesis trimers, metathesis tetramers, metathesis pentamers, and higher order metathesis oligomers (e.g., metathesis hexamers, metathesis heptamers, metathesis octamers, metathesis nonamers, metathesis decamers, and higher than metathesis decamers). These procedures can be repeated as many times as desired (for example, from 2 to about 50 times, or from 2 to about 30 times, or from 2 to about 10 times, or from 2 to about 5 times, or from 2 to about 4 times, or 2 or 3 times) to provide the desired metathesis oligomer or polymer which may comprise, for example, from 2 to about 100 bonded groups, or from 2 to about 50, or from 2 to about 30, or from 2 to about 10, or from 2 to about 8, or from 2 to about 6 bonded groups, or from 2 to about 4 bonded groups, or from 2 to about 3 bonded groups. In certain embodiments, it may be desirable to use the glyceride copolymer products produced by cross metathesis of an unsaturated polyol ester, or blend of unsaturated polyol esters, with a $C_{2-14}$ olefin, preferably $C_{2-6}$ olefin, more preferably $C_4$ olefin, and mixtures and isomers thereof, as the reactant in a self-metathesis reaction to produce another glyceride copolymer product. Alternatively, metathesized products produced by cross metathesis of an unsaturated polyol ester, or blend of unsaturated polyol esters, with a $C_{2-14}$ olefin, preferably $C_{2-6}$ olefin, more preferably $C_4$ olefin, and mixtures and isomers thereof, can be combined with an unsaturated polyol ester, or blend of unsaturated polyol esters, and further metathesized to produce another glyceride copolymer product.

In some embodiments, the glyceride copolymer may be hydrogenated (e.g., fully or partially hydrogenated) in order to improve the stability of the oil or to modify its viscosity or other properties. Representative techniques for hydrogenating unsaturated polyol esters are known in the art and are discussed herein.

In other embodiments, the glyceride copolymers can be used as a blend with one or more fabric care benefit agents and/or fabric softening actives.

Hydrogenation:

In some embodiments, the unsaturated polyol ester is partially hydrogenated before it is subjected to the metathesis reaction. Partial hydrogenation of the unsaturated polyol ester reduces the number of double bonds that are available for in the subsequent metathesis reaction. In some embodiments, the unsaturated polyol ester is metathesized to form a glyceride copolymer, and the glyceride copolymer is then hydrogenated (e.g., partially or fully hydrogenated) to form a hydrogenated glyceride copolymer.

Hydrogenation may be conducted according to any known method for hydrogenating double bond-containing compounds such as vegetable oils. In some embodiments, the unsaturated polyol ester, natural oil or glyceride copolymer is hydrogenated in the presence of a nickel catalyst that has been chemically reduced with hydrogen to an active state. Commercial examples of supported nickel hydrogenation catalysts include those available under the trade designations "NYSOFACT", "NYSOSEL", and "NI 5248 D" (from Englehard Corporation, Iselin, N.H.). Additional supported nickel hydrogenation catalysts include those commercially available under the trade designations "PRICAT 9910", "PRICAT 9920", "PRICAT 9908", "PRICAT 9936" (from Johnson Matthey Catalysts, Ward Hill, Mass.).

In some embodiments, the hydrogenation catalyst comprising, for example, nickel, copper, palladium, platinum, molybdenum, iron, ruthenium, osmium, rhodium, or iridium. Combinations of metals may also be used. Useful catalyst may be heterogeneous or homogeneous. In some embodiments, the catalysts are supported nickel or sponge nickel type catalysts.

In some embodiments, the hydrogenation catalyst comprises nickel that has been chemically reduced with hydrogen to an active state (i.e., reduced nickel) provided on a support. In some embodiments, the support comprises porous silica (e.g., kieselguhr, infusorial, diatomaceous, or siliceous earth) or alumina. The catalysts are characterized by a high nickel surface area per gram of nickel.

In some embodiments, the particles of supported nickel catalyst are dispersed in a protective medium comprising hardened triacylglyceride, edible oil, or tallow. In an exemplary embodiment, the supported nickel catalyst is dispersed in the protective medium at a level of about 22 wt. % nickel.

Hydrogenation may be carried out in a batch or in a continuous process and may be partial hydrogenation or complete hydrogenation. In a representative batch process, a vacuum is pulled on the headspace of a stirred reaction vessel and the reaction vessel is charged with the material to be hydrogenated (e.g., RBD soybean oil or metathesized RBD soybean oil). The material is then heated to a desired temperature. Typically, the temperature ranges from about 50 deg. C. to 350 deg. C., for example, about 100 deg. C. to 300 deg. C. or about 150 deg. C. to 250 deg. C. The desired temperature may vary, for example, with hydrogen gas pressure. Typically, a higher gas pressure will require a lower temperature. In a separate container, the hydrogenation catalyst is weighed into a mixing vessel and is slurried in a small amount of the material to be hydrogenated (e.g., RBD soybean oil or metathesized RBD soybean oil). When the material to be hydrogenated reaches the desired temperature, the slurry of hydrogenation catalyst is added to the reaction vessel. Hydrogen gas is then pumped into the reaction vessel to achieve a desired pressure of $H_2$ gas. Typically, the $H_2$ gas pressure ranges from about 15 to 3000 psig or, for example, about 15 psig to 150 psig. As the gas pressure increases, more specialized high-pressure processing equipment may be required. Under these conditions the hydrogenation reaction begins and the temperature is allowed to increase to the desired hydrogenation temperature (e.g., about 120 deg. C. to 200 deg. C.) where it is maintained by cooling the reaction mass, for example, with cooling coils. When the desired degree of hydrogenation is reached, the reaction mass is cooled to the desired filtration temperature.

The amount of hydrogenation catalysts is typically selected in view of a number of factors including, for example, the type of hydrogenation catalyst used, the amount of hydrogenation catalyst used, the degree of unsaturation in the material to be hydrogenated, the desired rate of hydrogenation, the desired degree of hydrogenation (e.g., as measure by iodine value (IV)), the purity of the reagent, and the $H_2$ gas pressure. In some embodiments, the hydrogenation catalyst is used in an amount of about 10 wt. % or less, for example, about 5 wt. % or less or about 1 wt. % or less.

After hydrogenation, the hydrogenation catalyst may be removed from the hydrogenated product using known techniques, for example, by filtration. In some embodiments, the hydrogenation catalyst is removed using a plate and frame filter such as those commercially available from Sparkler Filters, Inc., Conroe Tex. In some embodiments, the filtration is performed with the assistance of pressure or a vacuum. In order to improve filtering performance, a filter aid may be used. A filter aid may be added to the metathesized product directly or it may be applied to the filter. Representative examples of filtering aids include diatomaceous earth, silica, alumina, and carbon. Typically, the filtering aid is used in an amount of about 10 wt. % or less, for example, about 5 wt. % or less or about 1 wt. % or less. Other filtering techniques and filtering aids may also be employed to remove the used hydrogenation catalyst. In other embodiments the hydrogenation catalyst is removed using centrifugation followed by decantation of the product.

Potential Processing Aids and/or Impurities

Unsaturated polyol esters, particularly those derived or synthesized from natural sources, are known to those skilled in the art to contain a wide range of minor components and impurities. These may include tocopherols, carotenes, free fatty acids, free glycerin, sterols, glucosinolates, phospholipids, peroxides, aldehydes and other oxidation products, and the like. The impurities and reactions products present in a wide range of natural oils are described in "Bailey's Industrial Oil and Fat Products," Fifth edition, Y. H. Hui, Ed., Wiley (1996) and references cited therein; "Lipid Analysis in Oil and Fats," R. J. Hamilton, Ed., Chapman Hall (1998) and references cited therein; and "Flavor Chemistry of Fats and Oils," D. B. Min and T. H. Smouse, Ed., American Oil Chemists Society (1985) and references cited therein.

It is understood by one skilled in the art that any of these methods of making the glyceride copolymers claimed and described in this specification may result in the presence of impurities in the final glyceride copolymer and in the compositions/consumer products claimed and described in this specification as a result of the use of the glyceride coplymers. These nonlimiting examples include metathesis catalysts including metals and ligands described herein; immobilized catalyst supports including silica or alumina; oil pretreatment agents including reducing agents, cation-inorganic base compositions and adsorbents; structures which result from oil thermal pretreatment; process aids including solvents such as aromatic hydrocarbons, halogenated aromatic hydrocarbons, aliphatic solvents, and chlorinated alkanes; aliphatic olefins including hexane, nonene, dodecene, and cyclohexadiene; catalyst kill agents and/or catalyst removal agents including adsorbents such as clay, carbon, silica, silica-alumina, alumina, clay, magnesium silicates, synthetic silica, diatomaceous earth, polystyrene, macroporous (MP) resins, or water soluble phosphine reagents such as tris hydroxymethyl phosphine (THMP); polar solvents including water, alcohols (e.g., methanol, ethanol, etc.), ethylene glycol, glycerol, DMF, multifunctional polar compounds including but not limited to polyethylene glycols and/or glymes, or ionic liquids; phosphite ester hydolysis byproducts; hydrogenation catalysts, including metals and ligands described herein; immobilized hydrogenation catalyst supports including porous silica or alumina; adjuncts necessary to protect, activate and/or remove the hydrogenation catalyst; and/or water.

The glyceride coplymers claimed and described in this specification may contain the following processing aids and/or impurities:

TABLE 1

Potential Processing Aids and/or Impurities in Glyceride copolymers

| Processing aids and/or impurities | Range (ppm by weight) | Preferred Range (ppm by weight) |
|---|---|---|
| Ruthenium | 0-100 | 0-30 |
| Phosphorus | 1-2000 | 2-100 |
| Chloride | 2-200 | 3-20 |

TABLE 2

Potential Processing Aids and/or Impurities in Consumer Products Arising from Glyceride Copolymers The following processing aids and/or impurities may be brought into or generated during storage in the compositions/consumer products claimed and described in this specification as a result of the use of the glyceride coplymers, at the levels provided in this specification:

| Processing aids and/or impurities | Range (ppm by weight) | Preferred Range (ppm by weight) | More Preferred Range (ppm by weight) |
|---|---|---|---|
| Ruthenium (ppmwt) | 0-50 | 0-10 | 0-3 |
| Phosphorus (ppmwt) | 0.5-1000 | 0.1-200 | 0.2-10 |
| Chloride (ppmwt) | 1-100 | 0.2-20 | 0.3-2 |

Consumer Product Adjunct Materials

The disclosed compositions may include additional adjunct ingredients that include: bleach activators, surfactants, delivery enhancing agents, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softener actives, fabric care benefit agents, anionic surfactant scavengers, carriers, hydrotropes, processing aids, structurants, anti-agglomeration agents, coatings, formaldehyde scavengers and/or pigments. Other embodiments of Applicants' compositions do not contain one or more of the following adjuncts materials: bleach activators, surfactants, delivery enhancing agents, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softener actives, fabric care benefit agents, anionic surfactant scavengers, carriers, hydrotropes, processing aids, structurants, anti-agglomeration agents, coatings, formaldehyde scavengers and/or pigments. The precise nature of these additional components, and levels of incorporation thereof, will depend on the physical form of the composition and the nature of the operation for which it is to be used. However, when one or more adjuncts are present, such one or more adjuncts may be present as detailed below. The following is a non-limiting list of suitable additional adjuncts.

Delivery Enhancing Agent:

The compositions may comprise from about 0.01% to about 10% of the composition of a delivery enhancing agent. As used herein, such term refers to any polymer or combination of polymers that significantly enhance the deposition of the fabric care benefit agent onto the fabric during laundering. Preferably, delivery enhancing agent may be a cationic or amphoteric polymer. The cationic charge density of the polymer ranges from about 0.05 milliequivalents/g to about 23 milliequivalents/g. The charge density may be calculated by dividing the number of net charge per repeating unit by the molecular weight of the repeating unit. In one aspect, the charge density varies from about 0.05 milliequivalents/g to about 8 milliequivalents/g. The positive charges could be on the backbone of the polymers or the side chains of polymers. For polymers with amine monomers, the charge density depends on the pH of the carrier. For these polymers, charge density may be measured at a pH of 7. Non-limiting examples of deposition enhancing agents are cationic or amphoteric, polysaccharides, proteins and synthetic polymers. Cationic polysaccharides include cationic cellulose derivatives, cationic guar gum derivatives, chitosan and derivatives and cationic starches. Cationic polysaccharides have a molecular weight from about 50,000 to about 2 million, preferably from about 100,000 to about 1,500,000. Suitable cationic polysaccharides include cationic cellulose ethers, particularly cationic hydroxyethylcellulose and cationic hydroxypropylcellulose. Examples of cationic hydroxyalkyl cellulose include those with the INCI name Polyquaternium10 such as those sold under the trade names Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name Celquat H200 and Celquat L-200 available from National Starch and Chemical Company, Bridgewater, N.J. Other suitable polysaccharides include Hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches refer to starch that has been chemically modified to provide the starch with a net positive charge in aqueous solution at pH 3. This chemical modification includes, but is not limited to, the addition of amino and/or ammonium group(s) into the starch molecules. Non-limiting examples of these ammonium groups may include substituents such as trimethylhydroxypropyl ammonium chloride, dimethylstearylhydroxypropyl ammonium chloride, or dimethyldodecylhydroxypropyl ammonium chloride. The source of starch before chemical modification can be chosen from a variety of sources including tubers, legumes, cereal, and grains. Non-limiting examples of this source of starch may include corn starch, wheat starch, rice starch, waxy corn starch, oat starch, cassaya starch, waxy barley, waxy rice starch, glutenous rice starch, sweet rice starch, amioca, potato starch, tapioca starch, oat starch, sago starch, sweet rice, or mixtures thereof. Nonlimiting examples of cationic starches include cationic maize starch, cationic tapioca, cationic potato starch, or mixtures thereof. The cationic starches may comprise amylase, amylopectin, or maltodextrin. The cationic starch may comprise one or more additional modifications. For example, these modifications may include cross-linking, stabilization reactions, phophorylations, hydrolyzations, cross-linking. Stabilization reactions may include alkylation and esterification. Suitable cationic starches for use in the present compositions are commercially-available from Cerestar under the trade name C*BOND® and from National Starch and Chemical Company under the trade name CATO® 2A. Cationic galactomannans include cationic guar gums or cationic locust bean gum. An example of a cationic guar gum is a quaternary ammonium derivative of Hydroxypropyl Guar such as those sold under the trade name Jaguar C13 and Jaguar Excel available from Rhodia, Inc of Cranbury N.J. and N-Hance by Aqualon, Wilmington, Del.

In one aspect, a synthetic cationic polymer may be used as the delivery enhancing agent. The molecular weight of these polymers may be in the range of from about 2,000 to about 5 million kD. Synthetic polymers include synthetic addition polymers of the general structure

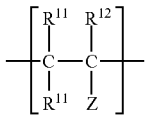

wherein each $R^{11}$ may be independently hydrogen, $C_1$-$C_{12}$ alkyl, substituted or unsubstituted phenyl, substituted or unsubstituted benzyl, —$OR_e$, or —$C(O)OR_e$ wherein $R_e$ may be selected from the group consisting of hydrogen, $C_1$-$C_{24}$ alkyl, and combinations thereof. In one aspect, $R^{11}$ may be hydrogen, $C_1$-$C_4$ alkyl, or —$OR_e$, or —$C(O)OR_e$ wherein each $R^{12}$ may be independently selected from the group consisting of hydrogen, hydroxyl, halogen, $C_1$-$C_{12}$ alkyl, —$OR_e$, substituted or unsubstituted phenyl, substituted or unsubstituted benzyl, carbocyclic, heterocyclic, and combinations thereof. In one aspect, $R^{12}$ may be selected from the group consisting of hydrogen, $C_1$-$C_4$ alkyl, and combinations thereof.

Each Z may be independently hydrogen, halogen; linear or branched $C_1$-$C_{30}$ alkyl, nitrilo, $N(R^{13})_2$—C(O)$N(R^{13})_2$; —NHCHO (formamide); —$OR^{13}$, —O($CH_2$)—$N(R^{13})_2$, —O($CH_2$)—$N^+(R^{13})_3X^-$, —C(O)$OR^{14}$; —C(O)N—$(R^{13})_2$; —C(O)O$(CH_2)''N(R^{13})_2$, —C(O)O$(CH_2)_nN^+(R^{13})_3X$, —OCO$(CH_2)_nN(R^{13})_2$, —OCO$(CH_2)_nN^+(R^{13})_3X^-$, —C(O)NH$(CH_2)_nN(R^{13})_2$, —C(O)NH$(CH_2)_nN^+(R^{13})_3X^-$, —$(CH_2)_n$ $N(R^{13})_2$, —$(CH_2)_nN\pm(R^{13})_3X^-$, Each $R^{13}$ may be independently selected from the group consisting of hydrogen, $C_1$-$C_{24}$ alkyl, $C_2$-$C_8$ hydroxyalkyl, benzyl, substituted benzyl, and combinations thereof;

Each $R^{14}$ may be independently selected from the group consisting of hydrogen, $C_1$-$C_{24}$ alkyl,

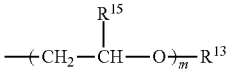

wherein m is 0 to 1,000, and $R^{15}$ may be independently selected from the group consisting of hydrogen, $C_1$-$C_6$ alkyl, and combinations thereof;

and combinations thereof.

X may be a water soluble anion wherein n may be from about 1 to about 6.

Z may also be selected from the group consisting of non-aromatic nitrogen heterocycles containing a quaternary ammonium ion, heterocycles containing an N-oxide moiety, aromatic nitrogens containing heterocycles wherein one or more or the nitrogen atoms may be quaternized; aromatic nitrogen-containing heterocycles wherein at least one nitrogen may be an N-oxide; and combinations thereof. Non-limiting examples of addition polymerizing monomers comprising a heterocyclic Z unit includes 1-vinyl-2-pyrrolidinone, 1-vinylimidazole, quaternized vinyl imidazole, 2-vinyl-1,3-dioxolane, 4-vinyl-1-cyclohexene 1,2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ may be the —NHCHO unit, formamide. The formulator can prepare a polymer or co-polymer comprising formamide units some of which are subsequently hydrolyzed to form vinyl amine equivalents.

The polymers or co-polymers may also contain one or more cyclic polymer units derived from cyclically polymerizing monomers. An example of a cyclically polymerizing monomer is dimethyl diallyl ammonium.

Suitable copolymers may be made from one or more cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, styrene sulfonic acid, acrylamidopropylmethane sulfonic acid (AMPS) and their salts, and combinations thereof. The polymer may optionally be cross-linked. Suitable crosslinking monomers include ethylene glycoldiacrylate, divinylbenzene, and butadiene.

In one aspect, the synthetic polymers are poly(acrylamide-co-diallyldimethylammonium chloride), poly(acrylamide-methacrylamidopropyltrimethyl ammonium chloride), poly(acrylamide-co-N,N-dimethyl aminoethyl methacrylate), poly(acrylamide-co-N,N-dimethyl aminoethyl acrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), poly(acrylamide-co-diallyldimethylammonium chloride-co-acrylic acid), poly(acrylamide-methacrylamidopropyltrimethyl ammonium chloride-co-acrylic acid). Examples of other suitable synthetic polymers are Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33.

Other cationic polymers include polyethyleneamine and its derivatives and polyamidoamine-epichlorohydrin (PAE) Resins. In one aspect, the polyethylene derivative may be an amide derivative of polyetheylenimine sold under the trade name Lupasol SK. Also included are alkoxylated polyethlenimine; alkyl polyethyleneimine and quaternized polyethyleneimine. These polymers are described in Wet Strength resins and their applications edited by L. L. Chan, TAPPI Press (1994). The weight-average molecular weight of the polymer will generally be from about 10,000 to about 5,000,000, or from about 100,000 to about 200,000, or from about 200,000 to about 1,500,000 Daltons, as determined by size exclusion chromatography relative to polyethylene oxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 ml/min.

In another aspect, the deposition aid may comprise poly (acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In one embodiment, the deposition aid is cationic acrylic based homopolymer sold under the tradename name Rheovis CDE, from CIBA.

Surfactants:

The products of the present invention may comprise from about 0.11% to 80% by weight of a surfactant. In one aspect, such compositions may comprise from about 5% to 50% by weight of surfactant. Surfactants utilized can be of the anionic, nonionic, zwitterionic, ampholytic or cationic type or can comprise compatible mixtures of these types.

Anionic and nonionic surfactants are typically employed if the fabric care product is a laundry detergent. On the other hand, cationic surfactants are typically employed if the fabric care product is a fabric softener.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, or even from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates and alkyl alkoxy sulfates, especially those obtained by sulfating the higher alcohols ($C_8$-$C_{18}$ carbon atoms).

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

In another embodiment, the anionic surfactant may comprise a $C_{11}$-$C_{18}$ alkyl benzene sulfonate surfactant; a $C_{10}$-$C_{20}$ alkyl sulfate surfactant; a $C_{10}$-$C_{18}$ alkyl alkoxy sulfate surfactant, having an average degree of alkoxylation of from 1 to 30, wherein the alkoxy comprises a $C_1$-$C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy comprises a $C_1$-$C_4$ chain and mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

In addition to the anionic surfactant, the fabric care compositions of the present invention may further contain a nonionic surfactant. The compositions of the present invention can contain up to about 30%, alternatively from about 0.01% to about 20%, more alternatively from about 0.1% to about 10%, by weight of the composition, of a nonionic surfactant. In one embodiment, the nonionic surfactant may comprise an ethoxylated nonionic surfactant.

Suitable for use herein are the ethoxylated alcohols and ethoxylated alkyl phenols of the formula $R(OC_2H_4)_nOH$, wherein R is selected from the group consisting of aliphatic hydrocarbon radicals containing from about 8 to about 20 carbon atoms and alkyl phenyl radicals in which the alkyl groups contain from about 8 to about 12 carbon atoms, and the average value of n is from about 5 to about 15. Materials may also be propoxylated alcohols and propoxylated alkyl phenols, and mixtures of such propoxylated and ethoxylated materials may be used. Furthermore, such materials may be propoxylated and ethoxylated.

Suitable nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. In one aspect, particularly useful materials are condensation products of $C_9$-$C_{15}$ alcohols with from about 5 to about 20 moles of ethylene oxide per mole of alcohol.

Additional suitable nonionic surfactants include polyhydroxy fatty acid amides such as N-methyl N-1-deoxyglucityl cocoamide and N-methyl N-1-deoxyglucityl oleamide and alkyl polysaccharides.

The fabric care compositions of the present invention may contain up to about 30%, alternatively from about 0.01% to about 20%, more alternatively from about 0.1% to about 20%, by weight of the composition, of a cationic surfactant. For the purposes of the present invention, cationic surfactants include those which can deliver fabric care benefits. Non-limiting examples of useful cationic surfactants include: fatty amines; quaternary ammonium surfactants; and imidazoline quat materials.

In some embodiments, useful cationic surfactants, have the general formula (IV):

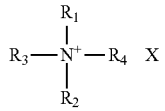

(IV)

wherein:

(a) $R_1$ and $R_2$ each are individually selected from the groups of: $C_1$-$C_4$ alkyl; $C_1$-$C_4$ hydroxy alkyl; benzyl; $—(C_nH_{2n}O)_xH$, wherein:
  i. x has a value from about 2 to about 5;
  ii. n has a value of about 1-4;

(b) $R_3$ and $R_4$ are each:
  i. a $C_8$-$C_{22}$ alkyl; or
  ii. $R_3$ is a $C_8$-$C_{22}$ alkyl and $R_4$ is selected from the group of: $C_1$-$C_{10}$ alkyl; $C_1$-$C_{10}$ hydroxy alkyl; benzyl; $—(C_nH_{2n}O)_xH$, wherein:
    1. x has a value from 2 to 5; and
    2. n has a value of 1-4; and (c) X is an anion.

Fabric Softener Active:

The compositions of the present invention may contain up to about 30%, alternatively from about 0.01% to about 20%, more alternatively from about 0.1% to about 20%, by weight of the composition, of fabric softener active. Liquid fabric care compositions, e.g., fabric softening compositions (such as those contained in DOWNY® or LENOR™), comprise a fabric softening active. One class of fabric softener actives includes cationic surfactants.

Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1.5% to about 50%, alternatively from about 1.5% to about 30%, alternatively from about 3% to about 25%, alternatively from about 3 to about 15%, of fabric softening active by weight of the final composition. In one embodiment, the fabric softening composition is a so called rinse added composition. In such an embodiment, the composition is substantially free of detersive surfactants, alternatively substantially free of anionic surfactants. In another embodiment, the pH of the fabric softening composition is from about pH 3 to about 9. In another embodiment, the pH of the fabric softening composition is from about pH 2 to about 3. The pH may be adjusted with the use of an acid such as hydrochloric acid or formic acid.

In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an alkylating agent.

In one aspect, the fabric softener active is a bis-(2-hydroxyethyl)-dimethylammonium chloride fatty acid ester having an average chain length of the fatty acid moieties of from 16 to 20 carbon atoms, preferably 16 to 18 carbon atoms, and an Iodine Value (IV), calculated for the free fatty acid, of from 15 to 25, alternatively from 18 to 22, alternatively from about 19 to about 21, alternatively combinations thereof. The Iodine Value is the amount of iodine in grams consumed by the reaction of the double bonds of 100 g of fatty acid, determined by the method of ISO 3961.

In certain aspects, the fabric softening active comprises a compound of Structure 5:

(Structure 5)

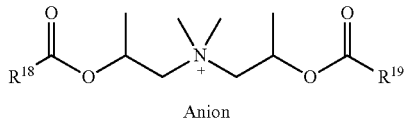

Anion wherein $R^{18}$ and $R^{19}$ is each independently a $C_{15}$-$C_{17}$, and wherein the $C_{15}$-$C_{17}$ is unsaturated or saturated, branched or linear, substituted or unsubstituted.

In some aspects, the fabric softening active comprises a bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60.

In some aspects, the fabric softening active comprises, as the principal active, compounds of the formula $$\{R_{4-m}—N^+—[(CH_2)_n—Y—R^1]_m\}A^- \quad \text{(Structure 6)}$$

wherein each R substituent is either hydrogen, a short chain $C_1$-$C_6$, preferably $C_1$-$C_3$ alkyl or hydroxyalkyl group, e.g., methyl, ethyl, propyl, hydroxyethyl, and the like, poly ($C_{2-3}$ alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group, and $A^-$ can be any softener-compatible anion, preferably, chloride, bromide, methylsulfate, ethylsulfate, sulfate, and nitrate, more preferably chloride or methyl sulfate;

In some aspects, the fabric softening active has the general formula:

$$[R_3N^+CH_2CH(YR^1)(CH_2YR^1)]A^-$$

wherein each Y, R, $R^1$, and $A^-$ have the same meanings as before. Such compounds include those having the formula:

$$[CH_3]_3N^{(+)}[CH_2CH(CH_2O(O)CR^1)O(O)CR^1]Cl^{(-)} \quad \text{(Structure 7)}$$

wherein each R is a methyl or ethyl group and preferably each $R^1$ is in the range of $C_{15}$ to $C_{19}$. As used herein, when the diester is specified, it can include the monoester that is present.

An example of a preferred DEQA (2) is the "propyl" ester quaternary ammonium fabric softener active having the formula 1,2-di(acyloxy)-3-trimethylammoniopropane chloride.

In some aspects, the fabric softening active has the formula:

$$[R_{4-m}—N^+—R^1_m]A^- \quad \text{(Structure 8)}$$

wherein each R, $R^1$, and $A^-$ have the same meanings as before.

In some aspects, the fabric softening active has the formula:

(Structure 9)

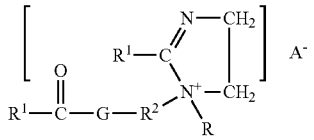

wherein each R, $R^1$, and $A^-$ have the definitions given above; each $R^2$ is a $C_{1-6}$ alkylene group, preferably an ethylene group; and G is an oxygen atom or an —NR— group;

In some aspects, the fabric softening active has the formula:

(Structure 10)

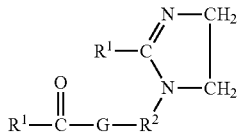

wherein $R^1$, $R^2$ and G are defined as above.

In some aspects, the fabric softening active is a condensation reaction product of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad \text{(Structure 11)}$$

wherein $R^1$, $R^2$ are defined as above, and each $R^3$ is a $C_{1-6}$ alkylene group, preferably an ethylene group and wherein the reaction products may optionally be quaternized by the additional of an alkylating agent such as dimethyl sulfate.

In some aspects, the preferred fabric softening active has the formula:

$$[R^1—C(O)—NR—R^2—N(R)_2—R^3—NR—C(O)—R^1]^+A^- \quad \text{(Structure 12)}$$

wherein R, $R^1$, $R^2$, $R^3$ and $A^-$ are defined as above;

In some aspects, the fabric softening active is a reaction product of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad \text{(Structure 13)}$$

wherein $R^1$, $R^2$ and $R^3$ are defined as above;

In some aspects, the fabric softening active has the formula:

(Structure 14)

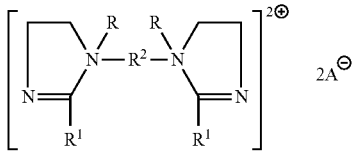

wherein R, $R^1$, $R^2$, and $A^-$ are defined as above.

In yet a further aspect, the fabric softening active may comprise the formula (Structure 15);

(Structure 15)

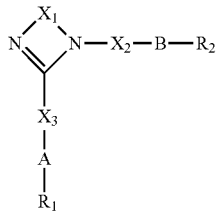

wherein;

$X_1$ may comprise a $C_{2-3}$ alkyl group, in one aspect, an ethyl group;

$X_2$ and $X_3$ may independently comprise $C_{1-6}$ linear or branched alkyl or alkenyl groups, in one aspect, methyl, ethyl or isopropyl groups;

$R_1$ and $R_2$ may independently comprise $C_{8-22}$ linear or branched alkyl or alkenyl groups;

characterized in that;

A and B are independently selected from the group comprising —O—(C═O)—, —(C═O)—O—, or mixtures thereof, in one aspect, —O—(C═O)—.

Non-limiting examples of Structure 6 are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)N-methyl ammonium methylsulfate.

Non-limiting examples of Structure 7 is 1,2 di(stearoyl-oxy) 3 trimethyl ammoniumpropane chloride.

Non-limiting examples of Structure 8 are dialkylenedimethylammonium salts such as dicanoladimethylammonium chloride, di(hard)tallowdimethylammonium chloride dicanoladimethylammonium methylsulfate. An example of commercially available dialkylenedimethylammonium salts usable in the present invention is dioleyldimethylammonium chloride available from the Evonik Corporation under the trade name Adogen® 472 and dihardtallow dimethylammonium chloride available from Akzo Nobel Arquad 2HT75.

A non-limiting example of Structure 9 is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of Structure 10 is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of Structure 11 is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Structure 12 is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g. under the trade name Varisoft® 222LT.

An example of Structure 12 is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of Structure 14 is the diquaternary compound having the formula:

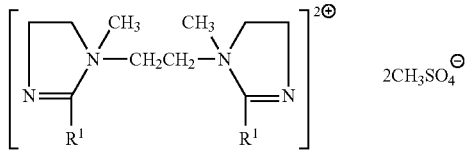

wherein $R^1$ is derived from fatty acid, and the compound is available from Witco Company.

A non-limiting example of a fabric softening active comprising Structure 15 is a dialkyl imidazoline diester compound, where the compound is the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of softener actives disclosed above are suitable for use in this invention.

It is also understood that some softening actives disclosed above may degrade into a variety of components, including but not limited to choline, fatty acids, hydroxyalkyl ammonium salts, and ammonium compounds.

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

Fabric Care Benefit Agent

The compositions disclosed herein may include a fabric care benefit agent. As used herein, "fabric care benefit agents" refers to ingredients which are water dispersible or water insoluble and can provide fabric care benefits such as fabric softening, color protection, pill/fuzz reduction, anti-abrasion, anti-wrinkle, perfume longevity and the like, to garments and fabrics, particularly on cotton garments and fabrics.

These fabric care benefit agents typically have the solubility in distilled water of less than 100 g/L, preferably less than 10 g/L at 25° C. It is believed that if the solubility of the fabric care benefit agent is more than 10 g/L, it will remain soluble in the wash liquor and consequently will not deposit onto the fabrics.

Examples of water insoluble fabric care benefit agents useful herein include dispersible polyolefins, polymer latexes, organosilicones, perfume or other active microcapsules, and mixtures thereof. The fabric care benefit agents can be in the form of emulsions, latexes, dispersions, suspensions, micelles and the like, and preferably in the form of microemulsions, swollen micelles or latexes. As such, they can have a wide range of particle sizes from about 1 nm to 100 um and preferably from about 5 nm to 10 um. The particle size of the microemulsions can be determined by conventional methods, such as using a Leeds & Northrup Microtrac UPA particle sizer.

Emulsifiers, dispersing agents and suspension agents may be used. The weight ratio of emulsifiers, dispersing agents or suspension agents to the fabric care benefit agents is about 1:100 to about 1:2. Preferably, the weight ratio ranges from about 1:50 to 1:5. Any surfactants suitable for making polymer emulsions or emulsion polymerizations of polymer latexes can be used to make the water insoluble fabric care benefit agents of the present invention. Suitable surfactants include anionic, cationic, and nonionic surfactants or mixtures thereof.

Silicones

Suitable organosilicones, include, but not limited to (a) non-functionalized silicones such as polydimethylsiloxane (PDMS); and (b) functionalized silicones such as silicones with one or more functional groups selected from the group consisting of amino, amido, alkoxy, alkyl, phenyl, polyether, acrylate, siliconehydride, mercaptoproyl, carboxylate, sulfate phosphate, quaternized nitrogen, and combinations thereof.

In typical embodiments, the organosilicones suitable for use herein have a viscosity ranging from about 10 to about 2,000,000 CSt (centistokes) at 25° C. In other embodiments, the suitable organosilicones have a viscosity from about 10 to about 800,000 CSt at 25° C.

(a) Polydimethylsiloxanes (PDMS) have been described in Cosmetics and Toiletries. They can be linear, branched, cyclic, grafted or cross-linked or cyclic structures. In some embodiments, the detergent compositions comprise PDMS having a viscosity of from about 100 to about 700,000 CSt at 25° C.

(b) Exemplary functionalized silicones include but are not limited to aminosilicones, amidosilicones, silicone polyethers, alkylsilicones, phenyl silicones and quaternary silicones.

The functionalized silicones suitable for use in the present invention have the following general formula:

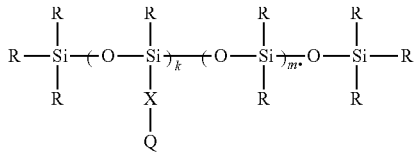

wherein m is from 4 to 50,000, preferably from 10 to 20,000;

k is from 1 to 25,000, preferably from 3 to 12,000;

each R is H or $C_1$-$C_8$ alkyl or aryl group, preferably $C_1$-$C_4$ alkyl, and more preferably a methyl group;

X is a linking group having the formula:

i) $—(CH_2)_p—$ wherein p is from 2 to 6, preferably 2 to 3;

ii)

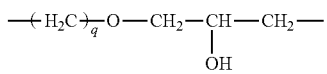

wherein q is from 0 to 4, preferably 1 to 2;

iii)

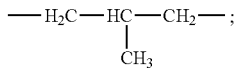

Q has the formula:

i) $—NH_2$, $—NH—(CH_2)_r—NH_2$, wherein r is from 1 to 4, preferably 2 to 3; or ii) $—(O—CHR_2—CH_2)_s—Z$, wherein s is from 1 to 100, preferably 3 to 30;

wherein $R_2$ is H or $C_1$-$C_3$ alkyl, preferably H or $CH_3$; and Z is selected from the group consisting of $—OR_3$, $—OC(O)R_3$, $—CO—R_4—COOH$, $—SO_3$, $—PO(OH)_2$, and mixtures thereof; further wherein $R_3$ is H, $C_1$-$C_{26}$ alkyl or substituted alkyl, $C_6$-$C_{26}$ aryl or substituted aryl, $C_7$-$C_{26}$ alkylaryl or substituted alkylaryl groups, preferably $R_3$ is H, methyl, ethyl propyl or benzyl groups; $R_4$ is $—CH_2—$ or $—CH_2CH_2—$ groups; and iii)

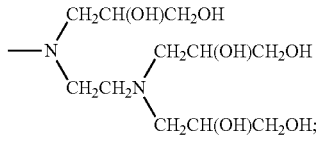

-continued iv)

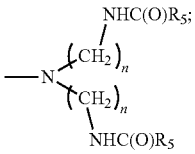

wherein n is from 1 to 4, preferably 2 to 3; and $R_5$ is C1-C4 alkyl, preferably methyl.

Another class of organosilicone useful herein is modified polyalkylene oxide polysiloxanes of the general formula:

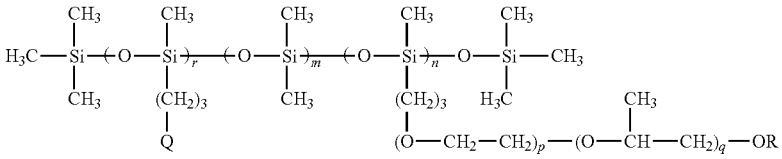

wherein Q is $NH_2$ or —$NHCH_2CH_2NH_2$; R is H or $C_1$-$C_6$ alkyl; r is from 0 to 1000; m is from 4 to 40,000; n is from 3 to 35,000; and p and q are integers independently selected from 2 to 30.

When r=0, nonlimiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland Ohio; and DC-5097, FF-400® available from Dow Corning® of Midland, Mich. Additional examples are KF-352®, KF-6015®, and KF-945®, all available from Shin Etsu Silicones of Tokyo, Japan.

When r=1 to 1000, nonlimiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of organosilicones useful herein is modified polyalkylene oxide polysiloxanes of the general formula:

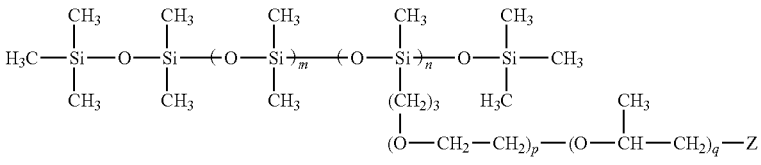

wherein m is from 4 to 40,000; n is from 3 to 35,000; and p and q are integers independently selected from 2 to 30; Z is selected from i.

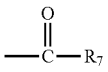

wherein $R_7$ is C1-C24 alkyl group;

ii.

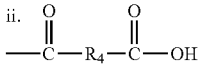

wherein $R_4$ is $CH_2$ or $CH_2CH_2$;

iii.

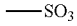

-continued iv.

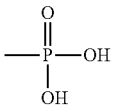

v.

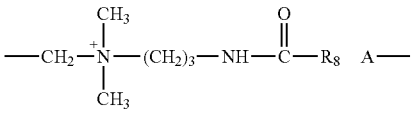

wherein $R_8$ is C1-C22 alkyl and A− is an appropriate anion, preferably $Cl^-$;

vi.

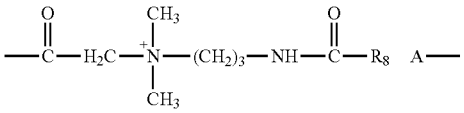

wherein $R_8$ is C1-C22 alkyl and A− is an appropriate anion, preferably $Cl^-$.

Another class of silicones is cationic silicones. These are typically produced by reacting a diamine with an epoxide. These are commercially available under the trade names Magnasoft® Prime, Magnasoft® HSSD, Silsoft® A-858 (all from GE Silicones).

In another aspect, the functionalized siloxane polymer may comprise silicone-urethanes. In one aspect, the synthesis of silicone-urethanes involves a conventional polycondensation reaction between a polysiloxane containing hydroxy functional groups or amine functional groups at the ends of its chain (for example, α,ω-dihydroxyalkylpolydimethylsiloxane or α,ω-diaminoalkylpolydimethylsiloxane or α-amino, ω-hydroxyalkylpolydimethylsiloxane) and a diisocyanate. In another aspect, organopolysiloxane oligomers containing a hydroxyalkyl functional group or an aminoalkyl functional group at the ends of its chain may be mixed with an organic diol or diamine coupling agent in a compatible solvent. The mixture may be then reacted with a diisocyanate. Silicone-urethanes are commercially available from Wacker Silicones under the trade name SLM-21200.

One embodiment of the composition of the present invention contains organosilicone emulsions, which comprise organosilicones dispersed in a suitable carrier (typically water) in the presence of an emulsifier (typically an anionic surfactant).

In another embodiment, the organosilicones are in the form of microemulsions. The organosilicone microemulsions may have an average particle size in the range from about 1 nm to about 150 nm, or from about 10 nm to about 100 nm, or from about 20 nm to about 50 nm. Microemulsions are more stable than conventional macroemulsions (average particle size about 1-20 microns) and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron. Since the selected organosilicones are water insoluble or have limited solubility in water, they will crash out of the wash liquor, resulting in more efficient deposition onto the fabrics and enhanced fabric care benefits. In a typical immersive wash environment, the composition is mixed with an excess of water to form a wash liquor, which typically has a weight ratio of water:composition ranging from 10:1 to 400:1.

A typical embodiment of the composition comprising from about 0.01% to about 10%, by weight of composition of the organosilicones and an effective amount of an emulsifier in a carrier. The "effective amount" of emulsifier is the amount sufficient to produce an organosilicone microemulsion in the carrier, preferably water. In some embodiments, the amount of emulsifiers ranges from about 5 to about 75 parts, or from about 25 to about 60 parts per 100 weight parts organosilicone.

The microemulsion typically comprises from about 10 to about 70%, or from about 25 to about 60%, by weight of the microemulsion of the dispersed organosilicones; from about 0.1 to about 30%, or from about 1 to about 20%, by weight of the microemulsion of anionic surfactant; optionally, from about 0 to about 3%, or from about 0.1 to about 20%, by weight of the microemulsion of nonionic surfactant; and the balance being water, and optionally other carriers. Selected organosilicone polymers (all those disclosed herein above, excluding PDMS and cationic silicones) are suitable for forming microemulsions; these organosilicones are sometimes referred to as the "self emulsifying silicones". Emulsifiers, particularly anionic surfactants, may be added to aid the formation of organosilicone microemulsions in the composition. Optionally, nonionic surfactants useful as laundry adjuncts to provide detersive benefits can also aid the formation and stability of the microemulsions. In a typical embodiment, the amount of emulsifiers is from about 0.05% to about 15% by weight of the composition.

Dispersible Polyolefins—

All dispersible polyolefins that provide fabric care benefits can be used as a fabric care benefit agents in the compositions of the present invention. The polyolefins can be in the form of waxes, emulsions, dispersions or suspensions. Examples of polyolefins useful herein are discussed below.

The polyolefin may be a polyethylene, polypropylene, polyisoprene, polyisobutylene and copolymers and combinations thereof. The polyolefin may be at least partially modified to contain various functional groups, such as carboxyl, alkylamide, sulfonic acid or amide groups. In one embodiment, the polyolefin is at least partially carboxyl modified or, in other words, oxidized.

For ease of formulation, the dispersible polyolefin may be introduced as a suspension or an emulsion of polyolefin dispersed in an aqueous medium by use of an emulsifying agent. When an emulsion is employed, the emulsifier may be any suitable emulsification agent including anionic, cationic, or nonionic surfactants, or mixtures thereof. Almost any suitable surfactant may be employed as the emulsifier of the present invention. The dispersible polyolefin is dispersed by use of an emulsifier or suspending agent in a ratio 1:100 to about 1:2. Preferably, the ratio ranges from about 1:50 to 1:5.

The polyolefin suspension or emulsion may comprise from about 1% to about 60%, alternatively from about 10% to about 55%, and still alternatively from about 20 to about 50% by weight of polyolefin.

Suitable polyethylene waxes are available commercially from suppliers including but not limited to Honeywell (A-C polyethylene), Clariant (Velustrol emulsion), and BASF (LUWAX).

Polymer Latexes—

Polymer latex is typically made by an emulsion polymerization process which includes one or more monomers, one or more emulsifiers, an initiator, and other components familiar to those of ordinary skill in the art. All polymer latexes that provide fabric care benefits can be used as water insoluble fabric care benefit agents of the present invention. Non-limiting examples of suitable polymer latexes include the monomers used in producing polymer latexes such as: (1) 100% or pure butyl acrylate; (2) butyl acrylate and butadiene mixtures with at least 20% (weight monomer ratio) of butyl acrylate; (3) butyl acrylate and less than 20% (weight monomer ratio) of other monomers excluding butadiene; (4) alkyl acrylate with an alkyl carbon chain at or greater than C6; (5) alkyl acrylate with an alkyl carbon chain at or greater than C6 and less than 50% (weight monomer ratio) of other monomers; (6) a third monomer (less than 20% weight monomer ratio) added into an aforementioned monomer systems; and (7) combinations thereof.

Polymer latexes suitable for use herein as fabric care benefit agents include those having a glass transition temperature of from about −120° C. to about 120° C. and preferably from about −80° C. to about 60° C. Suitable emulsifiers include anionic, cationic, nonionic and amphoteric surfactants. Suitable initiators include all initiators that are suitable for emulsion polymerization of polymer latexes. The particle size of the polymer latexes can be from about 1 nm to about 10 μm and is preferably from about 10 nm to about 1 um.

Oily Sugar Derivatives

For the purposes of the present invention, oily sugar derivatives include those which can deliver fabric care benefits. Two of the general types of oily sugar derivates are liquid or soft solid derivatives of: a cyclic polyol (hereinafter "CEP"); or a reduced saccharide (RSE); resulting from 35% to 100% of the hydroxyl groups in the CEP or the RSE being esterified and/or etherified. The resultant derivative CPE or RSE has at least two or more of its ester or ether groups independently attached to a $C_8$ to $C_{22}$ alkyl or alkenyl chain. Typically CPE's and RSE's have 3 or more ester or ether groups or combinations thereof.

In some embodiments, two or more ester or ether groups of the CPE or RSE may be independently attached to a $C_8$ to $C_{22}$ alkyl or alkenyl chain. The $C_8$ to $C_{22}$ alkyl or alkenyl chain may be linear or branched. In some embodiments, about 40% to about 100% of the hydroxyl groups are esterified or etherified. In some embodiments, about 50% to about 100% of the hydroxyl groups are esterified or etherified.

In the context of the present invention, the term cyclic polyol encompasses all forms of saccharides. In some embodiments, the CPEs and RSEs are derived from monosaccharides and disaccharides. Non-limiting examples of useful monosaccharides include: xylose; arabinose; galactose; fructose; and glucose. A non-limiting example of a useful saccharide is sorbitan. Non-limiting examples of useful disaccharides include: sucrose; lactose; maltose; and cellobiose.

In some embodiments, the CPEs or RSEs have 4 or more ester or ether groups. If a cyclic CPE is a disaccharide, disaccharide may have three or more ester or ether groups. In some embodiments, sucrose esters with 4 or more ester groups are of use; these are commercially available under the trade name SEFOSE®, available from The Procter and Gamble Co. of Cincinnati, Ohio. If a cyclic polyol is a reducing sugar, it may be advantageous if the ring of the CPE has one ether group, preferably at $C_1$ position; the remaining hydroxyl groups are esterified with alkyl groups.

Poly Glycerol Esters

All polyglycerol esters (PGEs) that provide fabric care benefits can be used as a fabric care benefit agents in the compositions of the present invention. The polyglycerol esters suitable for use in the present invention have the following general formula:

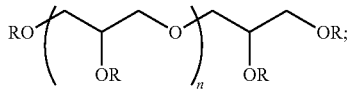

wherein each R is independently selected from the group consisting of fatty acid ester moieties comprising carbon chains, said carbon chains having a carbon chain length of from about 10 to about 22 carbon atoms; H; and combinations thereof; wherein n may be from about 1.5 to about 6; wherein the average % esterification of the PGE may be from about 20% to about 100%; and wherein the PGE may be saturated or unsaturated, or may comprise combinations thereof. Exemplary commercially available PGEs include Mazol® PGO 31K, Mazol® PGO 104K from BASF; Caprol® MPGO, Caprol® ET from Abitec Corp.; Grindsted® PGE 382, Grindsted® PGE 55, Grindsted® PGE 60 from Danisco; Varonic® 14, TegoSoft® PC 31, Isolan® GO 33, Isolan® GI 34 from Evonik Industries.

Anionic Surfactant Scavenger

The composition may contain an anionic surfactant scavenger. The surfactant scavenger is preferably a water soluble cationic and/or zwitterionic scavenger compound. The cationic and zwitterionic scavenger compounds useful herein typically have a quaternized nitrogen atom or amine group. Suitable anionic surfactant scavengers, include, but not limited to monoalkyl quaternary ammonium compounds and amine precursors thereof, dialkyl quaternary ammonium compounds and amine precursors thereof, polymeric amines, polyquaternary ammonium compounds and amine precursors thereof.

Builders—

The compositions may also contain from about 0.1% to 80% by weight of a builder. Compositions in liquid form generally contain from about 1% to 10% by weight of the builder component. Compositions in granular form generally contain from about 1% to 50% by weight of the builder component. Detergent builders are well known in the art and can contain, for example, phosphate salts as well as various organic and inorganic nonphosphorus builders. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other polycarboxylate builders are the oxydisuccinates and the ether carboxylate builder compositions comprising a combination of tartrate monosuccinate and tartrate disuccinate. Builders for use in liquid detergents include citric acid. Suitable nonphosphorus, inorganic builders include the silicates, aluminosilicates, borates and carbonates, such as sodium and potassium carbonate, bicarbonate, sesquicarbonate, tetraborate decahydrate, and silicates having a weight ratio of $SiO_2$ to alkali metal oxide of from about 0.5 to about 4.0, or from about 1.0 to about 2.4. Also useful are aluminosilicates including zeolites.

Dispersants—

The compositions may contain from about 0.1%, to about 10%, by weight of dispersants. Suitable water-soluble organic materials are the homo- or co-polymeric acids or their salts, in which the polycarboxylic acid may contain at least two carboxyl radicals separated from each other by not more than two carbon atoms. The dispersants may also be alkoxylated derivatives of polyamines, and/or quaternized derivatives.

Enzymes—

The compositions may contain one or more detergent enzymes which provide cleaning performance and/or fabric care benefits. Examples of suitable enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination may be a cocktail of conventional applicable enzymes like protease, lipase, cutinase and/or cellulase in conjunction with amylase. Enzymes can be used at their art-taught levels, for example at levels recommended by suppliers such as Novozymes and Genencor. Typical levels in the compositions are from about 0.0001% to about 5%. When enzymes are present, they can be used at very low levels, e.g., from about 0.001% or lower; or they can be used in heavier-duty laundry detergent formulations at higher levels, e.g., about 0.1% and higher. In accordance with a preference of some consumers for "non-biological" detergents, the compositions may be either or both enzyme-containing and enzyme-free.

Dye Transfer Inhibiting Agents—

The compositions may also include from about 0.0001%, from about 0.01%, from about 0.05% by weight of the compositions to about 10%, about 2%, or even about 1% by weight of the compositions of one or more dye transfer inhibiting agents such as polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Chelant—

The compositions may contain less than about 5%, or from about 0.01% to about 3% of a chelant such as citrates; nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

Brighteners—

The compositions may also comprise a brightener (also referred to as "optical brightener") and may include any compound that exhibits fluorescence, including compounds that absorb UV light and reemit as "blue" visible light. Non-limiting examples of useful brighteners include: derivatives of stilbene or 4,4'-diaminostilbene, biphenyl, five-membered heterocycles such as triazoles, pyrazolines, oxazoles, imidiazoles, etc., or six-membered heterocycles (coumarins, naphthalamide, s-triazine, etc.). Cationic, anionic, nonionic, amphoteric and zwitterionic brighteners can be used. Suitable brighteners include those commercially marketed under the trade name Tinopal-UNPA-GX® by Ciba Specialty Chemicals Corporation (High Point, N.C.).

Bleach System—

Bleach systems suitable for use herein contain one or more bleaching agents. Non-limiting examples of suitable bleaching agents include catalytic metal complexes; activated peroxygen sources; bleach activators; bleach boosters; photobleaches; bleaching enzymes; free radical initiators; $H_2O_2$; hypohalite bleaches; peroxygen sources, including perborate and/or percarbonate and combinations thereof. Suitable bleach activators include perhydrolyzable esters and perhydrolyzable imides such as, tetraacetyl ethylene diamine, octanoylcaprolactam, benzoyloxybenzenesulphonate, nonanoyloxybenzene¬sulphonate, benzoylvalerolactam, dodecanoyloxybenzenesulphonate. Other bleaching agents include metal complexes of transitional metals with ligands of defined stability constants.

Structurant—

The compositions may contain one or more structurant and thickener. Any suitable level of structurant may be of use; exemplary levels include from about 0.01% to about 20%, from about 0.1% to about 10%, or from about 0.1% to about 3% by weight of the composition. Non-limiting examples of structurants suitable for use herein include crystalline, hydroxyl-containing stabilizing agents, trihydroxystearin, hydrogenated oil, or a variation thereof, and combinations thereof. In some aspects, the crystalline, hydroxyl-containing stabilizing agents may be water-insoluble wax-like substances, including fatty acid, fatty ester or fatty soap. In other aspects, the crystalline, hydroxyl-containing stabilizing agents may be derivatives of castor oil, such as hydrogenated castor oil derivatives, for example, castor wax. Commercially available crystalline, hydroxyl-containing stabilizing agents include THIXCIN® from Rheox, Inc. Other structurants include thickening structurants such as gums and other similar polysaccharides, for example gellan gum, carrageenan gum, and other known types of thickeners and rheological additives. Exemplary structurants in this class include gum-type polymers (e.g. xanthan gum), polyvinyl alcohol and derivatives thereof, cellulose and derivatives thereof including cellulose ethers and cellulose esters and tamarind gum (for example, comprising xyloglucan polymers), guar gum, locust bean gum (in some aspects comprising galactomannan polymers), and other industrial gums and polymers.

Structurant materials may also include materials added to adequately suspend the benefit agent containing delivery particles include polysaccharides, gellan gum, starch, derivatized starches, carrageenan, guar gum, pectin, xanthan gum, and mixtures thereof; modified celluloses such as hydrolyzed cellulose acetate, hydroxy propyl cellulose, methyl cellulose, and mixtures thereof; modified proteins such as gelatin; hydrogenated and non-hydrogenated polyalkenes, and mixtures thereof; inorganic salts, for example, magnesium chloride, calcium chloride, calcium formate, magnesium formate, aluminum chloride, potassium permanganate; clays, such as laponite clay, bentonite clay and mixtures thereof; polysaccharides in combination with inorganic salts; quaternized polymeric materials, for example, polyether amines, alkyl trimethyl ammonium chlorides, diester ditallow ammonium chloride; imidazoles; nonionic polymers with a pKa less than 6.0, for example polyethyleneimine, polyethyleneimine ethoxylate; polyurethanes. Such materials can be obtained from CP Kelco Corp. of San Diego, Calif., USA; Degussa AG or Dusseldorf, Germany; BASF AG of Ludwigshafen, Germany; Rhodia Corp. of Cranbury, N.J., USA; Baker Hughes Corp. of Houston, Tex., USA; Hercules Corp. of Wilmington, Del., USA; Agrium Inc. of Calgary, Alberta, Canada, ISP of New Jersey, U.S.A. Structurants may also include homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide.

Perfume:

The optional perfume component may comprise a component selected from the group consisting of (1) a perfume microcapsule, or a moisture-activated perfume microcapsule, comprising a perfume carrier and an encapsulated perfume composition, wherein said perfume carrier may be selected from the group consisting of cyclodextrins, starch microcapsules, porous carrier microcapsules, and mixtures thereof; and wherein said encapsulated perfume composition may comprise low volatile perfume ingredients, high volatile perfume ingredients, and mixtures thereof;

(2) a pro-perfume;

(3) a low odor detection threshold perfume ingredients, wherein said low odor detection threshold perfume ingredients may comprise less than about 25%, by weight of the total neat perfume composition; and (4) mixtures thereof; and Porous Carrier Microcapsule—

A portion of the perfume composition can also be absorbed onto and/or into a porous carrier, such as zeolites or clays, to form perfume porous carrier microcapsules in order to reduce the amount of free perfume in the multiple use fabric conditioning composition.

Pro-Perfume—

The perfume composition may additionally include a pro-perfume. Pro-perfumes may comprise nonvolatile materials that release or convert to a perfume material as a result of, e.g., simple hydrolysis, or may be pH-change-triggered pro-perfumes (e.g. triggered by a pH drop) or may be enzymatically releasable pro-perfumes, or light-triggered pro-perfumes. The pro-perfumes may exhibit varying release rates depending upon the pro-perfume chosen.

Perfume Delivery Systems

As disclosed, the benefits of the perfumes disclosed herein may be further enhanced by employing a perfume delivery system to apply such perfumes. Non-limiting examples of suitable perfume delivery systems, methods of making perfume delivery systems and the uses of such perfume delivery systems are disclosed in USPA 2007/0275866 A1. Such perfume delivery systems include:

Polymer Assisted Delivery (PAD):

This perfume delivery technology uses polymeric materials to deliver perfume materials. Classical coacervation, water soluble or partly soluble to insoluble charged or neutral polymers, liquid crystals, hot melts, hydrogels, perfumed plastics, microcapsules, nano- and micro-latexes, polymeric film formers, and polymeric absorbents, polymeric adsorbents, etc. are some examples. PAD includes but is not limited to:

Matrix Systems:

The fragrance is dissolved or dispersed in a polymer matrix or particle. Perfumes, for example, may be 1) dispersed into the polymer prior to formulating into the product or 2) added separately from the polymer during or after formulation of the product. Diffusion of perfume from the polymer is a common trigger that allows or increases the rate of perfume release from a polymeric matrix system that is deposited or applied to the desired surface (situs), although many other triggers are known that may control perfume release. Absorption and/or adsorption into or onto polymeric particles, films, solutions, and the like are aspects of this technology. Nano- or micro-particles composed of organic materials (e.g., latexes) are examples. Suitable particles include a wide range of materials including, but not limited to polyacetal, polyacrylate, polyacrylic, polyacrylonitrile, polyamide, polyaryletherketone, polybutadiene, polybutylene, polybutylene terephthalate, polychloroprene, polyethylene, polyethylene terephthalate, polycyclohexylene dimethylene terephthalate, polycarbonate, polychloroprene, polyhydroxyalkanoate, polyketone, polyester, polyetherimide, polyethersulfone, polyethylenechlorinates, polyimide, polyisoprene, polylactic acid, polymethylpentene, polyphenylene oxide, polyphenylene sulfide, polyphthalamide, polypropylene, polystyrene, polysulfone, polyvinyl acetate, polyvinyl chloride, as well as polymers or copolymers based on acrylonitrile-butadiene, cellulose acetate, ethylene-vinyl acetate, ethylene vinyl alcohol, styrene-butadiene, vinyl acetate-ethylene, and mixtures thereof.

"Standard" systems refer to those that are "pre-loaded" with the intent of keeping the pre-loaded perfume associated with the polymer until the moment or moments of perfume release. Such polymers may also suppress the neat product odor and provide a bloom and/or longevity benefit depending on the rate of perfume release. One challenge with such systems is to achieve the ideal balance between 1) in-product stability (keeping perfume inside carrier until you need it) and 2) timely release (during use or from dry situs). Achieving such stability is particularly important during in-product storage and product aging. This challenge is particularly apparent for aqueous-based, surfactant-containing products, such as heavy duty liquid laundry detergents. Many "Standard" matrix systems available effectively become "Equilibrium" systems when formulated into aqueous-based products. One may select an "Equilibrium" system or a Reservoir system, which has acceptable in-product diffusion stability and available triggers for release (e.g., friction). "Equilibrium" systems are those in which the perfume and polymer may be added separately to the product, and the equilibrium interaction between perfume and polymer leads to a benefit at one or more consumer touch points (versus a free perfume control that has no polymer-assisted delivery technology). The polymer may also be pre-loaded with perfume; however, part or all of the perfume may diffuse during in-product storage reaching an equilibrium that includes having desired perfume raw materials (PRMs) associated with the polymer. The polymer then carries the perfume to the surface, and releases it typically via perfume diffusion. The use of such equilibrium system polymers has the potential to decrease the odor intensity of the neat product (usually more so in the case of pre-loaded standard systems). Deposition of such polymers may serve to "flatten" the release profile and provide increased longevity. As indicated above, such longevity would be achieved by suppressing the initial intensity and may enable the formulator to use more high impact or low odor detection threshold (ODT) or low Kovats Index (KI) PRMs to achieve FMOT benefits without initial intensity that is too strong or distorted. It is important that perfume release occurs within the time frame of the application to impact the desired consumer touch point or touch points. Matrix systems also include hot melt adhesives and perfume plastics. In addition, hydrophobically modified polysaccharides may be formulated into the perfumed product to increase perfume deposition and/or modify perfume release. All such matrix systems, including for example polysaccarides and nanolatexes may be combined with other PDTs, including other PAD systems such as PAD reservoir systems in the form of a perfume microcapsule (PMC).

Silicones are also examples of polymers that may be used as PDT, and can provide perfume benefits in a manner similar to the polymer-assisted delivery "matrix system". Such a PDT is referred to as silicone-assisted delivery (SAD). One may pre-load silicones with perfume, or use them as an equilibrium system as described for PAD. Examples of silicones include polydimethylsiloxane and polyalkyldimethylsiloxanes. Other examples include those with amine functionality, which may be used to provide benefits associated with amine-assisted delivery (AAD) and/or polymer-assisted delivery (PAD) and/or amine-reaction products (ARP).

Reservoir Systems:

Reservoir systems are also known as a core-shell type technology, or one in which the fragrance is surrounded by a perfume release controlling membrane, which may serve as a protective shell. The material inside the microcapsule is referred to as the core, internal phase, or fill, whereas the wall is sometimes called a shell, coating, or membrane. Microparticles or pressure sensitive capsules or microcapsules are examples of this technology. Microcapsules of the current invention are formed by a variety of procedures that include, but are not limited to, coating, extrusion, spray-drying, interfacial, in-situ and matrix polymerization. The possible shell materials vary widely in their stability toward water. Among the most stable are polyoxymethyleneurea (PMU)-based materials, which may hold certain PRMs for even long periods of time in aqueous solution (or product). Such systems include but are not limited to urea-formaldehyde and/or melamine-formaldehyde. Gelatin-based microcapsules may be prepared so that they dissolve quickly or slowly in water, depending for example on the degree of cross-linking. Many other capsule wall materials are available and vary in the degree of perfume diffusion stability observed. Without wishing to be bound by theory, the rate of release of perfume from a capsule, for example, once deposited on a surface is typically in reverse order of in-product perfume diffusion stability. As such, urea-formaldehyde and melamine-formaldehyde microcapsules for example, typically require a release mechanism other than, or in addition to, diffusion for release, such as mechanical force (e.g., friction, pressure, shear stress) that serves to break the capsule and increase the rate of perfume (fragrance) release. Other triggers include melting, dissolution, hydrolysis or other chemical reaction, electromagnetic radiation, and the like. The use of pre-loaded microcapsules requires the proper ratio of in-product stability and in-use and/or on-surface (on-situs) release, as well as proper selection of PRMs. Microcapsules that are based on urea-formaldehyde and/or melamine-formaldehyde are relatively stable, especially in near neutral aqueous-based solutions. These materials may require a friction trigger which may not be applicable to all product applications. Other microcapsule materials (e.g., gelatin) may be unstable in aqueous-based products and may even provide reduced benefit (versus free perfume control) when in-product aged. Scratch and sniff technologies are yet another example of PAD.

In one aspect, said perfume delivery technology may comprise encapsulated perfume such as encapsulated perfume formed by at least partially surrounding a benefit agent with a wall material. Said benefit agent may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl) propyl]cyclopentan-2-one, 2-sec-butylcyclohexanone, and (3-dihydro ionone, linalool, ethyllinalool, tetrahydrolinalool, and dihydromyrcenol. Suitable perfume materials can be obtained from Givaudan Corp. of Mount Olive, N.J., USA, International Flavors & Fragrances Corp. of South Brunswick, N.J., USA, or Quest Corp. of Naarden, Netherlands. In one aspect, the microcapsule wall material may comprise: melamine, polyacrylamide, silicones, silica, polystyrene, polyurea, polyurethanes, polyacrylate based materials, gelatin, styrene malic anhydride, polyamides, and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene cross-linked with divinylbenzene. In one aspect, said polyurea wall material may comprise urea crosslinked with formaldehyde, urea crosslinked with gluteraldehyde, and mixtures thereof. In one aspect, said polyacrylate based materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof. In one aspect, the encapsulated perfume may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, and combinations thereof. In one aspect, one or more types of encapsulated perfumes, for example two types of encapsulated perfumes each having a different benefit agent, and/or processing parameters may be used.

Molecule-Assisted Delivery (MAD):

Non-polymer materials or molecules may also serve to improve the delivery of perfume. Without wishing to be bound by theory, perfume may non-covalently interact with organic materials, resulting in altered deposition and/or release. Non-limiting examples of such organic materials include but are not limited to hydrophobic materials such as organic oils, waxes, mineral oils, petrolatum, fatty acids or esters, sugars, surfactants, liposomes and even other perfume raw material (perfume oils), as well as natural oils, including body and/or other soils. Perfume fixatives are yet another example. In one aspect, non-polymeric materials or molecules have a C Log P greater than about 2.

Cyclodextrin (CD):

This technology approach uses a cyclic oligosaccharide or cyclodextrin to improve the delivery of perfume. Typically a perfume and cyclodextrin (CD) complex is formed. Such complexes may be preformed, formed in-situ, or formed on or in the situs. Without wishing to be bound by theory, loss of water may serve to shift the equilibrium toward the CD-Perfume complex, especially if other adjunct ingredients (e.g., surfactant) are not present at high concentration to compete with the perfume for the cyclodextrin cavity. A bloom benefit may be achieved if water exposure or an increase in moisture content occurs at a later time point. In addition, cyclodextrin allows the perfume formulator increased flexibility in selection of PRMs. Cyclodextrin may be pre-loaded with perfume or added separately from perfume to obtain the desired perfume stability, deposition or release benefit.

Starch Encapsulated Accord (SEA):

The use of a starch encapsulated accord (SEA) technology allows one to modify the properties of the perfume, for example, by converting a liquid perfume into a solid by adding ingredients such as starch. The benefit includes increased perfume retention during product storage, especially under non-aqueous conditions. Upon exposure to moisture, a perfume bloom may be triggered. Benefits at other moments of truth may also be achieved because the starch allows the product formulator to select PRMs or PRM concentrations that normally cannot be used without the presence of SEA. Another technology example includes the use of other organic and inorganic materials, such as silica to convert perfume from liquid to solid.

Zeolite & Inorganic Carrier (ZIC):

This technology relates to the use of porous zeolites or other inorganic materials to deliver perfumes. Perfume-loaded zeolite may be used with or without adjunct ingredients used for example to coat the perfume-loaded zeolite (PLZ) to change its perfume release properties during product storage or during use or from the dry situs. Silica is another form of ZIC. Another example of a suitable inorganic carrier includes inorganic tubules, where the perfume or other active material is contained within the lumen of the nano- or micro-tubules. Preferably, the perfume-loaded inorganic tubule (or Perfume-Loaded Tubule or PLT) is a mineral nano- or micro-tubule, such as halloysite or mixtures of halloysite with other inorganic materials, including other clays. The PLT technology may also comprise additional ingredients on the inside and/or outside of the tubule for the purpose of improving in-product diffusion stability, deposition on the desired situs or for controlling the release rate of the loaded perfume. Monomeric and/or polymeric materials, including starch encapsulation, may be used to coat, plug, cap, or otherwise encapsulate the PLT.

In one aspect, a perfume delivery system selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system, wherein said perfume delivery system may comprise a perfume disclosed in this specification, for example a perfume selected from the perfumes disclosed in the perfume section of this specification, is disclosed.

In one aspect, a Polymer Assisted Delivery (PAD) system wherein said Polymer Assisted Delivery (PAD) system may comprise a Polymer Assisted Delivery (PAD) Reservoir system that may comprise a perfume disclosed in this specification, for example a perfume selected from the perfumes disclosed in the perfume section of this specification, is disclosed.

In one aspect of, said Polymer Assisted Delivery (PAD) Reservoir system said Polymer Assisted Delivery (PAD) Reservoir system may comprise a perfume delivery particle that may comprise a shell material and a core material, said shell material encapsulating said core material, said core material may comprise a perfume disclosed in this specification, for example a perfume selected from the perfumes disclosed in the perfume section of this specification, and said shell comprising a material selected from the group consisting of polyethylenes; polyamides; polystyrenes; polyisoprenes; polycarbonates; polyesters; polyacrylates; aminoplasts, in one aspect said aminoplast comprises a polyurea, polyurethane, and/or polyureaurethane, in one aspect said polyurea comprises polyoxymethyleneurea and/or melamine formaldehyde; polyolefins; polysaccharides, in one aspect alginate and/or chitosan; gelatin; shellac; epoxy resins; vinyl polymers; water insoluble inorganics; silicone; and mixtures thereof.

In one aspect, of said Polymer Assisted Delivery (PAD) Reservoir system said shell may comprise melamine formaldehyde and/or cross linked melamine formaldehyde.

In one aspect of said Polymer Assisted Delivery (PAD) Reservoir system said shell may be coated by a water-soluble cationic polymer selected from the group that consists of polysaccharides, cationically modified starch and cationically modified guar, polysiloxanes, dimethyldiallylammonium polyhalogenides, copolymers of dimethyldiallylammonium polychloride and vinyl pyrrolidone, acrylamides, imidazoles, imidazolinium halogenides and imidazolium halogenides and polyvinyl amine and its copolymers with N-vinyl formamide.

In one aspect of said Polymer Assisted Delivery (PAD) Reservoir system said coating that coats said shell, may comprise a cationic polymer and an anionic polymer.

In one aspect of said Polymer Assisted Delivery (PAD) Reservoir system wherein said cationic polymer may comprise hydroxyl ethyl cellulose; and said anionic polymer may comprise carboxyl methyl cellulose.

In one aspect, said Polymer Assisted Delivery (PAD) Reservoir system is a perfume microcapsule.

Malodor Reduction Technologies—

Any malodor technology may be used, including technologies that mask malodors, inhibit the perception of malodors, or operate by any other mechanism to make one or more malodors less noticeable to the consumer. One such technology is described in detail USPA Serial No. 2016/0090555 A1. USPA Serial No. 2016/0090555 A1 teaches that a sum total of from about 0.00025% to about 0.5%, preferably from about 0.0025% to about 0.1%, more preferably from about 0.005% to about 0.075%, most preferably from about 0.01% to about 0.05% of 1 or more malodor reduction materials, preferably 1 to about 20 malodor reduction materials, more preferably 1 to about 15 malodor reduction materials, most preferably 1 to about 10 malodor reduction materials, each of said malodor reduction materials having a MORV of at least 0.5, preferably from 0.5 to 10, more preferably from 1 to 10, most preferably from 1 to 5, and preferably each of said malodor reduction materials having a Universal MORV, said sum total of malodor reduction materials having a Blocker Index of less than 3, more preferable less than about 2.5 even more preferably less than about 2 and still more preferably less than about 1 and most preferably 0 and/or a Blocker Index average of 3 to about 0.001 an be used to inhibit malodor. Preferably, said malodor reduction materials have a Fragrance Fidelity Index of less than 3, preferably less than 2, more preferably less than 1 and most preferably 0 and/or a Fragrance Fidelity Index average of 3 to about 0.001 Fragrance Fidelity Index. In one aspect, the weight ratio of parts of malodor reduction composition to parts of perfume is from about 1:20,000 to about 3000:1, preferably from about 1:10,000 to about 1,000:1, more preferably 5,000:1 to about 500:1 and most preferably from about 1:15 to about 1:1.

Fabric Hueing Agents—

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof. Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Acid, Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10, 19, 35, 38, and 48, Basic Blue dyes such as 3, 16, 22, 47, 65, 66, 67, 71, 75 and 159, Disperse or Solvent dyes, and mixtures thereof. In another aspect, suitable small molecule dyes include small molecule dyes selected from the group consisting of C. I. numbers Acid Violet 17, Acid Blue 80, Acid Violet 50, Direct Blue 71, Direct Violet 51, Direct Blue 1, Acid Red 88, Acid Red 150, Acid Blue 29, Acid Blue 113 or mixtures thereof.

Polymeric Dyes—

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet Conn., carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

The hueing agent may be incorporated into the detergent composition as part of a reaction mixture which is the result of the organic synthesis for a dye molecule, with optional purification step(s). Such reaction mixtures generally comprise the dye molecule itself and in addition may comprise un-reacted starting materials and/or by-products of the organic synthesis route.

The aforementioned fabric hueing agents can be used in combination (any mixture of fabric hueing agents can be used).

Coatings—

In one aspect of the invention, benefit agent containing delivery particles are manufactured and are subsequently coated with an additional material. Non-limiting examples of coating materials include but are not limited to materials selected from the group consisting of poly(meth)acrylate, poly(ethylene-maleic anhydride), polyamine, wax, polyvinylpyrrolidone, polyvinylpyrrolidone co-polymers, polyvinylpyrrolidone-ethyl acrylate, polyvinylpyrrolidone-vinyl acrylate, polyvinylpyrrolidone methylacrylate, polyvinylpyrrolidone/vinyl acetate, polyvinyl acetal, polyvinyl butyral, polysiloxane, poly(propylene maleic anhydride), maleic anhydride derivatives, co-polymers of maleic anhydride derivatives, polyvinyl alcohol, styrene-butadiene latex, gelatin, gum Arabic, carboxymethyl cellulose, carboxymethyl hydroxyethyl cellulose, hydroxyethyl cellulose, other modified celluloses, sodium alginate, chitosan, casein, pectin, modified starch, polyvinyl acetal, polyvinyl butyral, polyvinyl methyl ether/maleic anhydride, polyvinyl pyrrolidone and its co polymers, poly(vinyl pyrrolidone/methacrylamidopropyl trimethyl ammonium chloride), polyvinylpyrrolidone/vinyl acetate, polyvinyl pyrrolidone/dimethylaminoethyl methacrylate, polyvinyl amines, polyvinyl formamides, polyallyl amines and copolymers of polyvinyl amines, polyvinyl formamides, and polyallyl amines and mixtures thereof. Such materials can be obtained from CP Kelco Corp. of San Diego, Calif., USA; Degussa AG or Dusseldorf, Germany; BASF AG of Ludwigshafen, Germany; Rhodia Corp. of Cranbury, N.J., USA; Baker Hughes Corp. of Houston, Tex., USA; Hercules Corp. of Wilmington, Del., USA; Agrium Inc. of Calgary, Alberta, Canada, ISP of New Jersey U.S.A.

Formaldehyde Scavenger—

In one aspect, benefit agent containing delivery particles may be combined with a formaldehyde scavenger. In one aspect, such benefit agent containing delivery particles may comprise the benefit agent containing delivery particles of the present invention. Suitable formaldehyde scavengers include materials selected from the group consisting of sodium bisulfite, melamine, urea, ethylene urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), partially hydrolyzed poly(vinylformamide), poly(vinyl amine), poly(ethylene imine), poly(oxyalkyleneamine), poly (vinyl alcohol)-co-poly(vinyl amine), poly(4-aminostyrene), poly(l-lysine), chitosan, hexane diol, ethylenediamine-N,N'-bisacetoacetamide, N-(2-ethylhexyl)acetoacetamide, 2-benzoylacetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, ammonium hydroxide, benzylamine, hydroxycitronellol, cyclohexanone, 2-butanone, pentane dione, dehydroacetic acid, or a mixture thereof. These formaldehyde scavengers may be obtained from Sigma/Aldrich/Fluka of St. Louis, Mo. U.S.A. or PolySciences, Inc. of Warrington, Pa., U.S.A.

In one aspect, such formaldehyde scavengers may be combined with a consumer product, for example, a liquid laundry detergent product containing a benefit agent containing delivery particle, said scavengers being selected from the group consisting of sodium bisulfite, melamine, urea, ethylene urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), partially hydrolyzed poly (vinylformamide), poly(vinyl amine), poly(ethylene imine), poly(oxyalkyleneamine), poly(vinyl alcohol)-co-poly(vinyl amine), poly(4-aminostyrene), poly(l-lysine), chitosan, hexane diol, ethylenediamine-N,N'-bisacetoacetamide, N-(2-ethylhexyl)acetoacetamide, 2-benzoylacetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, ammonium hydroxide, benzylamine, hydroxycitronellol, cyclohexanone, 2-butanone, pentane dione, dehydroacetic acid and mixtures thereof, and combined with said liquid laundry detergent product at a level, based on total liquid laundry detergent product weight, of from about 0.003 wt. % to about 0.20 wt. %, from about 0.03 wt. % to about 0.20 wt. % or even from about 0.06 wt. % to about 0.14 wt. %.

Carrier—

The compositions generally contain a carrier. In some aspects, the carrier may be water alone or mixtures of organic solvents with water. In some aspects, organic solvents include 1,2-propanediol, ethanol, isopropanol, glycerol and mixtures thereof. Other lower alcohols, $C_1$-$C_4$ alkanolamines such as monoethanolamine and triethanolamine, can also be used. Suitable carriers include, but are not limited to, salts, sugars, polyvinyl alcohols (PVA), modified PVAs; polyvinyl pyrrolidone; PVA copolymers such as PVA/polyvinyl pyrrolidone and PVA/polyvinyl amine; partially hydrolyzed polyvinyl acetate; polyalkylene oxides such as polyethylene oxide; polyethylene glycols; polypropylene oxide, acrylamide; acrylic acid; cellulose, alkyl cellulosics such as methyl cellulose, ethyl cellulose and propyl cellulose; cellulose ethers; cellulose esters; cellulose amides; polycarboxylic acids and salts; polyamino-acids or peptides; polyamides; polyacrylamide; copolymers of maleic/acrylic acids; polysaccharides including starch, modified starch; gelatin; alginates; xyloglucans, other hemicellulosic polysaccharides including xylan, glucuronoxylan, arabinoxylan, mannan, glucomannan and galactoglucomannan; and natural gums such as pectin, xanthan, and carrageenan, locus bean, arabic, tragacanth; and combinations thereof. In one embodiment the polymer comprises polyacrylates, especially sulfonated polyacrylates and water-soluble acrylate copolymers; and alkylhydroxy cellulosics such as methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates. In addition to the carriers provided above, co-polymers of such polymeric materials can serve as carriers. Carriers can be absent, for example, in anhydrous solid forms of the composition, but more typically are present at levels in the range of from about 0.1% to about 99%, from about 10% to about 95%, or from about 25% to about 90%.

Method of Use and Treated Article

Compositions disclosed herein can be used to clean and/or treat a fabric. Typically at least a portion of the fabric is contacted with an embodiment of Applicants' composition, in neat form or diluted in a liquor, for example, a wash liquor and then the fabric may be optionally washed and/or rinsed For purposes of the present invention, washing includes but is not limited to, scrubbing, and mechanical agitation. The fabric may comprise most any fabric capable of being laundered or treated in normal consumer use conditions. Liquors that may comprise the disclosed compositions may have a pH of from about 3 to about 12. Such compositions are typically employed at concentrations of from about 500 ppm to about 15,000 ppm in solution. When the wash solvent is water, the water temperature typically ranges from about 5° C. to about 90° C. and, when the fabric comprises a fabric, the water to fabric ratio is typically from about 1:1 to about 30:1.

In one aspect, a fabric treated with any embodiment of any composition disclosed herein is disclosed.

TEST METHODS

Molecular Weight Distribution

Weight-average molecular weight ($M_w$) values were determined as follows. Sample molecular weights were determined on an Agilent 1260 HPLC system equipped with autosampler, column oven, and refractive index detector. The operating system was OpenLAB CDS ChemStation Workstation (A.01.03). Data storage and analysis were performed with Cirrus GPC offline, GPC/SEC Software for ChemStation, version 3.4. Chromatographic conditions are given in Table 3. In carrying out the calculation, the results were calibrated using polystyrene reference samples having known molecular weights. Measurements of $M_w$ values vary by 5% or less. The molecular weight analyses were determined using a chloroform mobile phase.

TABLE 3

| Parameter | Conditions |
|---|---|
| Column Set | Three ResiPore columns (Agilent #1113-6300) in series with guard column (Agilent #1113-1300)<br>Particle size: 3 μm<br>Column dimensions: 300 × 7.5 mm |
| Mobile Phase | Chloroform |
| Flow Rate | 1 mL/min, needle wash is included |
| Column Temperature | 40° C. |

TABLE 3-continued

| Parameter | Conditions |
|---|---|
| Injection Volume | 20 μL |
| Detector | Refractive Index |
| Detector Temperature | 40° C. |

Table 4 shows the molecular weights and the retention times of the polystyrene standards.

TABLE 4

| Standard Number | Average Reported MW | Retention Time (min) |
|---|---|---|
| 1 | 150,000 | 19.11 |
| 2 | 100,000 | 19.63 |
| 3 | 70,000 | 20.43 |
| 4 | 50,000 | 20.79 |
| 5 | 30,000 | 21.76 |
| 6 | 9,000 | 23.27 |
| 7 | 5,000 | 23.86 |
| 8 | 1,000 | 27.20 |
| 9 | 500 | 28.48 |

Iodine Value

Another aspect of the invention provides a method to measure the iodine value of the glyceride copolymer. The iodine value is determined using AOCS Official Method Cd 1-25 with the following modifications: carbon tetrachloride solvent is replaced with chloroform (25 ml), an accuracy check sample (oleic acid 99%, Sigma-Aldrich; IV=89.86±2.00 cg/g) is added to the sample set, and the reported IV is corrected for minor contribution from olefins identified when determining the free hydrocarbon content of the glyceride copolymer.

Gas Chromatographic Analysis of Fatty Acid Residues in Glyceride Copolymer

The final glyceride oligomer products described in Examples 4, 5, 6, and 7 were analyzed by gas chromatography after olefins were vacuum distilled to below 1% by weight and the resulting oligomer products were transesterified to methyl esters by the following procedure.

A sample 0.10±0.01 g was weighed into a 20 mL scintillation vial. A 1% solution of sodium methoxide in methanol (1.0 mL) was transferred by pipette into the vial and the vial was capped. The capped vial was placed in a sample shaker and shaken at 250 rpm and 60° C. until the sample was completely homogeneous and clear. The sample was removed from the shaker and 5 ml of brine solution followed by 5 ml of ethyl acetate were added by pipette. The vial was vortex mixed for one minute to thoroughly to mix the solution thoroughly. The mixed solution was allowed to sit until the two layers separated. The top (ethyl acetate) layer (1 mL) was transferred to a vial for gas chromatographic analysis. Their normalized compositions, based on a select group of components, are shown in Table 9 in units of wt %.

Gas chromatographic data were collected using an Agilent 6850 instrument equipped with an Agilent DB-WAXETR column (122-7332E, 30 m×250 um×0.25 um film thickness) and a Flame Ionization Detector. The methods and the conditions used are described as follows: The GC method "Fast_FAME.M" was used for the analyses of all samples in Examples 1 through 7.

Method FAST_FAME.M

OVEN
Initial temp: 40° C. (On)
Initial time: 0.00 min
Ramps:

| # | Rate (° C./min) | Final temp (° C.) | Final time (min) |
|---|---|---|---|
| 1 | 20.00 | 240 | 20.00 |
| 2 | 0 (Off) | | |

Post temp: 0° C.
Post time: 0.00 min
Run time: 30.00 min
Maximum temp: 260° C.
Equilibration time: 0.10 min
INLET (SPLIT/SPLITLESS)
Mode: Split
Initial temp: 250° C. (On)
Pressure: 6.06 psi (On)
Split ratio: 150:1
Split flow: 149.9 mL/min
Total flow: 157.5 mL/min
Gas saver: On
Saver flow: 20.0 mL/min
Saver time: 2.00 min
Gas type: Hydrogen
DETECTOR (FID)
Temperature: 300° C. (On)
Hydrogen flow: 40.0 mL/min (On)
Air flow: 450.0 mL/min (On)
Mode: Constant makeup flow
Makeup flow: 30.0 mL/min (On)
Makeup Gas Type: Nitrogen
Flame: On
Electrometer: On
Lit offset: 2.0 pA
COLUMN
Capillary Column
Model Number: DB-WAXETR
Description: 122-7332E
Max temperature: 260° C.
Nominal length: 30.0 m
Nominal diameter: 250.00 um
Nominal film thickness: 0.25 um
Mode: constant flow
Initial flow: 1.0 mL/min
Nominal init pressure: 6.06 psi
Average velocity: 29 cm/sec
Source: Inlet
Outlet: Detector
Outlet pressure: ambient
SIGNAL
Data rate: 20 Hz
Type: detector
Save Data: On
INJECTOR
Sample pre-washes: 3
Sample pumps: 1
Sample volume (uL): 1.000
Syringe size (uL): 10.0
Pre washes from bottle A: 3
Pre washes from bottle B: 3
Post washes from bottle A: 3
Post washes from bottle B: 3
Viscosity delay (seconds): 0
Pre injection dwell (min): 0.00
Post injection dwell (min): 0.00
Sample skim depth (mm): 0.0(Off)
NanoLiter Adapter Installed
Solvent Wash Mode: A, B
Plunger Speed: Fast
Solvent saver: Off The weight percentage of $C_{10-14}$ unsaturated fatty acid esters in the glyceride copolymer is calculated by summing the weight percentages of all $C_{10}$, $C_{11}$, $C_{12}$, $C_{13}$, and $C_{14}$ unsaturated fatty acid esters obtained in the above analysis. The weight percentage of $C_{10-13}$ unsaturated fatty acid esters in the glyceride copolymer is calculated by summing the weight percentages of all $C_{10}$, $C_{11}$, $C_{12}$, and $C_{13}$ unsaturated fatty acid esters obtained in the above analysis. The weight percentage of $C_{10-11}$ unsaturated fatty acid esters in the glyceride copolymer is calculated by summing the weight percentages of all $C_{10}$ and $C_{11}$ unsaturated fatty acid esters obtained in the above analysis.

Free Hydrocarbon Content

Another aspect of this invention provides a method to determine both the free hydrocarbon content of the glyceride copolymer. The method combines gas chromatography/mass spectroscopy (GC/MS) to confirm identity of the free hydrocarbon homologs and gas chromatography with flame ionization detection (GC/FID) to quantify the free hydrocarbon present in the glyceride copolymer.

Sample Prep: The sample to be analyzed was typically trans-esterified by diluting (e.g. 400:1) in methanolic KOH (e.g. 0.1N) and heating in a closed container until the reaction was complete (i.e. 90° C. for 30 min) then cooled to room temperature. The sample solution could then be treated with 15% boron tri-fluoride in methanol and again heated in a closed vessel until the reaction was complete (i.e. at 60° C. for 30 min.) both to acidify (methyl orange—red) and to methylate any free acid present in the sample. After allowing to cool to room temperature, the reaction was quenched by addition of saturated NaCl in water. An organic extraction solvent such as cyclohexane containing a known level internal standard (e.g. 150 ppm dimethyl adipate) was then added to the vial and mixed well. After the layers separated, a portion of the organic phase was transferred to a vial suitable for injection to the gas chromatograph. This sample extraction solution was analyzed by GC/MS to confirm identification of peaks matching hydrocarbon retention times by comparing to reference spectra and then by GC/FID to calculate concentration of hydrocarbons, fatty acid, and fatty diacid by comparison to standard FID response factors.

A hydrocarbon standard of known concentrations, such as 50 ppm each, of typically observed hydrocarbon compounds (i.e. 1-dodecene, 1-tridecene, 1-tetradecene, 1-pentadecene, 1-hexadecene, 1-heptadecene, 1-octadecene, dodecane, tridecane, tetradecane, pentadecane, hexadecane, heptadecane and octadecane) was prepared by dilution in the same solvent containing internal standard as was used to extract the sample reaction mixture. This hydrocarbon standard was analyzed by GC/MS to generate retention times and reference spectra and then by GC/FID to generate retention times and response factors.

GC/MS: An Agilent 7890 GC equipped with a split/splitless injection port coupled with a Waters QuattroMicroGC mass spectrometer set up in EI+ ionization mode was used to carry out qualitative identification of peaks observed. A non-polar DB1-HT column (15 m×0.25 mm×0.1 um df) was installed with 1.4 mL/min helium carrier gas. In separate runs, 1 uL of the hydrocarbon standard and the sample extract solution were injected to a 300° C. injection port with a split ratio of 25:1. The oven was held at 40° C. for 1 minute then ramped 15 C.°/minute to a final temperature of 325° C. which was held for 10 minutes resulting in a total run time of 30 minutes. The transfer line was kept at 330° C. and the temperature of the EI source was 230° C. The ionization energy was set at 70 eV and the scan range was 35-550 m/z.

GC/FID: An Agilent 7890 GC equipped with a split/splitless injection port and a flame ionization detector was used for quantitative analyses. A non-polar DB1-HT column (5 m×0.25 mm×0.1 um df) was installed with 1.4 mL/min helium carrier gas. In separate runs, 1 uL of the hydrocarbon standard and the sample extract solution was injected to a 330° C. injection port with a split ratio of 100:1. The oven was held at 40° C. for 0.5 minutes then ramped at 40 C.°/minute to a final temperature of 380° C. which was held for 3 minutes resulting in a total run time of 12 minutes. The FID was kept at 380° C. with 40 mL/minute hydrogen gas flow and 450 mL/min air flow. Make up gas was helium at 25 mL/min. The hydrocarbon standard was used to create calibration tables in the Chemstation Data Analysis software including known concentrations to generate response factors. These response factors were applied to the corresponding peaks in the sample chromatogram to calculate total amount of free hydrocarbon found in each sample.

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Non-limiting examples of product formulations disclosed in the present specification are summarized below.

Example 1—Reaction with Butenylyzed Canola Oil (BCO): Effect of BCO Content

The experimental apparatus consisted of a three-necked round-bottom flask equipped with a magnetic stir bar, a septum cap, and an outlet to a vacuum system. External heating was provided via a silicone oil bath. The septum was used to add metathesis catalyst and withdraw samples. The vacuum system consisted of a TEFLON diaphragm pump and a pressure controller.

Butenylyzed canola oil (BCO) was made by cross-metathesizing canola oil (Wesson) with 1-butene (1 mol of 1-butene per mol of C=C double bonds in the oil) according to the methods described in U.S. Pat. No. 8,957,268. The BCO was mixed with canola oil (Wesson) and charged to a 500-mL round-bottom flask. The oil mixture was purged with nitrogen gas (Airgas, UHP) for about 15 minutes. The reaction flask was heated to about 70° C. and evacuated to the desired pressure (see below: 200 or 450 torr absolute.) A toluene (Sigma-Aldrich, anhydrous 99.8%) solution of C827 metathesis catalyst (10 mg/mL; Materia, Inc., Pasadena, Calif., USA) was added to the oil mixture to achieve a catalyst level of 100 ppmwt. The reaction was held at 70° C. while maintaining a dynamic vacuum at the desired pressure for 2 hours. A small sample of the reaction mixture was removed by syringe, quenched with ethyl vinyl ether (Sigma-Aldrich), and analyzed by GPC to determine the weight-average molecular weight ($M_w$) of the resulting glyceride oligomers.

Table 5 shows the resulting weight average $M_w$ for 13 different reactions, where the percentage of BCO was increased. The percentage of BCO reported is a weight percentage of BCO relative to the total weight of oil (BCO and canola oil combined). The weight average molecular weights are reported in units of g/mol.

TABLE 5

| Percentage BCO (wt %) | $M_w$ 450 Torr (absolute) Experiments | $M_w$ 200 Torr (absolute) Experiments |
|---|---|---|
| 0 | 11,700 | 12,300 |
| 10 | 12,800 | 13,100 |
| 30 | 13,600 | 14,800 |
| 50 | 14,400 | 18,000 |
| 70 | 14,100 | 22,500 |
| 90 | 14,500 | — |
| 100 | 25,900 | 56,600 |

Example 2—Reaction with Butenylyzed Canola Oil (BCO): Effect of Reaction Time

Using the same apparatus and procedures as those described in Example 1, 50 wt %/50 wt % mixtures of BCO and canola oil were reacted for four hours while maintaining a dynamic vacuum at either 200 or 450 torr (absolute) with samples being taken hourly. Table 6 shows the weight averaged molecular weight ($M_w$) over time. The molecular weight ($M_w$) is reported in units of g/mol.

TABLE 6

| Time (hr) | $M_w$ 450 Torr (absolute) Experiments | $M_w$ 200 Torr (absolute) Experiments |
|---|---|---|
| 1 | 13,600 | 16,100 |
| 2 | 13,600 | 18,000 |
| 3 | 13,100 | 19,000 |
| 4 | 13,000 | 20,000 |

Example 3—Cross-Metathesis of Canola Oil with Butenylyzed Palm Oil (BPO): Effect of Feedstock Composition Using the same apparatus and procedures as those described in Example 1, mixtures of BPO (Wilmar) and palm oil were reacted for two hours. Table 7 shows the molecular weight (Mw) after two hours. The molecular weight ($M_w$) is reported in units of g/mol.

TABLE 7

| Percentage BPO (wt %) | $M_w$ 200 Torr (absolute) Experiment |
|---|---|
| 15 | 9,400 |
| 25 | 8,100 |
| 35 | 5,900 |

Example 4—Canola Oil Self-Metathesis (Comparative Example)

Using the same apparatus (except that a two-stage rotary vane pump was used for experiments run under dynamic vacuums of less than 10 torr absolute and procedure described in Example 1, canola oil was reacted for two hours. Table 8 shows the molecular weight ($M_w$) after two hours. The molecular weight ($M_w$) is reported in units of g/mol.

TABLE 8

| Absolute Pressure (Torr) | 100-g Scale ($M_w$) | 1-kg Scale ($M_w$) |
|---|---|---|
| 450 | 11,700 | — |
| 200 | 12,300 | — |
| 75 | 12,600 | — |
| 8 | 14,500 | 13,600 |
| 3.2 | — | 15,100 |
| 2.5 | — | 15,900 |

A portion (473 g) of the product from the 1 kg experiment run at 2.5 torr was diluted with heptane (BDH, laboratory reagent, 500 mL). Magnesol-600-R (Dallas Group of Am., 10 g) was added and the resulting mixture was stirred under nitrogen at ambient temperature for 30 minutes. The Magnesol-600-R was removed by vacuum filtration. A fresh charge of Magnesol-600-R (10 g) was added and the resulting mixture was stirred under nitrogen at ambient temperature for 30 minutes. Heptane was removed by rotovap. Olefins were removed by vacuum distillation in a 1 L three-neck round-bottom equipped with a short-path distillation head; a condenser chilled to 5° C.; a 20 mL round bottom flask chiller with dry-ice/isopropanol; a magnetic stir bar; and thermometers to measure liquid temperature and vapor temperature. Heating was supplied through a resistive heating mantle Vacuum was supplied by a two-stage rotary vane vacuum pump. The bulk of olefinic material was removed by gradually increasing the heat input. A very small nitrogen purge was maintained on the system for the initial part of the distillation. The final pressure was about 0.1 torr absolute and the final liquid temperature was 192° C. The olefin content was less than 1% by mass. A sample of the final product was trans-esterified and analyzed by GC to determine the Fatty Acid Residues as described above. See Table 9 (below).

Example 5—Cross-Metathesis of Canola with Butenylyzed Canola Oil (BCO) on One-Kilogram Scale with Catalyst Removal and Olefin Stripping Using a similar metathesis procedure and apparatus to the one described in Example 1, a 1 kg mixture of BCO and canola oil (50 wt %/50 wt %) was reacted for two hours. Catalyst removal was accomplished by THMP treatment. THMP treatments consisted of adding 1 M tris(hydroxymethyl)phosphine (THMP, 1.0 M, 50 mol THMP/mol C827) in water, stirring at ambient temperature for 2 hours, and then washing the product with water (2×100 mL) in a separatory funnel. Olefin by-products and traces of residual water were removed from the product by the same procedure and distillation apparatus as described in Example 4 except that no nitrogen purge was used. The final pressure was about 0.2 torr absolute and the final liquid temperature was 195° C. The olefin content was less than 1% by mass and the $M_w$ of the glyceride oligomer was 16,700 g/mol. A sample of the final product was trans-esterified and analyzed by GC to determine the Fatty Acid Residues as described above. See Table 9 (below).

Example 6—Cross-Metathesis of Soybean Oil with Butenylyzed Soybean Oil (BSO) on a Two-Kilogram Scale with Catalyst Removal and Olefin Stripping Using the same procedure and an apparatus similar to that described in Example 1 except that a 3 L flask was used in place of the 500 mL flask, a 1 kg, 50/50 wt % mixture of butenylyzed soybean oil and soybean oil (Costco) was reacted for about four hours using 100 ppm wt C827 catalyst. An additional 40 ppm of catalyst was added and after about two more hours the reaction was quenched with ethyl vinyl ether. Olefin by-products and traces of residual water were removed from a 265 g sample of the product by a similar distillation procedure and apparatus as described in Example 5. The final pressure was about 0.1 torr absolute and the final liquid temperature was 195° C. The olefin content was less than 1% by mass. A sample of the final product was trans-esterified and analyzed by GC to determine the Fatty Acid Residues as described above. See Table 9 (below).

Example 7—Cross-Metathesis of Canola Oil with Butenylyzed Canola Oil (BCO) on a Twelve-Kilogram Scale with Catalyst Removal and Olefin Stripping This example was conducted in a 5 gallon Stainless Steel Reactor (Parr) equipped with an impeller, a port for air-free catalyst addition, and a Strahman valve for sampling. The reactor system was completely purged with nitrogen before beginning.

The BCO (6.16 kg) was produced by a procedure similar to that used in Example 1 and mixed with canola oil (6.12 kg) and charged to the reactor. The oil mixture was stirred at 200 rpm while purging with nitrogen gas for about 30 minutes through a dip tube at a rate of 0.5 SCFM. The reactor was evacuated to 200 torr (absolute) and heated to 70° C. The C827 metathesis catalyst (1.0 g, Materia, Inc., Pasadena, Calif., USA) was suspended in canola oil (50 mL) and added to the oil mixture. The reaction was maintained at 70° C. and at 200 torr for four hours. An additional charge of C827 catalyst (0.25 g) suspended in canola oil (50 mL) was added to the reaction. After an additional two hours, the reactor was back filled with nitrogen.

Catalyst removal was conducted in a 5 gallon jacketed glass reactor equipped with an agitator, a bottom drain valve, and ports for adding reagents. A 0.12 M aqueous solution of THMP (0.31 kg) was charged to the glass reactor and pre-heated to about 90° C. The crude metathesis reaction product, still at 70° C., was transferred to the glass reactor and the mixture was stirred (150 rpm) at about 80-90° C. for 20 minutes. The following wash procedure was done twice. Deionized water (1.9 kg at 60° C.) was added to the reactor which was heated to 80-90° C. and the resulting mixture was stirred (100 rpm) for 20 minutes. The stirrer was stopped and the reactor contents were allowed to settle for 16 hours at a constant temperature of 80-90° C. The bottom aqueous layer was carefully drained off. Following the second wash, the washed product was cooled and then drained to a container.

The washed product was divided into two portions to remove olefins and residual water, which was done using a similar distillation procedure and apparatus as described in Example 5. The final distillation pressure was about 0.1 torr absolute and the final liquid temperature was about 190° C. Following distillation, the two portions were recombined. A small sample of the recombined product was trans-esterified and analyzed by GC to determine the Fatty Acid Residues as described above. See Table 9 (below).

The fatty acid residues in the final glyceride oligomer products produced in examples 4, 5, 6, and 7 were analyzed by the method described above after olefins were vacuum distilled to below 1% by weight. The $C_{10-14}$ unsaturated fatty acid esters, $C_{10-13}$ unsaturated fatty acid esters, and $C_{10-11}$ unsaturated fatty acid esters were calculated and are reported in Table 10.

TABLE 9

| Fatty Acid Methyl Ester Component | Example 4 Product (wt %) | Example 5 Product (wt %) | Example 6 Product (wt %) | Example 7 Product (wt %) |
|---|---|---|---|---|
| C10:1 | — | 6.72 | 2.97 | 4.58 |
| C12:1 | 1.74 | 7.33 | 4.77 | 6.25 |
| C13:2 | — | 1.33 | 0.71 | 0.72 |
| C15:1 | 8.53 | 5.05 | 12.21 | 5.05 |
| C16:0 | 5.89 | 6.12 | 14.69 | 5.65 |
| C16:1 | 1.97 | 1.08 | 0.43 | 1.06 |
| C18:0 | 2.53 | 2.65 | 6.05 | 2.58 |
| C18:1 | 35.87 | 19.52 | 6.31 | 19.80 |
| C18:2 | 0.80 | 1.33 | 3.46 | 0.89 |
| C18:3 | 0.64 | 0.39 | 0.42 | 0.27 |
| C20:0 | 1.30 | 0.85 | 0.48 | 0.90 |
| C20:1 | 2.10 | 1.08 | 0.29 | 1.15 |
| C21:2 | 2.82 | 3.59 | 1.76 | 3.61 |
| C22:0 | 0.53 | 0.56 | 0.08 | 0.60 |
| C18:1 diester | 26.80 | 29.10 | 21.84 | 29.85 |
| C20:1 diester | 3.09 | 3.11 | 1.02 | 3.08 |
| C21:2 diester | 1.00 | 5.10 | 6.40 | 4.95 |

TABLE 10

| Unsaturated Fatty Acid Ester Component | Example 4 Product (wt %) | Example 5 Product (wt %) | Example 6 Product (wt %) | Example 7 Product (wt %) |
|---|---|---|---|---|
| $C_{10-14}$ unsaturated fatty acid esters | 1.74 | 15.38 | 8.45 | 11.55 |
| $C_{10-13}$ unsaturated fatty acid esters | 1.74 | 15.38 | 8.45 | 11.55 |
| $C_{10-11}$ unsaturated fatty acid esters | — | 6.72 | 2.97 | 4.58 |

Example 8—Diene-Selective Hydrogenation of Crude Glyceride Polymer

In a 600 mL Parr reactor, 170 g of crude metathesis product from Example 6, 170 g of n-decane (Sigma-Aldrich, anhydrous, >99%), and 0.60 g PRICAT 9908 (Johnson Matthey Catalysts); saturated triglyceride wax removed before reaction via a toluene wash) were purged with $N_2$, then $H_2$, for 15 minutes each, then reacted at 160° C. under 100 psig $H_2$ (Airgas, UHP) with 1000 rpm stirring with a gas dispersion impeller. The $H_2$ pressure was monitored and the reactor was refilled to 100 psig when it decreased to about 70 psig. After six hours, the reaction was cooled below 50° C. and the hydrogen was displaced by nitrogen gas. The reaction mixture was vacuum filtered through diatomaceous earth to remove the catalyst solids. Olefin by-products and n-decane were removed from the product by a similar distillation procedure and apparatus as described in Example 5. The final distillation pressure was about 0.1 torr absolute and the final liquid temperature was 195° C. The olefin content was less than 1% by mass. A sample of the final product was trans-esterified with methanol and analyzed by GC. The level of polyunsaturated C18 fatty acid methyl esters (C18:2 plus C18:3) were reduced from 3.88% in the starting material to 1.13% and the C21:2 diester was reduced from 6.40% in the starting material to 3.72%.

Examples 9: Liquid Fabric Enhancer

Fabric Softener compositions are prepared by mixing together ingredients shown below:

| | EXAMPLE COMPOSITION | | | | | | |
|---|---|---|---|---|---|---|---|
| | A | B | C | D | E | F | G |
| Fabric Softener Active[1] | 10 | 8 | 11 | 8.1 | 6.8 | | |
| Fabric Softener Active[2] | | | | | | 8.1 | 6.8 |
| Fabric Softener Active[3] | | | | | | | |
| Fabric Softener Active[4] | | | | | | | |
| Low molecular weight alcohol[5] | 1.0 | 0.8 | 1.1 | 0.81 | 0.68 | 0.81 | 0.68 |
| Quaternized polyacrylamide[6] | 0.175 | 0.175 | 0.175 | 0.14 | 0.14 | 0.14 | 0.14 |
| Calcium chloride | 0-0.3 | 0-0.3 | 0-0.3 | 0-0.3 | 0-0.3 | 0-0.3 | 0-0.3 |
| Glyceride copolymer according to Examples 1-8 (mixtures thereof may also be used) | 4 | 6 | 3 | 3.1 | 4.4 | 3.1 | 4.4 |
| Water soluble dialkyl quat[7] | 1.0 | 2.0 | .2 | 0.2 | 0.2 | 0.2 | 0.2 |
| Perfume | 1.75 | 1.75 | 1.75 | 1.25 | 1.25 | 1.25 | 1.25 |
| Perfume microcapsule[8] | 0.138 | 0.138 | 0.138 | 0.3 | 0.3 | 0.3 | 0.3 |
| Amino-functional organosiloxane polymer[9] | | | | | | | |
| Water, emulsifiers, suds suppressor, stabilizers, preservative, antioxidant, chelant, pH control agents, buffers, dyes & other optional ingredients | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 |

| | EXAMPLE COMPOSITION | | | | | | |
|---|---|---|---|---|---|---|---|
| | H | I | J | K | L | M | N |
| Fabric Softener Active[1] | | | | | 6.25 | 5.75 | 6.9 |
| Fabric Softener Active[2] | | | | | | | |
| Fabric Softener Active[3] | 8.1 | 6.8 | | | | | |
| Fabric Softener Active[4] | | | 8.1 | 6.8 | | | |
| Low molecular weight alcohol[5] | 0.81 | 0.68 | 0.81 | 0.68 | 0.63 | 0.58 | 0.69 |
| Quaternized polyacrylamide[6] | 0.14 | 0.14 | 0.14 | 0.14 | 0.14 | 0.14 | 0.14 |
| Calcium chloride | | | | | | | |
| Ammonium chloride | | | | | | | |
| Suds Suppressor[6] | | | | | | | |
| Glyceride copolymer according to Examples 1-8 (mixtures thereof may also be used) | 3.1 | 4.4 | 3.1 | 4.4 | 4.1 | 3.75 | 2.6 |
| Water soluble dialkyl quat[7] | 0.2 | 0.2 | 0.2 | 0.2 | 0.2 | 0.2 | 0.2 |
| Perfume | 1.25 | 1.25 | 1.25 | 1.25 | 1.25 | 1.25 | 1.25 |
| Perfume microcapsule[8] | 0.3 | 0.3 | 0.3 | 0.3 | 0.3 | 0.3 | 0.3 |
| Amino-functional organosiloxane polymer[9] | | | | | | | |
| Water, emulsifiers, suds suppressor, stabilizers, preservative, antioxidant, chelant, pH control agents, buffers, dyes & other optional ingredients | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 |

| | EXAMPLE COMPOSITION | | | | | | |
|---|---|---|---|---|---|---|---|
| | O | P | Q | R | S | T | U |
| Fabric Softener Active[1] | 7.4 | 5.5 | 4.4 | 7.1 | 5.9 | 9.0 | 7.8 |
| Fabric Softener Active[2] | | | | | | | |
| Fabric Softener Active[3] | | | | | | | |
| Fabric Softener Active[4] | | | | | | | |
| Low molecular weight alcohol[5] | 0.74 | 0.55 | 0.44 | 0.71 | 0.59 | 0.90 | 0.78 |
| Quaternized polyacrylamide[6] | 0.175 | 0.175 | 0.14 | 0.14 | 0.14 | 0.14 | 0.14 |
| Calcium chloride | | | | | | | |
| Ammonium chloride | | | | | | | |
| Glyceride copolymer according to Examples 1-8 (mixtures thereof may also be used) | 5.6 | 5.5 | 4.4 | 1.8 | 3.5 | 1.1 | 2.2 |
| Water soluble dialkyl quat[7] | 2.3 | 3.0 | 0.2 | 0.2 | 0.2 | 0.2 | 0.2 |
| Perfume | 1.75 | 1.75 | 1.25 | 1.25 | 1.25 | 1.25 | 1.25 |
| Perfume microcapsule[8] | 0.138 | 0.138 | 0.3 | 0.3 | 0.3 | 0.3 | 0.3 |
| Amino-functional organosiloxane polymer[9] | 1.0 | 3.0 | 2.4 | 2.4 | 1.8 | 1.2 | 1.2 |

-continued

| | | | | | | | |
|---|---|---|---|---|---|---|---|
| Water, emulsifiers, suds suppressor, stabilizers, preservative, antioxidant, chelant, pH control agents, buffers, dyes & other optional ingredients | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 | q.s. to 100% pH = 3.0 |

[1]N,N-di(alkanoyloxyethyl)-N,N-dimethylammonium chloride where alkyl consists predominatly of C16-C18 alkyl chains with an IV value of about 20 available from Evonik
[2]Methyl bis[ethyl(tallowate)]-2- hydroxyethyl ammonium methyl sulfate available from Stepan
[3]N,N-di(alkanoyloxyethyl)-N,N-dimethylammonium chloride where alkyl consists of C16-C18 alkyl chains with an IV value of about 52 available from Evonik
[4]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N-hydroxyethyl N,N-dimethylammonium chloride available from Evonik Corporation, Hopewell, VA.
[5]Low molecular weight alcohol such as ethanol or isopropanol
[6]Cationic polyacrylamide polymer such as a copolymer of acrylamide/[2-(acryloylamino)ethyl]tri-methylammonium chloride (quaternized dimethyl aminoethyl acrylate) available from BASF, AG, Ludwigshafen under the trade name Rheovis CDX.
[7]Didecyl dimethyl ammonium chloride under the trade name Bardac ® 2280 or Hydrogenated tallowalkyl(2-ethylhexyl)dimethyl ammonium methylsulfate from AkzoNobel under the trade name Arquad ® HTL8-MS
[8]Perfume microcapsules available ex Appleton Papers, Inc.
[9]Propoxylated Amino-functional organosiloxane polymer as described in U.S. Pat. No. 8,748,646

The composition provided by the formula above is made by combining such ingredients in accordance with the method of making provided in this specification.

Examples 10

Granular laundry detergent compositions for hand washing or washing machines, typically top-loading washing machines.

| | A (wt %) | B (wt %) | C (wt %) | D (wt %) | E (wt %) | F (wt %) |
|---|---|---|---|---|---|---|
| Linear alkylbenzenesulfonate | 20 | 22 | 20 | 15 | 19.5 | 20 |
| $C_{12-14}$ Dimethylhydroxyethyl ammonium chloride | 0.7 | 0.2 | 1 | 0.6 | 0.0 | 0 |
| AE3S | 0.9 | 1 | 0.9 | 0.0 | 0.4 | 0.9 |
| AE7 | 0.0 | 0.0 | 0.0 | 1 | 0.1 | 3 |
| Sodium tripolyphosphate | 5 | 0.0 | 4 | 9 | 2 | 0.0 |
| Zeolite A | 0.0 | 1 | 0.0 | 1 | 4 | 1 |
| 1.6R Silicate ($SiO_2$:$Na_2O$ at ratio 1.6:1) | 7 | 5 | 2 | 3 | 3 | 5 |
| Sodium carbonate | 25 | 20 | 25 | 17 | 18 | 19 |
| Polyacrylate MW 4500 | 1 | 0.6 | 1 | 1 | 1.5 | 1 |
| Random graft copolymer[1] | 0.1 | 0.2 | 0.0 | 0.0 | 0.05 | 0.0 |
| Carboxymethyl cellulose | 1 | 0.3 | 1 | 1 | 1 | 1 |
| Stainzyme ® (20 mg active/g) | 0.1 | 0.2 | 0.1 | 0.2 | 0.1 | 0.1 |
| Protease (Savinase ®, 32.89 mg active/g) | 0.1 | 0.1 | 0.1 | 0.1 | | 0.1 |
| Amylase-Natalase ® (8.65 mg active/g) | 0.1 | 0.0 | 0.1 | 0.0 | 0.1 | 0.1 |
| Lipase-Lipex ® (18 mg active/g) | 0.03 | 0.07 | 0.3 | 0.1 | 0.07 | 0.4 |
| Glyceride copolymer according to Examples 1-8 (mixtures thereof may also be used) | 1-10 | 1-10 | 1-10 | 1-10 | 1-10 | 1-10 |
| Fluorescent Brightener 1 | 0.06 | 0.0 | 0.06 | 0.18 | 0.06 | 0.06 |
| Fluorescent Brightener 2 | 0.1 | 0.06 | 0.1 | 0.0 | 0.1 | 0.1 |
| DTPA | 0.6 | 0.8 | 0.6 | 0.25 | 0.6 | 0.6 |
| $MgSO_4$ | 1 | 1 | 1 | 0.5 | 1 | 1 |
| Sodium Percarbonate | 0.0 | 5.2 | 0.1 | 0.0 | 0.0 | 0.0 |
| Sodium Perborate Monohydrate | 4.4 | 0.0 | 3.85 | 2.09 | 0.78 | 3.63 |
| NOBS | 1.9 | 0.0 | 1.66 | 0.0 | 0.33 | 0.75 |
| TAED | 0.58 | 1.2 | 0.51 | 0.0 | 0.015 | 0.28 |
| Sulphonated zinc phthalocyanine | 0.0030 | 0.0 | 0.0012 | 0.0030 | 0.0021 | 0.0 |
| S-ACMC | 0.1 | 0.0 | 0.0 | 0.0 | 0.06 | 0.0 |
| Direct Violet Dye (DV9 or DV99 or DV66) | 0.0 | 0.0 | 0.0003 | 0.0001 | 0.0001 | 0.0 |
| Neat Perfume (1) | 0.5 | 0.5 | 0.5 | 0.5 | 0.5 | 0.5 |
| Perfume Microcapsules (2) | 0.7 | 1.0 | 2.3 | 0.5 | 1.2 | 0.8 |
| Sulfate/Moisture | | | Balance | | | |

(1) Optional.
(2) Available from Appleton Paper of Appleton, WI

The composition provided by the formula above is made by combining such ingredients in accordance with the method of making provided in this specification.

Examples 11

Granular laundry detergent compositions typically for front-loading automatic washing machines.

| | A (wt %) | B (wt %) | C (wt %) | D (wt %) | E (wt %) | F (wt %) |
|---|---|---|---|---|---|---|
| Linear alkylbenzenesulfonate | 8 | 7.1 | 7 | 6.5 | 7.5 | 7.5 |
| AE3S | 0 | 4.8 | 1.0 | 5.2 | 4 | 4 |
| $C_{12-14}$ Alkylsulfate | 1 | 0 | 1 | 0 | 0 | 0 |
| AE7 | 2.2 | 0 | 2.2 | 0 | 0 | 0 |
| $C_{10-12}$ Dimethyl hydroxyethylammonium chloride | 0.75 | 0.94 | 0.98 | 0.98 | 0 | 0 |
| Crystalline layered silicate ($\delta$-$Na_2Si_2O_5$) | 4.1 | 0 | 4.8 | 0 | 0 | 0 |
| Zeolite A | 5 | 0 | 5 | 0 | 2 | 2 |
| Citric Acid | 3 | 5 | 3 | 4 | 2.5 | 3 |
| Sodium Carbonate | 15 | 20 | 14 | 20 | 23 | 23 |
| Silicate 2R ($SiO_2$:$Na_2O$ at ratio 2:1) | 0.08 | 0 | 0.11 | 0 | 0 | 0 |
| Soil release agent | 0.75 | 0.72 | 0.71 | 0.72 | 0 | 0 |
| Acrylic Acid/Maleic Acid Copolymer | 1.1 | 3.7 | 1.0 | 3.7 | 2.6 | 3.8 |
| Carboxymethylcellulose | 0.15 | 1.4 | 0.2 | 1.4 | 1 | 0.5 |
| Protease-Purafect ® (84 mg active/g) | 0.2 | 0.2 | 0.3 | 0.15 | 0.12 | 0.13 |
| Amylase-Stainzyme Plus ® (20 mg active/g) | 0.2 | 0.15 | 0.2 | 0.3 | 0.15 | 0.15 |
| Lipase-Lipex ® (18.00 mg active/g) | 0.05 | 0.15 | 0.1 | 0 | 0 | 0 |
| Amylase-Natalase ® (8.65 mg active/g) | 0.1 | 0.2 | 0 | 0 | 0.15 | 0.15 |
| Cellulase-Celluclean ™ (15.6 mg active/g) | 0 | 0 | 0 | 0 | 0.1 | 0.1 |
| TAED | 3.6 | 4.0 | 3.6 | 4.0 | 2.2 | 1.4 |
| Percarbonate | 13 | 13.2 | 13 | 13.2 | 16 | 14 |
| Na salt of Ethylenediamine-N,N'-disuccinic acid, (S,S) isomer (EDDS) | 0.2 | 0.2 | 0.2 | 0.2 | 0.2 | 0.2 |
| Hydroxyethane di phosphonate (HEDP) | 0.2 | 0.2 | 0.2 | 0.2 | 0.2 | 0.2 |
| $MgSO_4$ | 0.42 | 0.42 | 0.42 | 0.42 | 0.4 | 0.4 |
| Perfume | 0.5 | 0.6 | 0.5 | 0.6 | 0.6 | 0.6 |
| Suds suppressor agglomerate | 0.05 | 0.1 | 0.05 | 0.1 | 0.06 | 0.05 |
| Soap | 0.45 | 0.45 | 0.45 | 0.45 | 0 | 0 |
| Sulphonated zinc phthalocyanine (active) | 0.0007 | 0.0012 | 0.0007 | 0 | 0 | 0 |
| S-ACMC | 0.01 | 0.01 | 0 | 0.01 | 0 | 0 |
| Direct Violet 9 (active) | 0 | 0 | 0.0001 | 0.0001 | 0 | 0 |
| Neat Perfume [1] | 0.5 | 0.5 | 0.5 | 0.5 | 0.5 | 0.5 |
| Perfume Microcapsules [2] | 2.0 | 1.5 | 0.9 | 2.2 | 1.5 | 0.8 |
| Glyceride copolymer according to Examples 1-8 (mixtures thereof may also be used) | 1-10 | 1-10 | 1-10 | 1-10 | 1-10 | 1-10 |
| Sulfate/Water & Miscellaneous | | | Balance | | | |

[1] Optional.

[2] Available from Appleton Paper of Appleton, WI

The typical pH is about 10.

The composition provided by the formula above is made by combining such ingredients in accordance with the method of making provided in this specification.

Examples 12 Heavy Duty Liquid Laundry Detergent Compositions

| | A (wt %) | B (wt %) | C (wt %) | D (wt %) | E (wt %) | F (wt %) | G (wt %) |
|---|---|---|---|---|---|---|---|
| AES $C_{12-15}$ alkyl ethoxy (1.8) sulfate | 11 | 10 | 4 | 6.32 | 0 | 0 | 0 |
| AE3S | 0 | 0 | 0 | 0 | 2.4 | 0 | 0 |
| Linear alkyl benzene sulfonate/sulfonic acid | 1.4 | 4 | 8 | 3.3 | 5 | 8 | 19 |
| HSAS | 3 | 5.1 | 3 | 0 | 0 | 0 | 0 |
| Sodium formate | 1.6 | 0.09 | 1.2 | 0.04 | 1.6 | 1.2 | 0.2 |
| Sodium hydroxide | 2.3 | 3.8 | 1.7 | 1.9 | 1.7 | 2.5 | 2.3 |
| Monoethanolamine | 1.4 | 1.49 | 1.0 | 0.7 | 0 | 0 | To pH 8.2 |
| Diethylene glycol | 5.5 | 0.0 | 4.1 | 0.0 | 0 | 0 | 0 |
| AE9 | 0.4 | 0.6 | 0.3 | 0.3 | 0 | 0 | 0 |
| AE8 | 0 | 0 | 0 | 0 | 0 | 0 | 20.0 |
| AE7 | 0 | 0 | 0 | 0 | 2.4 | 6 | 0 |
| Chelant (HEDP) | 0.15 | 0.15 | 0.11 | 0.07 | 0.5 | 0.11 | 0.8 |
| Citric Acid | 2.5 | 3.96 | 1.88 | 1.98 | 0.9 | 2.5 | 0.6 |
| $C_{12-14}$ dimethyl Amine Oxide | 0.3 | 0.73 | 0.23 | 0.37 | 0 | 0 | 0 |
| $C_{12-18}$ Fatty Acid | 0.8 | 1.9 | 0.6 | 0.99 | 1.2 | 0 | 15.0 |
| 4-formyl-phenylboronic acid | 0 | 0 | 0 | 0 | 0.05 | 0.02 | 0.01 |
| Borax | 1.43 | 1.5 | 1.1 | 0.75 | 0 | 1.07 | 0 |
| Ethanol | 1.54 | 1.77 | 1.15 | 0.89 | 0 | 3 | 7 |
| A compound having the following general structure: $bis((C_2H_5O)(C_2H_4O)_n)(CH_3)—N^+—C_xH_{2x}—N^+—(CH_3)—bis((C_2H_5O)(C_2H_4O)_n)$, wherein n = from 20 to 30, and x = from 3 to 8, or sulphated or sulphonated variants thereof | 0.1 | 0 | 0 | 0 | 0 | 0 | 2.0 |
| Ethoxylated ($EO_{15}$) tetraethylene pentamine | 0.3 | 0.33 | 0.23 | 0.17 | 0.0 | 0.0 | 0 |
| Ethoxylated Polyethylenimine | 0 | 0 | 0 | 0 | 0 | 0 | 0.8 |
| Ethoxylated hexamethylene diamine | 0.8 | 0.81 | 0.6 | 0.4 | 1 | 1 | 0 |
| 1,2-Propanediol | 0.0 | 6.6 | 0.0 | 3.3 | 0.5 | 2 | 8.0 |
| Fluorescent Brightener | 0.2 | 0.1 | 0.05 | 0.3 | 0.15 | 0.3 | 0.2 |
| Hydrogenated castor oil derivative structurant | 0.1 | 0 | 0 | 0 | 0 | 0 | 0.1 |
| Perfume | 1.6 | 1.1 | 1.0 | 0.8 | 0.9 | 1.5 | 1.6 |
| Protease (40.6 mg active/g) | 0.8 | 0.6 | 0.7 | 0.9 | 0.7 | 0.6 | 1.5 |
| Mannanase: Mannaway ® (25 mg active/g) | 0.07 | 0.05 | 0.045 | 0.06 | 0.04 | 0.045 | 0.1 |
| Amylase: Stainzyme ® (15 mg active/g) | 0.3 | 0 | 0.3 | 0.1 | 0 | 0.4 | 0.1 |
| Amylase: Natalase ® (29 mg active/g) | 0 | 0.2 | 0.1 | 0.15 | 0.07 | 0 | 0.1 |
| Xyloglucanase (Whitezyme ®, 20 mg active/g) | 0.2 | 0.1 | 0 | 0 | 0.05 | 0.05 | 0.2 |
| Lipex ® (18 mg active/g) | 0.4 | 0.2 | 0.3 | 0.1 | 0.2 | 0 | 0 |
| Neat Perfume (1) | 0.5 | 0.5 | 0.5 | 0.5 | 0.5 | 0.5 | 0.5 |
| Perfume Microcapsules (2) | 0.25 | 3.2 | 2.5 | 4.0 | 2.5 | 1.4 | 0.8 |
| Polyquaternium-7 (3) | 0-1 | 0-1 | 0-1 | 0-1 | 0-1 | 0-1 | 0-1 |
| Polyquaternium-10 (4) | 0-1 | 0-1 | 0-1 | 0-1 | 0-1 | 0-1 | 0-1 |
| Glyceride copolymer according to Examples 1-8 (mixtures thereof may also be used) | 1-10 | 1-10 | 1-10 | 1-10 | 1-10 | 1-10 | 1-10 |
| Water, emulsifiers, dyes & minors | Balance to 100% | | | | | | |

(1) Optional.

(2) Available from Appleton Paper of Appleton, WI (3) Available from BASF, Ludwigshafen (4) Available from Dow Chemicals under the tradename Polymer PK or LR400

The composition provided by the formula above is made by combining such ingredients in accordance with the method of making provided in this specification.

Examples 13 Unit Dose Compositions

| Example of Unit Dose detergents | A | B |
|---|---|---|
| $C_{14-15}$ alkyl poly ethoxylate (8) | 12 | — |
| $C_{12-14}$ alkyl poly ethoxylate (7) | 1 | 14 |
| $C_{12-14}$ alkyl poly ethoxylate (3) sulfate Mono EthanolAmine salt | 8.4 | 9 |
| Linear Alkylbenzene sulfonic acid | 15 | 16 |
| Citric Acid | 0.6 | 0.5 |
| $C_{12-18}$ Fatty Acid | 15 | 17 |
| Enzymes | 1.5 | 1.2 |
| PEI 600 EO20 | 4 | — |
| Diethylene triamine penta methylene phosphonic acid or HEDP | 1.3 | — |
| Fluorescent brightener | 0.2 | 0.3 |
| Hydrogenated Castor Oil | 0.2 | 0.2 |
| 1,2 propanediol | 16 | 12 |
| Glycerol | 6.2 | 8.5 |
| Sodium hydroxide | — | 1 |
| Mono Ethanol Amine | 7.9 | 6.1 |
| Dye | Present | Present |
| PDMS | — | 2.7 |
| Potassium sulphite | 0.2 | 0.2 |
| Perfume Microcapsules(1) | 1.5 | 0.9 |
| Glyceride copolymer according to Examples 1-8 (mixtures thereof may also be used) | 1-10 | 1-10 |
| Water* | Up to 100% | Up to 100% |

*Based on total cleaning and/or treatment composition weight, a total of no more than 12% water (1)Available from Appleton Paper of Appleton, WI The composition provided by the formula above is made by combining such ingredients in accordance with the method of making provided in this specification.

Example 14—Laundry Pastille Composition

| Example of laundry pastille compositions | A | B | C |
|---|---|---|---|
| PEG 8000 | 75 | 70-80 | 75 |
| PEG 400 | 5 | 0 | 0-5 |
| Glyceride copolymer according to Examples 1-8 (mixtures thereof may also be used) | 1-20 | 1-25 | 1-25 |
| Neat Perfume | 0-5 | 0-5 | 0-5 |
| Perfume Microcapsules(1) | 0-5 | 0-5 | 0-5 |
| Polyquaternium-7(2) | — | — | 0-2 |
| Polyquaternium-10(3) | 0-2 | 0-2 | — |
| Stabilizers, dyes & other optional ingredients | q.s. to 100% | q.s. to 100% | q.s. to 100% |

(5)Available from Appleton Paper of Appleton, WI (6)Available from BASF, Ludwigshafen (7)Available from Dow Chemicals under the tradename Polymer PK or LR400 Ingredients are combined and mixed by conventional means as known by one of ordinary skill in the art.

Raw Materials and Notes for Composition Examples

LAS is linear alkylbenzenesulfonate having an average aliphatic carbon chain length $C_9$-$C_{15}$ supplied by Stepan, Northfield, Ill., USA or Huntsman Corp. (HLAS is acid form).

$C_{12-14}$ Dimethylhydroxyethyl ammonium chloride, supplied by Clariant GmbH, Germany AE3S is $C_{12-15}$ alkyl ethoxy (3) sulfate supplied by Stepan, Northfield, Ill., USA AE7 is $C_{12-15}$ alcohol ethoxylate, with an average degree of ethoxylation of 7, supplied by Huntsman, Salt Lake City, Utah, USA AES is $C_{10-18}$ alkyl ethoxy sulfate supplied by Shell Chemicals.

AE9 is $C_{12-13}$ alcohol ethoxylate, with an average degree of ethoxylation of 9, supplied by Huntsman, Salt Lake City, Utah, USA HSAS or $HC_{16-17}$ HSAS is a mid-branched primary alkyl sulfate with average carbon chain length of about 16-17

Sodium tripolyphosphate is supplied by Rhodia, Paris, France

Zeolite A is supplied by Industrial Zeolite (UK) Ltd, Grays, Essex, UK 1.6R Silicate is supplied by Koma, Nestemica, Czech Republic Sodium Carbonate is supplied by Solvay, Houston, Tex., USA Polyacrylate MW 4500 is supplied by BASF, Ludwigshafen, Germany Carboxymethyl cellulose is Finnfix® V supplied by CP Kelco, Arnhem, Netherlands Suitable chelants are, for example, diethylenetetraamine pentaacetic acid (DTPA) supplied by Dow Chemical, Midland, Mich., USA or Hydroxyethane di phosphonate (HEDP) supplied by Solutia, St Louis, Mo., USA Bagsvaerd, Denmark Savinase®, Natalase®, Stainzyme®, Lipex®, Celluclean™, Mannaway® and Whitezyme® are all products of Novozymes, Bagsvaerd, Denmark.

Proteases may be supplied by Genencor International, Palo Alto, Calif., USA (e.g. Purafect Prime®) or by Novozymes, Bagsvaerd, Denmark (e.g. Liquanase®, Coronase®).

Fluorescent Brightener 1 is Tinopal® AMS, Fluorescent Brightener 2 is Tinopal® CBS-X, Sulphonated zinc phthalocyanine and Direct Violet 9 is Pergasol® Violet BN-Z all supplied by Ciba Specialty Chemicals, Basel, Switzerland Sodium percarbonate supplied by Solvay, Houston, Tex., USA Sodium perborate is supplied by Degussa, Hanau, Germany NOBS is sodium nonanoyloxybenzenesulfonate, supplied by Future Fuels, Batesville, USA TAED is tetraacetylethylenediamine, supplied under the Peractive® brand name by Clariant GmbH, Sulzbach, Germany.

S-ACMC is carboxymethylcellulose conjugated with C.I. Reactive Blue 19, sold by Megazyme, Wicklow, Ireland under the product name AZO-CM-CELLULOSE, product code S-ACMC.

Soil release agent is Repel-o-tex® PF, supplied by Rhodia, Paris, France

Acrylic Acid/Maleic Acid Copolymer is molecular weight 70,000 and acrylate:maleate ratio 70:30, supplied by BASF, Ludwigshafen, Germany Na salt of Ethylenediamine-N,N'-disuccinic acid, (S,S) isomer (EDDS) is supplied by Octel, Ellesmere Port, UK Hydroxyethane di phosphonate (HEDP) is supplied by Dow Chemical, Midland, Mich., USA Suds suppressor agglomerate is supplied by Dow Corning, Midland, Mich., USA $C_{12-14}$ dimethyl Amine Oxide is supplied by Procter & Gamble Chemicals, Cincinnati, USA Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40:60 and no more than 1 grafting point per 50 ethylene oxide units.

Ethoxylated polyethyleneimine is polyethyleneimine (MW=600) with 20 ethoxylate groups per —NH.

Cationic cellulose polymer is LK400, LR400 and/or JR30M from Amerchol Corporation, Edgewater N.J.

Note: all enzyme levels are expressed as % enzyme raw material.

Example 15

Examples of free flowing particles products that comprise glyceride copolymers according to the present invention.

| | COMPOSITION | | | |
|---|---|---|---|---|
| Component | 1<br>% Wt<br>Active | 2<br>% Wt<br>Active | 3<br>% Wt<br>Active | 4<br>% Wt<br>Active |
| Polyethylene glycol | 70-99 | 0-20 | 0-29 | 0-40 |
| Clay | 0-29 | 0-20 | 0-20 | 0-10 |
| NaCl | 0-29 | 50-99 | 0-29 | 0-40 |
| Na2SO4 | 0-10 | 0-10 | 0-10 | 0-5 |
| Urea | 0-29 | 0-29 | 0-99 | 0-40 |
| Polysaccharide | 0-29 | 0-29 | 0-29 | 0-5 |
| Zeolite | 0-29 | 0-29 | 0-29 | 0-5 |
| Plasticizers/Solvents | 0-5 | 0-5 | 0-5 | 0-5 |
| Starch/Zeolite | 0-29 | 0-29 | 0-29 | 0-5 |
| Silica | 0-5 | 0-5 | 0-5 | 0-5 |
| Metal oxide | 0-29 | 0-29 | 0-29 | 0-29 |
| Metal catalyst | 0.001-0.5 | 0.001-0.5 | 0.001-0.5 | 0.001-0.5 |
| Opacifier | 0-5 | 0-5 | 0-1 | 0-1 |
| Water | 0-2 | 0-2 | 0-5 | 0-5 |
| Perfume | 0-5 | 0-5 | 0-5 | 0-5 |
| Perfume Microcapsules(1) | 0.001-10 | 0.001-4.5 | 0.001-3 | 0.001-7.5 |
| Glyceride copolymer according to Examples 1-8 (mixtures thereof may also be used) | 1-25 | 1-25 | 1-25 | 1-25 |

| | COMPOSITION | | | |
|---|---|---|---|---|
| Component | 5<br>% Wt<br>Active | 6<br>% Wt<br>Active | 7<br>% Wt<br>Active | 8<br>% Wt<br>Active |
| Polyethylene glycol | 70-99 | 0-20 | 0-29 | 0-40 |
| Clay | 0-29 | 0-20 | 0-20 | 0-10 |
| NaCl | 0-29 | 50-99 | 0-29 | 0-40 |
| Na2SO4 | 0-10 | 0-10 | 0-10 | 0-5 |
| Urea | 0-29 | 0-29 | 0-99 | 0-40 |
| Polysaccharide | 0-29 | 0-29 | 0-29 | 0-5 |
| Zeolite | 0-29 | 0-29 | 0-29 | 0-5 |
| Plasticizers/Solvents | | | | |
| Starch/Zeolite | 0-29 | 0-29 | 0-29 | 0-5 |
| Silica | 0-5 | 0-5 | 0-5 | 0-5 |
| Metal oxide | 0-29 | 0-29 | 0-29 | 0-29 |
| Metal catalyst | 0.001-0.5 | 0.001-0.5 | 0.001-0.5 | 0.001-0.5 |
| Opacifier | 0-5 | 0-5 | 0-1 | 0-1 |
| Water | 0-2 | 0-2 | 0-5 | 0-5 |
| Perfume Microcapsules(10) | 0.001-10 | 0.001-4.5 | 0.001-3 | 0.001-7.5 |
| Glyceride copolymer according to Examples 1-8 (mixtures thereof may also be used) | 1-25 | 1-25 | 1-25 | 1-25 |

(1)PEG (2) Clay (3) Urea (4) Polysaccharide, mostly starches, unmodified starches, starch derivatives, acid-modified starch and kappa carrageenan (5) Zeolite (6) Starch/Zeolite - SEA (7) Metal oxides - non-limiting examples - TiO2, ZnO, MnO (8) Metal catalysts (9) Opacifier (10)Available from Appvion, Appleton, WI.

The composition provided by the formula above is made by combining such ingredients in accordance with the method of making provided in this specification.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising,

A) a glyceride copolymer having formula (I):

(I)

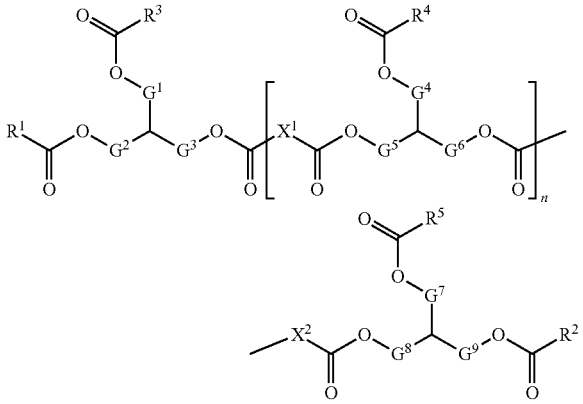

wherein:

each $R^1$, $R^2$, $R^3$, $R^4$, and $R^5$ in the glyceride copolymer is independently selected from the group consisting of an oligomeric glyceride moiety, a $C_{1-24}$ alkyl, a substituted $C_{1-24}$ alkyl wherein the substituent is one or more —OH moieties, a $C_{2-24}$ alkenyl, or a substituted $C_{2-24}$ alkenyl wherein the substituent is one or more OH moieties; and/or wherein each of the following combinations of moieties may each independently be covalently linked:

$R^1$ and $R^3$, $R^2$ and $R^5$, $R^1$ and an adjacent $R^4$, $R^2$ and an adjacent $R^4$, $R^3$ and an adjacent $R^4$, $R^5$ and an adjacent $R^4$, or any two adjacent $R^4$ such that the covalently linked moieties form an alkenylene moiety;

each $X^1$ and $X^2$ in said glyceride copolymer is independently selected from the group consisting of a $C_{1-32}$ alkylene, a substituted $C_{1-32}$ alkylene wherein the substituent is one or more —OH moieties, a $C_{2-32}$ alkenylene or a substituted $C_{2-32}$ alkenylene wherein the substituent is one or more —OH moieties;

two of $G^1$, $G^2$, and $G^3$ are —$CH_2$—, and one of $G^1$, $G^2$, and $G^3$ is a direct bond; for each individual repeat unit in the repeat unit having index n, two of $G^4$, $G^5$, and $G^6$ are —$CH_2$—, and one of $G^4$, $G^5$, and $G^6$ is a direct bond, and the values $G^4$, $G^5$, and $G^6$ for each individual repeat unit are independently selected from the values of $G^4$, $G^5$, and $G^6$ in other repeating units;

two of $G^7$, $G^8$, and $G^9$ are —$CH_2$—, and one of $G^7$, $G^8$, and $G^9$ is a direct bond;

n is an integer from 3 to 250;

with the proviso for each of said glyceride copolymers at least one of $R^1$, $R^2$, $R^3$, and $R^5$, and/or at least one $R^4$ in one individual repeat unit of said repeat unit having index n, is selected from the group consisting of: 8-nonenyl; 8-decenyl; 8-undecenyl; 8-dodecenyl; 8,11-dodecadienyl; 8,11-tridecadienyl; 8,11-tetradecadienyl; 8,11-pentadecadienyl; 8,11,14-pentadecatrienyl; 8,11,14-hexadecatrienyl; 8,11,14-octadecatrienyl; 9-methyl-8-decenyl; 9-methyl-8-undecenyl; 10-methyl-8-undecenyl; 12-methyl-8,11-tridecadienyl; 12-methyl-8,11-tetradecadienyl; 13-methyl-8,11-tetradecadienyl; 15-methyl-8,11,14-hexadecatrienyl; 15-methyl-8,11,14-heptadecatrienyl; 16-methyl-8,11,14-heptadecatrienyl; 12-tridecenyl; 12-tetradecenyl; 12-pentadecenyl; 12-hexadecenyl; 13-methyl-12-tetradecenyl; 13-methyl-12-pentadecenyl; and 14-methyl-12-pentadecenyl; and B) a material selected from the group consisting of a fabric softener active, a fabric care benefit agent, an anionic surfactant scavenger, a delivery enhancing agent, a perfume, a perfume delivery system, a structurant, a soil dispersing polymer, a brightener, a hueing dye, dye transfer inhibiting agent, builder, surfactant, an enzyme, a carrier, and mixtures thereof, wherein said composition is a fabric care composition.

2. The composition of claim 1 wherein said glyceride copolymer has a weight average molecular weight of from about 4,000 g/mol to about 150,000 g/mol.

3. The composition according to claim 1, wherein for said glyceride copolymer at least one of $R^1$, $R^2$, $R^3$, $R^4$, or $R^5$ is a $C_{9-13}$ alkenyl.

4. The composition according to claim 1, wherein for the glyceride copolymer, $R^1$ is a $C_{1-24}$ alkyl or a $C_{2-24}$ alkenyl.

5. The composition according to claim 1, wherein for the glyceride copolymer, $R^2$ is a $C_{1-24}$ alkyl or a $C_{2-24}$ alkenyl.

6. The composition according to claim 1, wherein for the glyceride copolymer, $R^3$ is a $C_{1-24}$ alkyl or a $C_{2-24}$ alkenyl.

7. The composition according to claim 1, wherein for the glyceride copolymer, each $R^4$ is independently selected from a $C_{1-24}$ alkyl and a $C_{2-24}$ alkenyl.

8. The composition according to claim 1, wherein for the glyceride copolymer, $R^5$ is a $C_{1-24}$ alkyl or a $C_{2-24}$ alkenyl.

9. A composition according to claim 1, wherein said composition comprises based on total composition weight, from about 0.1% to about 50% of said glyceride copolymer.

10. A composition according to claim 1, comprising one or more of the following:

a) from about 0.01% to about 50% of said fabric softener active;
b) from about 0.001% to about 15% of said anionic surfactant scavenger;
c) from about 0.01% to about 10%, of said delivery enhancing agent;
d) from about 0.005% to about 30% of said perfume;
e) from about 0.005% to about 30% of said perfume delivery system;
f) from about 0.01% to about 20% of said soil dispersing polymer;
g) from about 0.001% to about 10% of said brightener;
h) from about 0.0001% to about 10% of said hueing dye;
i) from about 0.0001% to about 10% of said dye transfer inhibiting agent;
j) from about 0.01% to about 10% of said enzyme;
k) from about 0.01% to about 20% of said structurant;
l) from about 0.05% to about 20% of said fabric care benefit agent;
m) from about 0.1% to about 80% of said builder;
n) from about 0.1% to about 99% of a carrier; and
o) mixtures thereof.

11. A composition according to claim 1 wherein:

a) said fabric softener active comprises a cationic fabric softener;
b) said anionic surfactant scavenger comprises a water soluble cationic and/or zwitterionic scavenger compound;
c) said delivery enhancing agent comprises a material selected from the group consisting of a cationic polymer having a charge density from about 0.05 milliequivalent/g to about 23 milliequivalent per gram of polymer, an amphoteric polymer having a charge density from about 0.05 milliequivalent/g to about 23 milliequivalent per gram of polymer, a protein having a charge density from about 0.05 milliequivalent/g to about 23 milliequivalent per gram of protein and mixtures thereof;
d) said perfume delivery system is selected from the group consisting of a Polymer Assisted Delivery (PAD) system, Molecule-Assisted Delivery (MAD) system, Cyclodextrin (CD) system, Starch Encapsulated Accord (SEA) system, Zeolite & Inorganic Carrier (ZIC) system, and mixtures thereof;
e) said soil dispersing polymer is selected from the group consisting of a homopolymer, copolymer, or terpolymer of an ethylenically unsaturated monomer anionic monomer, alkoxylated polyamines and mixtures thereof;
f) said brightener is selected from the group consisting of derivatives of stilbene or 4,4'-diaminostilbene, biphenyl, five-membered heterocycles, six-membered heterocycles and mixtures thereof;
g) said hueing dye comprising a moiety selected the group consisting of acridine, anthraquinone, azine, azo, benzodifurane and benzodifuranone, carotenoid, coumarin, cyanine, diazahemicyanine, diphenylmethane, formazan, hemicyanine, indigoid, methane, naphthalimide, naphthoquinone, nitro and nitroso, oxazine, phthalocyanine, pyrazole, stilbene, styryl, triarylmethane, triphenylmethane, xanthene and mixtures thereof;
h) said dye transfer inhibiting agent is selected from the group consisting polyvinylpyrrolidone polymers, polyamine N-oxide polymers, copolymers of N-vinylpyrrolidone and N-vinylimidazole, polyvinyloxazolidones and polyvinylimidazoles or mixtures thereof;
i) said enzyme is selected from the group consisting of hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases and mixtures thereof;
j) said structurant is selected from the group consisting of hydrogenated castor oil, gellan gum, starches, derivatized starches, carrageenan, guar gum, pectin, xanthan gum, modified celluloses, microcrystalline celluloses modified proteins, hydrogenated polyalkylenes, non-hydrogenated polyalkenes, inorganic salts, clay, homo- and co-polymers comprising cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, and mixtures thereof;
k) said fabric care benefit agent is selected from the group consisting of polyglycerol esters, oily sugar derivatives, wax emulsions, silicones, polyisobutylene, polyolefins and mixtures thereof;
l) said surfactant is selected from the group consisting of anionic surfactants, nonionic surfactants, ampholytic surfactants, cationic surfactants, zwitterionic surfactants, and mixtures thereof; and
m) said carrier is selected from the group consisting of water, 1,2-propanediol, hexylene glycol, ethanol, isopropanol, glycerol, $C_1$-$C_4$ alkanolamines, salts, sugars, polyalkylene oxides; polyethylene glycols; polypropylene oxide, and mixtures thereof.

12. A composition according to claim 1 wherein:

a) said fabric softener active is selected from the group consisting of bis-(2-hydroxypropyl)-dimethylammonium methylsulphate fatty acid ester, 1,2-di(acyloxy)-3-trimethylammoniopropane chloride, N,N-bis (stearoyl-oxy-ethyl)-N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)-N-methyl ammonium methylsulfate, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, 1,2 di(stearoyl-oxy) 3 trimethyl ammoniumpropane chloride, dicanoladimethylammonium chloride, di(hard)tallowdimethylammonium chloride dicanoladimethylammonium methylsulfate, Dipalmethyl Hydroxyethylammoinum Methosulfate and mixtures thereof;
b) said anionic surfactant scavenger is selected from the group consisting of monoalkyl quaternary ammonium compounds, amine precursors of monoalkyl quaternary ammonium compounds, dialkyl quaternary ammonium compounds, and amine precursors of dialkyl quaternary ammonium compounds, polyquaternary ammonium compounds, amine precursors of polyquaternary ammonium compounds, and mixtures thereof;

c) said delivery enhancing agent is selected from the group consisting of cationic polysaccaharides, polyethyleneimine and its derivatives, polyamidoamines and homopolymers, copolymers and terpolymers made from one or more cationic monomers selected from the group consisting of N,N-dialkylaminoalkyl methacrylate, N,N-dialkylaminoalkyl methyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl methyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof;

d) said soil dispersing polymer is selected from the group consisting of alkoxylated polyethyleneimines, homopolymer or copolymer of acrylic acid, methacrylic acid, methyl methacrylate, itaconic acid, fumaric acid, 3-allyloxy-2-hydroxy-1-propane-sulfonic acid (HAPS) and their salts, allyl sulfonic acid and their salts, maleic acid, vinyl sulfonic acid, acrylamidopropylmethane sulfonic acid (AMPS) and their salts, derivatives and combinations thereof;

e) said brightener is selected from the group consisting of derivatives of stilbene or 4,4'-diaminostilbene, biphenyl, five-membered heterocycles and mixtures thereof;

f) said hueing dye is selected from the group consisting of Direct Violet dyes, Direct Blue dyes, Acid Red dyes, Acid Violet dyes, Acid Blue dyes, Acid Black dyes, Basic Violet dyes, Basic Blue dyes, Disperse or Solvent dyes and mixtures thereof;

g) said enzyme is selected from the group consisting of hemicellulases, peroxidases, proteases, cellulases, xylanases, lipases, phospholipases, esterases, cutinases, pectinases, pentosanases, malanases, β-glucanases, laccase, amylases and mixtures thereof;

h) said surfactant is selected from the group consisting of alkyl sulfate, alkyl ethoxysulfate, linear alkylbenzene sulfonate, alpha olefin sulfonate, ethoxylated alcohols, ethoxylated alkyl phenols, fatty acids, soaps, and mixtures thereof; and i) said fabric care benefit agent is selected from the group consisting of polydimethylsiloxane, silicone polyethers, cationic silicone, aminosilicone, and mixtures thereof.

13. A composition according to claim 1, wherein said material comprises:

a) a surfactant selected from the group consisting of anionic surfactants, nonionic surfactants, ampholytic surfactants, cationic surfactants, zwitterionic surfactants, and mixtures thereof; and b) a carrier;

wherein said composition has a pH of from about 4 to about 12.

14. A composition according to claim 1, wherein said material comprises about 49 to about 99%, based on total composition weight, of said carrier, wherein said carrier is selected from the group consisting of polyethylene glycol, salt, polysaccharide and sugar.

15. A composition according to claim 1 wherein said material comprises:

a) a fabric softening active, a perfume, and a delivery enhancing agent; or b) a fabric softening active, a perfume and a perfume delivery system; or c) a hueing dye and a surfactant; or d) less than 10% total water, said total water being the sum of the free and bound water; or e) a fabric softening active, a fabric care benefit agent and a delivery enhancing agent; or g) a fabric care benefit agent, anionic surfactant scavenger and a delivery enhancing agent; or h) a perfume delivery system.

16. A composition according to claim 1, wherein said composition is in the form of an emulsion, a gel network or lamellar phase.

17. A composition according to claim 1, wherein said composition is in the form of a crystal, a bead or a pastille.

18. An article comprising the composition according to claim 1 and a water soluble film.

19. An article comprising the composition according to claim 1, said article being in the form of a dryer sheet.

20. A fabric treated with the composition according to claim 1.

21. A method of treating and/or cleaning a fabric, said method comprising contacting said fabric with said composition of claim 1.

* * * * *